US009406269B2

(12) United States Patent
Lo et al.

(10) Patent No.: US 9,406,269 B2
(45) Date of Patent: Aug. 2, 2016

(54) SYSTEM AND METHOD FOR PULSE WIDTH MODULATING A SCROLLING COLOR DISPLAY

(71) Applicant: Jasper Display Corp., Hsinchu (TW)

(72) Inventors: Robert Lo, San Jose, CA (US); Edwin Lyle Hudson, San Jose, CA (US); David Charles McDonald, Longmont, CO (US)

(73) Assignee: JASPER DISPLAY CORP., Hsinchu (TW)

( * ) Notice: Subject to any disclaimer, the term of this patent is extended or adjusted under 35 U.S.C. 154(b) by 260 days.

(21) Appl. No.: 14/200,116

(22) Filed: Mar. 7, 2014

(65) Prior Publication Data

US 2014/0267453 A1 Sep. 18, 2014

Related U.S. Application Data

(60) Provisional application No. 61/788,807, filed on Mar. 15, 2013.

(51) Int. Cl.
*G09G 3/36* (2006.01)
*G09G 3/02* (2006.01)
(Continued)

(52) U.S. Cl.
CPC ..... *G09G 3/3648* (2013.01); *G09G 3/025* (2013.01); *G09G 3/2022* (2013.01); *G09G 3/2092* (2013.01); *G09G 5/06* (2013.01); *G09G 2300/0823* (2013.01); *G09G 2320/0204* (2013.01); *G09G 2320/0247* (2013.01); *G09G 2360/128* (2013.01); *G09G 2370/12* (2013.01)

(58) Field of Classification Search
CPC ... G09G 3/3648; G09G 3/025; G09G 3/2022; G09G 3/2092; G09G 5/06; G09G 2300/0823; G09G 2320/0204; G09G 2320/0247; G09G 2360/128; G09G 2370/12; G09G 3/36
See application file for complete search history.

(56) References Cited

U.S. PATENT DOCUMENTS 5,189,406 A 2/1993 Humphries et al.
5,537,128 A 7/1996 Keene et al.
5,548,347 A 8/1996 Melnik et al.
(Continued)

FOREIGN PATENT DOCUMENTS

EP 0658870 6/1995
EP 1187087 3/2002
(Continued)

OTHER PUBLICATIONS

Nakamura et al, "Modified drive method for OCB LSD," Proceeding of the International Display Research Conference, 1997, Society for Information Display, Campbell, CA, US.
(Continued)

*Primary Examiner* — Lun-Yi Lao
*Assistant Examiner* — Jarurat Suteerawongsa
(74) *Attorney, Agent, or Firm* — Han IP Corporation

(57) ABSTRACT

A method of organizing and ordering pulse width modulation image data is disclosed, so that it may be displayed on the pixels of a scrolling color display. The method includes a method of formatting received image data into a different form suitable for driving a pulse width modulated display and a method of distributing image data across a series of different image modulation segments to minimize flicker and gray scale errors. The method includes means for reducing lateral field effects between adjacent pixels in different data states.

20 Claims, 46 Drawing Sheets

(51) Int. Cl.
*G09G 3/20* (2006.01)
*G09G 5/06* (2006.01)

(56) References Cited

U.S. PATENT DOCUMENTS

| | | | | |
|---|---|---|---|---|
| 5,602,559 | A | 2/1997 | Kimura | |
| 5,619,228 | A | 4/1997 | Doherty | |
| 5,751,264 | A | 5/1998 | Cavallerano et al. | |
| 5,905,482 | A | 5/1999 | Hughes et al. | |
| 5,969,701 | A | 10/1999 | Numao et al. | |
| 6,005,558 | A | 12/1999 | Hudson et al. | |
| 6,034,659 | A | 3/2000 | Wald et al. | |
| 6,046,716 | A | 4/2000 | McKnight | |
| 6,127,991 | A | 10/2000 | Uehara et al. | |
| 6,317,112 | B1 | 11/2001 | Handschy et al. | |
| 6,690,432 | B2 | 2/2004 | Janssen et al. | |
| 6,717,561 | B1 | 4/2004 | Pfeiffer et al. | |
| 6,762,739 | B2 | 7/2004 | Bone | |
| 6,924,824 | B2 | 8/2005 | Adachi et al. | |
| 7,066,605 | B2 | 6/2006 | Dewald et al. | |
| 7,088,329 | B2 | 8/2006 | Hudson | |
| 7,129,920 | B2 | 10/2006 | Chow | |
| 7,379,043 | B2 | 5/2008 | Worley, III et al. | |
| 7,443,374 | B2 | 10/2008 | Hudson | |
| 7,468,717 | B2 | 12/2008 | Hudson | |
| 7,852,307 | B2 | 12/2010 | Hudson | |
| 7,990,353 | B2 | 8/2011 | Chow | |
| 8,040,311 | B2 | 10/2011 | Hudson et al. | |
| 8,111,271 | B2 * | 2/2012 | Hudson | G09G 3/2014 345/690 |
| 8,264,507 | B2 | 9/2012 | Hudson et al. | |
| 8,421,828 | B2 * | 4/2013 | Hudson | G09G 3/3648 345/690 |
| 2002/0043610 | A1 | 4/2002 | Lee et al. | |
| 2003/0174117 | A1 | 9/2003 | Crossland et al. | |
| 2005/0052437 | A1 | 3/2005 | Hudson | |
| 2005/0057466 | A1 | 3/2005 | Sala et al. | |

FOREIGN PATENT DOCUMENTS

| | | |
|---|---|---|
| GB | 2327798 | 2/1999 |
| JP | 7049663 | 2/1995 |
| WO | WO0152229 | 1/2001 |

OTHER PUBLICATIONS

Sloof et al, "An Improved WXGA LCOS Imager for Single Panel Systems," Proceedings of the Asia Symposium on Information Display, 2004, Society for Information Display, Campbell, CA, US.
SMPTE 274M-2005, "1920×1080 Image Sample Structure, Digital Representation and Digital Timing Referrence Sequences for Multiple Picture Rates," 2005, SMPTE, White Plains, New York, US.
Ong, Modern MOS Technology: Processes, Devices and Design, pp. 208-211, 1984, McGraw-Hill, New York, NY, US.
"Sony 3D," screen capture from video clip, 2009, authors unknown.
Robinson, et al, "Polarization Engineering for LCD Projection," pp. 121-123, 2005, John Wiley and Sons, Ltd., Chichester, England.

* cited by examiner

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 |
|---|---|---|---|---|---|---|---|---|---|---|---|---|---|---|---|---|---|---|---|---|---|---|---|---|---|---|---|---|
| 1 | | | | | | $F_1$ | | | | | | | | | | | | | | | | | | | | | | |
| 2 | | | | | $E_1$ | | | | | | | $F_2$ | | | | | | | | | | | | | | | | |
| 3 | | | | | | | | | | | $E_2$ | | | | | | | | $F_3$ | | | | | | | | | |
| 4 | | | | $D_1$ | | | | | | | | | | | | | | $E_3$ | | | | | | $F_4$ | | | | |
| 5 | | | | | | | | | | $D_2$ | | | | | | | | | | | | | $E_4$ | | | | | |
| 6 | | | | | | | | | | | | | | | | $D_3$ | | | | | | | | | | | | |
| 7 | | | | | | | | | | | | | | | | | | | | | | $D_4$ | | | | | | |
| 8 | | | $C_1$ | | | | | | | | | | | | | | | | | | | | | | | | | $D_5$ |
| 9 | | | | | | | | | $C_2$ | | | | | | | | | | | | | | | | | | | |
| 10 | | | | | | | | | | | | | | | $C_3$ | | | | | | | | | | | | | |
| 11 | | | | | | | | | | | | | | | | | | | | | $C_4$ | | | | | | | |
| 12 | | | | | | | | | | | | | | | | | | | | | | | | | | | $C_5$ | |
| 13 | | | | | | | | | | | | | | | | | | | | | | | | | | | | |
| 14 | | | | | | | | | | | | | | | | | | | | | | | | | | | | |
| 15 | | | | | | | | | | | | | | | | | | | | | | | | | | | | |
| 16 | | $B_1$ | | | | | | | | | | | | | | | | | | | | | | | | | | |
| 17 | | | | | | | | | $B_2$ | | | | | | | | | | | | | | | | | | | |
| 18 | | | | | | | | | | | | | | $B_3$ | | | | | | | | | | | | | | |
| 19 | | | | | | | | | | | | | | | | | | | | $B_4$ | | | | | | | | |
| 20 | | | | | | | | | | | | | | | | | | | | | | | | | | $B_5$ | | |
| 21 | | | | | | | | | | | | | | | | | | | | | $C_4$ | | | | | | | |
| 22 | | | | | | | | | | | | | | | | | | | | | | $D_4$ | | | | | | |
| 23 | | | | | | | | | | | | | | | | | | | | | | | $E_4$ | | | | | |
| 24 | $A_1$ | | | | | | | | | | | | | | | | | | | | | | | $F_4$ | | | | |
| 25 | | | | | | | $A_2$ | | | | | | | | | | | | | | | | | | $A_5$ | | | |
| 26 | | | | | | | | | | | | | $A_3$ | | | | | | | | | | | | | | | |
| 27 | | | | | | | | | | | | | | | | | | | $A_4$ | | | | | | | | | |
| 28 | | | | | | | | | | | | | | | | | | | | | | | | | | | | |

Time

Fig. 9A

| | | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| 1 | | | | | | $A_2T$ | | | | | | | | | | | | | | | | | | | | | | |
| 2 | | | | | $E_1$ | | | | | | $A_3T$ | | | | | | | | | | | | | | | | | |
| 3 | | | | | | | | | | $E_2$ | | | | | | $A_4T$ | | | | | | | | | | | | |
| 4 | | | | $D_1$ | | | | | | | | | | | $E_3$ | | | | | | $A_5T$ | | | | | | | |
| 5 | | | | | | | | | $D_2$ | | | | | | | | | | | $E_4$ | | | | | | $A_6T$ | | |
| 6 | | | | | | | | | | | | | | $D_3$ | | | | | | | | | | | $E_5$ | | | |
| 7 | | | | | | | | | | | | | | | | | | | $D_4$ | | | | | | | | | |
| 8 | | | $C_1$ | | | | | | | | | | | | | | | | | | | | | $D_5$ | | | | |
| 9 | | | | | | | | $C_2$ | | | | | | | | | | | | | | | | | | | | |
| 10 | | | | | | | | | | | | | C3 | | | | | | | | | | | | | | | |
| 11 | | | | | | | | | | | | | | | | | | $C_4$ | | | | | | | | | | |
| 12 | | | | | | | | | | | | | | | | | | | | | | | $C_5$ | | | | | |
| 13 | | | | | | | | | | | | | | | | | | | | | | | | | | | | $C_6$ |
| 14 | | | | | | | | | | | | | | | | | | | | | | | | | | | | |
| 15 | | | | | | | | | | | | | | | | | | | | | | | | | | | | |
| 16 | | $B_1$ | | | | | | | | | | | | | | | | | | | | | | | | | | |
| 17 | | | | | | | $B_2$ | | | | | | | | | | | | | | | | | | | | | |
| 18 | | | | | | | | | | | | $B_3$ | | | | | | | | | | | | | | | | |
| 19 | | | | | | | | | | | | | | | | | $B_4$ | | | | | | | | | | | |
| 20 | | | | | | | | | | | | | | | | | | | | | | $B_5$ | | | | | | |
| 21 | | | | | | | | | | | | | | | | | | | | | | | | | | | $B_6$ | |
| 22 | | | | | | | | | | | | | | | | | | | | | | | | | | | | |
| 23 | | | | | | | | | | | | | | | | | | | | | | | | | | | | |
| 24 | $A_1$ | | | | | | | | | | | | | | | | | | | | | | | | | | | |
| 25 | | | | | | $A_2$ | | | | | | | | | | | | | | | | | | | | | | |
| 26 | | | | | | | | | | | $A_3$ | | | | | | | | | | | | | | | | | |
| 27 | | | | | | | | | | | | | | | | $A_4$ | | | | | | | | | | | | |
| 28 | | | | | | | | | | | | | | | | | | | | | $A_5$ | | | | | | | |
| 29 | | | | | | | | | | | | | | | | | | | | | | | | | | $A_6$ | | |
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 |

Time →

Fig. 9B $A_i$
$B_i$
$C_i$
$D_i$
$E_i$
$F_i$
$A_{i+1}$
T
455
456
457
458
459
8
4
2
1
Time 475
476
477
478
8
4
2
1
$A_i$ $B_i$ $C_i$
$D_i$ $E_i$ $F_i$
$G_i$ $H_i$ $I_i$
$J_i$ $K_i$ $L_i$
$M_i$ $N_i$ $O_i$
$A_{i+1}T$ $B_{i+1}T$ $C_{i+1}T$
Time

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 |
|---|---|---|---|---|---|---|---|---|---|---|---|---|---|---|---|---|---|---|---|---|---|---|---|---|---|---|---|---|
| 1 | | | | | | $F_1$ | | | | | | | | | | | | | | | | | | | | | | |
| 2 | | | | | $E_1$ | | | | | | | $F_2$ | | | | | | | | | | | | | | | | |
| 3 | | | | $D_1$ | | | | | | | $E_2$ | | | | | | | $F_3$ | | | | | | | | | | |
| 4 | | | | | | | | | | $D_2$ | | | | | | | $E_3$ | | | | | | | $F_4$ | | | | |
| 5 | | | $C_1$ | | | | | | | | | | | | | $D_3$ | | | | | | | $E_4$ | | | | | |
| 6 | | | | | | | | | $C_2$ | | | | | | | | | | | | | $D_4$ | | | | | | |
| 7 | | | | | | | | | | | | | | | $C_3$ | | | | | | | | | | | | | $D_5$ |
| 8 | | | | | | | | | | | | | | | | | | | | | $C_4$ | | | | | | | |
| 9 | | $B_1$ | | | | | | | | | | | | | | | | | | | | | | | | | $C_5$ | |
| 10 | | | | | | | | $B_2$ | | | | | | | | | | | | | | | | | | | | |
| 11 | | | | | | | | | | | | | | $B_3$ | | | | | | | | | | | | | | |
| 12 | | | | | | | | | | | | | | | | | | | | $B_4$ | | | | | | | | |
| 13 | | | | | | | | | | | | | | | | | | | | | | | | | | $B_5$ | | |
| 14 | | | | | | | | | | | | | | | | | | | | | | | | | | | | |
| 15 | | | | | | | | | | | | | | | | | | | | | | | | | | | | |
| 16 | | | | | | | | | | | | | | | | | | | | | | | | | | | | |
| 17 | $A_1$ | | | | | | | | | | | | | | | | | | | | | | | | | | | |
| 18 | | | | | | | $A_2$ | | | | | | | | | | | | | | | | | | | | | |
| 19 | | | | | | | | | | | | | $A_3$ | | | | | | | | | | | | | | | |
| 20 | | | | | | | | | | | | | | | | | | | $A_4$ | | | | | | | | | |
| 21 | | | | | | | | | | | | | | | | | | | | | | | | | $A_5$ | | | |
| 22 | | | | | | | | | | | | | | | | | | | | | | | | | | | | |
| 23 | | | | | | | | | | | | | | | | | | | | | | | | | | | | |
| 24 | | | | | | | | | | | | | | | | | | | | | | | | | | | | |
| 25 | | | | | | | | | | | | | | | | | | | | | | | | | | | | |
| 26 | | | | | | | | | | | | | | | | | | | | | | | | | | | | |
| 27 | | | | | | | | | | | | | | | | | | | | | | | | | | | | |
| 28 | | | | | | | | | | | | | | | | | | | | | | | | | | | | |

Time →

Fig. 13A

| | | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| 1 | | | | | | $A_2T$ | | | | | | | | | | | | | | | | | | | | | | |
| 2 | | | | | $E_1$ | | | | | | $A_3T$ | | | | | | | | | | | | | | | | | |
| 3 | | | | $D_1$ | | | | | | $E_2$ | | | | | | $A_4T$ | | | | | | | | | | | | |
| 4 | | | | | | | | | $D_2$ | | | | | | $E_3$ | | | | | | $A_5T$ | | | | | | | |
| 5 | | | $C_1$ | | | | | | | | | | | $D_3$ | | | | | | $E_4$ | | | | | | $A_6T$ | | |
| 6 | | | | | | | | $C_2$ | | | | | | | | | | | $D_4$ | | | | | | $E_5$ | | | |
| 7 | | | | | | | | | | | | | $C_3$ | | | | | | | | | | | $D_5$ | | | | |
| 8 | | | | | | | | | | | | | | | | | | $C_4$ | | | | | | | | | | |
| 9 | | $B_1$ | | | | | | | | | | | | | | | | | | | | | $C_5$ | | | | | |
| 10 | | | | | | | $B_2$ | | | | | | | | | | | | | | | | | | | | | $C_6$ |
| 11 | | | | | | | | | | | | $B_3$ | | | | | | | | | | | | | | | | |
| 12 | | | | | | | | | | | | | | | | | $B_4$ | | | | | | | | | | | |
| 13 | | | | | | | | | | | | | | | | | | | | | | $B_5$ | | | | | | |
| 14 | | | | | | | | | | | | | | | | | | | | | | | | | | | $B_6$ | |
| 15 | | | | | | | | | | | | | | | | | | | | | | | | | | | | |
| 16 | | | | | | | | | | | | | | | | | | | | | | | | | | | | |
| 17 | $A_1$ | | | | | | | | | | | | | | | | | | | | | | | | | | | |
| 18 | | | | | | $A_2$ | | | | | | | | | | | | | | | | | | | | | | |
| 19 | | | | | | | | | | | $A_3$ | | | | | | | | | | | | | | | | | |
| 20 | | | | | | | | | | | | | | | | $A_4$ | | | | | | | | | | | | |
| 21 | | | | | | | | | | | | | | | | | | | | | $A_5$ | | | | | | | |
| 22 | | | | | | | | | | | | | | | | | | | | | | | | | | $A_6$ | | |
| 23 | | | | | | | | | | | | | | | | | | | | | | | | | | | | |
| 24 | | | | | | | | | | | | | | | | | | | | | | | | | | | | |
| 25 | | | | | | | | | | | | | | | | | | | | | | | | | | | | |
| 26 | | | | | | | | | | | | | | | | | | | | | | | | | | | | |
| 27 | | | | | | | | | | | | | | | | | | | | | | | | | | | | |
| 28 | | | | | | | | | | | | | | | | | | | | | | | | | | | | |
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 |

Time →

Fig. 13B $A_i$
$B_i$
$C_i$
$D_i$
$E_i$
$F_i$
$A_{i+1}T$
485
486
487
488
489
8
4
2
1
Time $A_i$ $B_i$ $C_i$ $D_i$ $E_i$ $F_i$ $G_i$ $H_i$ $I_i$ $J_i$
$A_i$ $B_i$ $C_i$ $D_i$ $E_i$ $F_i$ $G_i$ $H_i$ $A_{i+1}T$ $B_{i+1}T$
495
496
497
498
4
2
1
Time Time Time

SYSTEM AND METHOD FOR PULSE WIDTH MODULATING A SCROLLING COLOR DISPLAY

CROSS-REFERENCE TO RELATED APPLICATIONS

This application is a Continuation-in-Part of pending U.S. patent application Ser. No. 13/790,120, "MODULATION SCHEME FOR DRIVING DIGITAL DISPLAY SYSTEMS," which is a continuation of U.S. patent application Ser. No. 10/435,427, now U.S. Pat. No. 8,421,828, filed May 9, 2003, and is a Continuation-in-Part of pending U.S. patent application Ser. No. 13/252,356, "PIXEL CIRCUIT AND DISPLAY SYSTEM COMPRISING SAME", filed Oct. 4, 2011.

This application also claims the benefit of U.S. provisional patent application Ser. No. 61/788,807, filed Mar. 15, 2013, entitled "SYSTEM AND METHOD FOR PULSE WIDTH MODULATING A SCROLLING COLOR DISPLAY" which is also incorporated herein by reference.

FIELD OF THE INVENTION

The present invention relates to projection display systems useful to display projected images on a viewing surface. More particularly, the present invention relates to a projection display system wherein the system utilizes scrolling color means to illuminate a microdisplay or spatial light modulator wherein the microdisplay or spatial light modulator is pulse width modulated to create gray scale images.

BACKGROUND OF THE INVENTION

Projection display systems are a common component in home theater and digital cinema applications. Projection display system need achieve only a level of brightness appropriate to the size of the screen and the position of the audience in order to be useful, whereas a direct view display must be physically large enough. Size, cost, brightness, contrast and resolution are all important characteristics for projection displays. Most recently digital cinema projectors utilizing typically three reflective mode spatial light modulators have been fielded in significant numbers. These digital cinema systems utilize high power light sources such as xenon lamps and are able to project images onto screens that may be 90 feet or more wide. In 2010 the Eastman Kodak Company demonstrated a digital cinema projection system prototype system utilizing high power lasers as an alternative to projection systems utilizing xenon lamps for illumination.

A projection system for such applications must meet a number of performance requirements to provide a satisfactory viewing experience for an audience drawn from the general public. The displayed images must not exhibit objectionable flicker or motion blurring due to an unacceptably low data frame rate or any other cause. The displayed images should not exhibit choppy motion due to a low data capture rate during development of the material being shown. The projection system must reproduce colors such that the images on the screen appear true to life.

Methods for dealing with these issues are well known in the art. Flicker is well understood. In film based cinema images are captured at a rate of 24 frames per second. Film projectors use a double blade shutter so a given frame is shown twice after being pulled down into the display position, thus raising the effective rate of display to 48 frames per second. Early experimental television display systems based on CRTs were configured to match this frame rate but it proved ineffective at eliminating flicker because of differences in the stability of the displayed images, but this was largely overcome when the frame rate was raised to 60 frames per second. Motion blurring was alleviated by the double shutter method although the cause differs from that of flicker. Motion blurring was largely not present in CRT based displays because the phosphors in the CRT had low persistence, resulting in images comprising a set of impulses of light that are a millisecond or two long within a frame of over 16 milliseconds duration. Solutions to blurring in hold type displays such as liquid crystal displays were identified in "Modified drive method for OCB LCD", Proceeding of the International Display Research Conference, 1997, by H. Nakamura et al. The authors describe therein the backlight to a direct view transmissive display was periodically blanked electronically. The duration of the blanking period and the best rate for blanking were determined experimentally. Later evidence suggests that each display type may require a different optimal duration.

Scrolling color projection displays comprise a part of the art of liquid crystal displays. Previously, a rear projection television product incorporating a scrolling color display subsystem was offered for sale. The general operating principle of a scrolling color display system is that illuminating light in the form of three primary color bands with dark guard bands between them is formed. These bands are substantially the width of the display horizontally and relatively narrow vertically. By convention the rows of a display run horizontally and the columns of a display run vertically. Scanning optics cause the colored bands to be sequentially scanned down the face of a spatial light modulator, such as a liquid crystal on silicon microdisplay. At substantially the same time that each color passes over a given row on the spatial light modulator that row is addressed with the first of a series of pulse width modulation data values appropriate to that row and that color, with the duration of the sequence of pulses substantially contemporaneous with the duration of the illumination of that row by that color, thereby creating that color portion of that row on the display. The image is projected by a projection lens onto a viewing surface, such as a screen. The data for a given color for a row may be displayed across a number of consecutive illuminations of that row by that color.

In this application the terms microdisplay, spatial light modulator, imager and panel are all understood to refer to a device capable of modulating light in order to generate images. The microdisplay may be a reflective or transmissive liquid crystal device, a MEMS device, or another type device based on other modulation principles.

The operation of the illumination optics in a scrolling color projection system is disclosed in U.S. Pat. No. 5,548,347, Melnik, et al, assigned to Philips, the contents whereof being incorporated into this application by reference. Note particularly FIG. 16. The phase difference between the three rotating prism demonstrates clearly how multiple color stripes can be made to illuminate a single display.

An alternative implementation of a scrolling color illumination system is disclosed in U.S. Pat. No. 5,845,981, Bradley, assigned to Philips, the contents whereof being incorporated into this application by reference in its entirety. FIG. 1 discloses scrolling color projection system wherein three separate light sources illuminate a single reflective mode spatial light modulator through a polarizing beam splitter.

FIG. 1 presents a scrolling color projection system 105 based in part on Bradley. The example depicts a scrolling color projection system comprising three light sources 110R (red), 110G (green) and 110B (blue) oriented such that the illumination beams 115R, 115G and 115B are not parallel.

The angle between 110R and 110G is equal to the angle between 110G and 110B. All three beams of light enter hexagonal rotating prism 120 and are refracted according to Snell's Law. As the three beams exit the rotating prism they are again refracted according to Snell's Law. Collimating lenses 130 and 140 receive the non-parallel output of rotating prism 120 and collimate the light so that it enters polarizing beam splitter 150. The polarizing beam splitter would most typically be one based on the principles set forth in U.S. Pat. No. 2,403,731, MacNeille, "Beam Splitter" and may incorporate many of the later improvements to the thin film stack forming the multilayer film within a MacNeille and to the transparent optical material from which a MacNeille PBS components are formed. S-polarized light is reflected by PBS 150 while p-polarized light passes through PBS 150 and is thereafter not used. Reflected beams 115R, 115G, and 115B are as a result polarized when they encounter spatial light modulator (SLM or microdisplay) 160. Optional spatial light modulator 165 is deployed on a second port of PBS 150. Microdisplay 165 is illuminated by the aforementioned p-polarized light (not shown). Light reflect by microdisplay 165 in its on state is s-polarized and therefore reflected by PBS 150. Stereoscopic images may be placed on microdisplay 160 and optional microdisplay 165 as is well known in the art. In this example the spatial light modulator is a reflective mode liquid crystal on silicon microdisplay. Responsive to a drive voltage supplied by external circuitry (not shown), the liquid crystal layer in the SLM modifies the polarization state of the light passing through the liquid crystal layer. Light reflected by spatial light modulator 160 that is now partially or completely p-polarized will pass through PBS 150 to lens group 170 that will project it onto a viewing screen.

FIG. 2 presents an instantaneous view of the arrangement of color bands and dark guard bands on the face of spatial light modulator 180. Red color band 184 and green color band 188 are separated by dark guard band 186. Green color band 188 and blue color band 192 are separate by dark guard band 190. Blue color band 192, near the bottom of the face of spatial light modulator 180 and red color band 184 are separate by dark guard band 182. Note that dark guard band 182 is present at both the top and the bottom of the face of spatial light modulator 180. This is a necessary consequence of the scrolling of the color across the face of spatial light modulator 180. Arrow 194 indicates the direction in which color bands 184, 188 and 192 and dark guard bands 182, 195 and 192 move across the face of spatial light modulator 180 as a function of time. The a color band passes the bottom of the face of spatial light modulator 180 it begins to appear simultaneously at the top and the bottom of spatial light modulator 180.

Because the writing of data to a row of the panel must be synchronized with the illumination of that row with the proper color, it is necessary to maintain a phase relationship between the rotation of the prisms and the writing of data so that each color band and the data for that color band are synchronized. U.S. Pat. No. 6,690,432, Janssen, et al, assigned to Philips, the contents whereof are incorporated by reference into this application, discloses a method for achieving and maintaining alignment between the display data and the phase position of a rotating prism.

Other means for establishing scrolling color illumination are known in the art. See, for example, U.S. Pat. No. 7,066,605, Dewald, et al, for an example based on a color wheel with the color segments arranged in a spiral. The contents of U.S. Pat. No. 7,066,605 are incorporated into this application by reference.

The microdisplay used in the Philips product is disclosed in "An Improved WXGA LCOS Imager for Single Panel Systems", Willem Sloof, et al, Proceedings of the Asia Symposium on Information Display 2004, pages 150-153, hereinafter referred to as the Sloof paper. The text of the Sloof paper states that the display creates gray scale by the application of one of 256 voltages provided by a global voltage reference source and that the method of selecting the voltage is a digital comparator circuit. It further states that the display only writes data to a row once just prior to the arrival of a color band at that row and that the row is reset by draining the charge just prior to the writing of fresh data immediately prior to the arrival of a subsequent color band This device hereinafter is referred to as the "Sloof microdisplay". The contents of this paper are incorporated by reference herein in its entirety into this application.

In U.S. Pat. No. 8,421,828 and its continuation, pending U.S. patent application Ser. No. 13/790,120, Hudson, et al, (hereinafter '120) disclose a method for applying pulse width modulation to a digital display backplane. The modulation method uses different row spacings within a group of row write actions to form a template that can then be repeated by adjusting the start point of a subsequent application of the template while maintaining the same row spacing between members of the group of said row write actions. Normally the offset is one row although it may be a different number of rows. The offset between the rows and the number of rows forming the template determines the duration of one least significant bit (lsb) based on a constant time required to write each row of data. U.S. patent application Ser. No. 13/790,120 is a parent to the present application.

A microdisplay capable of being pulse width modulated according to the method of the above patent application is disclosed in U.S. Pat. Nos. 7,443,374 and 7,468,717, both Hudson, and in U.S. Pat. No. 8,040,311, Hudson et al, hereinafter collectively "Hudson microdisplay". The Hudson patents disclose a family of backplanes with a number of common characteristics described below. The contents of these patents are incorporated herein by reference.

The Hudson microdisplays resemble the Sloof microdisplay in that each Hudson patent discloses a microdisplay backplane wherein the rows are addressed through a row decoder scheme such that the rows need not be written in sequential order as is the case with a shift register method of delivering data to rows of a display.

The Hudson microdisplays differ from the Sloof microdisplay in two important respects. The backplanes of the Hudson microdisplays enable pure binary modulation of the liquid crystal. Only two voltages are available to be applied to the pixel mirrors and gray scale is generated by duty cycle modulation. DC balance of the Hudson microdisplays takes place independently of the writing of data to the backplane through a control element within the pixel circuit coordinated with external modulation of the counter electrode voltage. In the Sloof microdisplay the drive of the microdisplay backplane is analog in that up to 256 discreet voltages may be stored on a capacitor within the pixel drive circuit to be asserted onto the pixel mirror. One consequence is that DC balance takes place on consecutive loads of the backplane as is described in the Sloof paper at page 153, left hand column, first full paragraph.

FIGS. 3 and 4 show the general construction of a liquid crystal on silicon (LCOS) microdisplay panel 200. A single pixel cell 205 includes a liquid crystal layer 230 between a transparent common electrode 242 formed on glass substrate 240, and a pixel electrode 250. Alignment layers (not shown) of a suitable material such as polyimide or silicon dioxide ($SiO_2$) as is well known in the art, are interposed between transparent electrode 242 and liquid crystal layer 230 and between liquid crystal layer 230 and pixel electrode 250. A storage element 210 is coupled to the pixel electrode 250, and includes complementary data input terminals 212 and 214, a data output terminal 216, and a control terminal 218. The storage element 210 is responsive to a write signal placed on control terminal 218, reads complementary data signals asserted on a pair of bit lines (BPOS and BNEG) 220 and 222, and latch the data signal through the output terminal 216. Since the output terminal 216 is coupled to the pixel electrode 250, the data (i.e. high or low voltage) passed by the storage element 210 is imparted on pixel electrode 250. Pixel electrode 250 is preferably formed from a highly reflective polished aluminum. In the LCD display panel in accordance with the present invention, a pixel electrode 250 is provided for each pixel in the display. For example, in a Full High Definition display system conforming to the SMPTE 274M-2005 standard that requires an array of 1920×1080 pixels, there would be an individual pixel electrode 250 for each of the 2,073,600 pixels in the array. Transparent common electrode 242 is preferably formed from Indium Tin-Oxide (ITO) on glass substrate 240 by some suitable process such as sputtering. A voltage (VITO) is applied to transparent common electrode 242 through a common electrode terminal (not shown) and in conjunction with the voltage applied to each individual pixel electrode, determines the magnitude and polarity of the voltage across liquid crystal layer 230 within each pixel cell 205 in the display 200.

When incident polarized beam of light 260 is directed at pixel cell 205, passes through transparent common electrode 242 the polarization state of incident beam of light 260 is modified by the liquid crystal material 230. The manner in which the liquid crystal material 230 modifies the state of polarization of incident beam of light 260 is dependent on the orientation of the liquid crystal molecules within the path of the beam of light 260 which is in turn dependent on the RMS voltage applied across the liquid crystal between common electrode 242 and pixel electrode 250. For example, applying a certain voltage across the liquid crystal material 230 will reflect beam of light 262 but in a form wherein the polarization state of beam of light 262 is only identical to that of beam of light 260 when the molecules of liquid crystal layer 230 are oriented such that no change to the polarization state of beam of light 260 occurs. This is well known in the art. When reflected beam of light 262 possesses a polarization state differing from that of incident beam of light 260, thus encoding information onto the beam of light 262.*a* fraction of the incident polarized light to be reflected back through the liquid crystal material and the transparent common electrode 240 in a modified polarization state that will pass through subsequent polarizing elements. After passing through the liquid crystal material 230, the incident light beam 260 is reflected by the pixel electrode 250 and back through the liquid crystal material 230. After reflected beam of light 262 passes through subsequent polarizing elements and is thereby analyzed, according to the term of art, the analyzed beam of light (not shown) is attenuated according to the specifics of the exact polarization state of reflected beam of light 262. A specific example of a polarizing element is found at element 150, FIG. 1. The intensity of exiting light beam 262 is thus dependent on the degree of polarization rotation imparted by the liquid crystal material 230, which is in turn dependent on the voltage applied across the liquid crystal material 230.

Storage element 210 is preferably formed from a CMOS transistor array in the form of an SRAM memory cell, i.e., a latch, but may be formed from other known memory logic circuits. SRAM latches are well known in semiconductor design and manufacturing and provide the ability to store a data value, as long as power is applied to the circuit. Other control transistors may be incorporated into the memory chip as well. The physical size of a liquid crystal display panel utilizing pixel cells 205 is largely determined by the resolution capabilities of the device itself as well as industry standard image sizes. For example, a Full High Definition (FHD) system that requires a resolution of 1920×1080 pixels requires an array of storage elements 210 and a corresponding array of pixels electrodes 250 that are 1920 columns wide by 1080 rows high (i.e. 2,073,600 pixels). An HD (high definition) display system that requires a resolution of 1280×720 pixels, requires an array of storage elements 210 and a corresponding array of pixels electrodes 250 that are 1280 long by 720 wide (i.e. 921, 600 pixels). Various other display standards may be supported by a display in accordance with the present invention, including XGA (1024×768 pixels), UXGA (1600×1200 pixels), and various wide screen formats (2000×1000 pixels). Any combination of horizontal and vertical pixel resolution is possible. The precise configuration is determined by industry applications and standards or by the ingenuity of individual developers. For example, the company Red.com—a manufacturer of camera for digital cinema—has released a Red One digital recording camera with a native resolution of 4096 by 2308, a 16:9 aspect ratio similar to the HDTV formats, and the Victor Corporation of Japan (JVC) has released for sale a projection system with a native resolution of 4096 by 2400, it is only possible to presume that additional ultra-high resolution products will emerge with varying numbers of rows and columns. None of these possibilities fall outside the scope envisioned for the present application.

Since the transparent common electrode 242 and glass substrate 240 form a single common electrode, their physical size will substantially match the total physical size of the pixel cell array with some margins to permit external electrical contact with the ITO and space for gaskets and a fill hole (not shown) to permit the device to be sealed after it is filled with liquid crystal.

In U.S. Pat. No. 8,421,828, an inventor of the present invention discloses a method for applying pulse width modulation to a digital display backplane. The modulation method uses different row spacings within a group of row write actions to form a template that can then be repeated by adjusting the start point of a subsequent application of the template while maintaining the same row spacing between members of the group. Because the row write actions are not always physically adjacent it is necessary to insure that the rows of the display are addressed using row address decoder means and not using a shift register write mechanism. A suitable row addressing scheme has long been known in the art of digital memory devices, including SRAM memories. A suitable implementation of a row address decoder circuit is disclosed in "Modern MOS Technology: Processes, Devices, and Design", pp. 208-211, DeWitt G. Ong, McGraw-Hill, 1984.

FIG. 5 shows an electro-optical curve (EO-curve or liquid crystal response curve) for a typical liquid crystal mode known as a 63.6° mixed-mode-twisted-nematic (MTN) with optical compensation operated in the normally white (NW) mode from Robinson et al, "Polarization Engineering for LCD Projection", page 123. Three curves are presented for three different wavelengths of light. MTN modes are often cited as optimal for field sequential color applications because of their low drive voltages, relatively high efficiency and the availability of device configurations allow the use of a single dark state voltage and a single bright state voltage for all colors. As illustrated in FIG. 5, as the voltage applied to the liquid crystal increases, the degree of rotation that is induced onto the polarization state of the reflected light is decreased. Liquid crystal material 130 (FIG. 4) has an RMS voltage $V_{SAT}$, where its degree of polarization rotation is at a maximum (white display) and an RMS voltage $V_{TT}$ where the polarization rotation is at a minimum (black display). Within the range between $V_{TT}$ and $V_{SAT}$, as the RMS voltage increases; the brightness of the light that is transmitted through liquid crystal material 130 (FIG. 4) will decrease from a brighter state to a darker state. At an RMS voltage that corresponds to the point of 100% brightness, the liquid crystal components are aligned substantially in a fan of liquid crystal molecules, thus allowing the light to completely pass through and reflected by the pixel electrode 150. At an RMS voltage that corresponds to the point of 0% brightness, the crystal components are aligned in a vertical stack of liquid crystal molecules such that the polarization of the reflected light is substantially identical to that of the incoming light source, thus preventing the light from passing through the polarizing element for display. The useful portion of the EO curve is voltage range between $V_{TT}$ and $V_{SAT}$.

A useful feature of a liquid crystal cell with spectral performance features such as that of FIG. 5 is that the slope of the electro-optic curve is relatively uniform over the wavelength range of interest.

FIG. 6 shows a block diagram of single pixel cell 305 of a display compatible with the modulation method of the present invention after the pixel circuit disclosed in U.S. Pat. No. 7,443,374. Pixel cell 305 comprises storage element 300, DC balance control element 320, and inverter 340. DC balance control element 320 is preferably a CMOS based logic device that can selectively pass to another device one of several input voltages. Storage element 300 comprises complementary input terminals 302 and 304, respectively coupled to data lines ($B_{POS}$) 350 and ($B_{NEG}$) 352. Storage element 300 also comprises complementary enable terminals 306 and 307 coupled to word line ($W_{LINE}$) 356, and a pair of complementary data output terminals ($S_{POS}$) 308, and ($S_{NEG}$) 310. In the present embodiment, storage element 300 is an SRAM latch, but those skilled in the art will understand that any storage element capable of receiving a data bit, storing the bit, and asserting the complementary states of the stored bit on complementary output terminals may be substituted for the SRAM latch storage element 300 described herein.

DC balance control element 320 comprises complementary data input terminals 324 and 326 which are coupled respectively to data output terminals ($S_{POS}$) 308 and ($S_{NEG}$) 310 of storage element 300. DC balance control element 320 also comprises a first voltage supply terminal 328, and a second voltage supply terminal 330, which are coupled respectively to the third voltage supply terminal ($V_{SWA_P}$) 376, and the fourth voltage supply terminal ($V_{SWA_N}$) 378 of voltage controller 384 (See FIG. 7). DC balance control element 320 further includes a third voltage supply terminal 332, and a fourth voltage supply terminal 334, which are coupled respectively to the fifth voltage supply terminal ($V_{SWB_P}$) 380, and the sixth voltage supply terminal ($V_{SWA_N}$) 382 of voltage controller 384. (See FIG. 7) DC balance control element 320 further comprises data output terminal 322 that is coupled to data input terminal 348 of inverter 340.

A full explanation of the operation of DC balance control element 320 is found in U.S. Pat. No. 7,443,374, in corrected FIG. 6, and the corresponding text at Col. 11, lines 32-51, as corrected. And in FIGS. 12A through 12F and the corresponding text at Col. 17, line 18, through Col. 18, line 9.

Inverter 340 includes first voltage supply terminal 342, and second voltage supply terminal 344, which are coupled respectively to first voltage supply terminal ($V_1$) 372, and second voltage supply terminal ($V_0$) 374 of voltage controller 384 of FIG. 7. Inverter 340 also comprises data input terminal 348 coupled to data output terminal 322 of DC balance control element 320, and pixel voltage output terminal ($V_{PIX}$) 346 coupled to pixel mirror 354. Responsive to the voltage asserted on input terminal 348 inverter 340 asserts the correct voltage among $V_0$ 374 and $V_1$ 372 onto pixel mirror 354 through output terminal 346.

U.S. Pat. Nos. 6,005,558, 6,067,065, 7,379,043, 7,443,374, 7,468,717 and 8,040,311 disclose backplanes compatible with the modulation method of the present application. These patents are incorporated into the present application in their entirety by reference.

FIG. 7 depicts voltage and control logic for a display system 394 compatible with the modulation method of the present invention. Display system 394 comprises an array of pixel cells 305 comprising a plurality of rows and columns, voltage controller 384, a processing unit 388, memory unit 386, and transparent common electrode 392. Transparent common electrode 392 overlays the entire array of pixel cells 305. In a preferred embodiment, pixel cells 305 are formed on a silicon substrate or base material, and are overlaid with an array of pixel mirrors 354 (from FIG. 6), each single pixel mirror 354 forming a part of one of the pixel cells 305. Each pixel cell 305 comprises the circuit elements disclosed in FIG. 6. A substantially uniform layer of liquid crystal material is located in between the array of pixel mirrors 354 and the transparent common electrode 392. Transparent common electrode 392 is preferably formed by a transparent conductive material such as Indium Tin-Oxide (ITO) coated onto a glass substrate (not shown) as previously disclosed in FIG. 3, items 240 and 242. Memory 386 is a computer readable medium including programmed data and commands. Memory 386 is capable of directing processing unit 388 to implement various voltage modulation and other control schemes. Processing unit 388 receives data and commands from memory unit 386, via memory bus 387, provides internal voltage control signals, via voltage control bus 390, to voltage controller 384, and provides data control signals (i.e. image data into the pixel array) via data control bus 385. Voltage controller 384, memory unit 386, and processing unit 388 may be separate units or alternative may form part of a larger circuit assembly in a larger integrated circuit or circuit board assembly.

Responsive to control signals received from processing unit 388, via voltage control bus 390, voltage controller 384 provides predetermined voltages to each pixel cells 305 via a first voltage supply terminal ($V_1$) 372, a second voltage supply terminal ($V_0$) 374, a third (logic) voltage supply terminal ($V_{SWA_P}$) 376, and a fourth (logic) voltage supply terminal ($V_{SWA_N}$) 378, a fifth (logic) voltage supply terminal ($V_{SWB_P}$) 380, and a sixth (logic) voltage supply terminal ($V_{SWB_N}$) 382. Voltage controller 384 also supplies predetermined voltages $V_{ITO_L}$ by voltage supply terminal 396 and $V_{ITO_H}$ by voltage supply terminal 397 to ITO voltage multiplexer unit 399. Voltage multiplexer unit 399 selects between $V_{ITO_L}$ and $V_{ITO_H}$ based on control signals received from processing unit 388. Processing unit 388 controls the logic state of (logic) voltage supply terminals $V_{SWA_P}$ 376, $V_{SWA_N}$ 378, $V_{SWB_P}$ 380, and $V_{SWB_N}$ 382 in synchronization with switching of $V_{ITO}$ 398 between $V_{ITO_L}$ 397 and $V_{ITO_H}$ 396. ITO voltage multiplex unit 399 delivers $V_{ITO}$ to the transparent common electrode 392, by voltage supply terminal ($V_{ITO}$) 398. Each of the voltage supply terminals $V_1$ 372, $V_0$ 374, $V_{SWA_P}$ 376, $V_{SWA_N}$ 378, $V_{SWB_P}$ 380, and $V_{SWB_N}$ 382 in FIG. 7 are global signals, wherein each global terminal supplies the same voltage to each pixel cell 305 throughout the entire pixel array at any given instant in the operation of display system 394. In the case of $V_{ITO}$ 398, a single voltage is applied to transparent common electrode 392.

FIG. 8A depicts the movement of digital data and digital control signals in a display system. Display system 400 comprises microdisplay controller 420, digital image data input terminal 433, DDR SDRAM memory 430, memory control interface 431, memory data interface 432, microdisplay 440 and various digital control and data lines (402, 404, 406, 408, 410) that connect microdisplay controller 420 to microdisplay 440. Although DDR SDRAM 430 is preferably a DDR memory with a double data rate interface, other memory devices known in the art may be used. Digital image data input terminal may receive data from a digital input such as HDMI or DVI, or may receive data from a format converter device operative to receive digital or analog image signal and convert and reformat those signals as is well known in the art.

Line 402 may comprise a plurality of complementary clock lines. The clock lines allow microdisplay 440 and microdisplay controller 420 to conduct a synchronized transfer of data over a plurality of parallel data transfer lines 410. In one embodiment data transfer lines 410 comprise 64 parallel data lines. In another embodiment data transfer lines 410 comprises 128 parallel data lines. Those of ordinary skill in the art will recognize that the number of parallel data lines may be an arbitrary number and that the maximum number may be dictated by external factors such as the minimum spacing and minimum size of wire bond pads and the space available in which to fabricate said wire bond pads. Line 404 may comprise a set of operation code lines that control the microdisplay and instruct it to handle the data coming over parallel data transfer lines as address information or data information or as some other form of information that may be useful in a practical system. Line 406 may comprise a serial input-output interface. A serial input-output interface may be utilized to transfer control instructions from microdisplay controller 420 to microdisplay 440. Other control functions comprise functions to control other features of microdisplay 440 such as setup configuration. Line 408 may comprise additional features such as control of a temperature measurement sensor (not shown) with bidirectional data flow. A temperature sensor of the type required is disclosed in published patent application Ser. No. 10/627,230 (abandoned), the contents whereof are incorporated into the present application by reference. Other data lines may include such items as a field-invert (FI) signal (not shown) wherein the field-invert signal controls circuitry that triggers a change to the DC balance state of a pixel such as that shown in FIG. 6 by controlling DC balance control element 320 as previously described. Those of ordinary skill in the art will recognize other useful features that may be implemented in an interface between a microdisplay and a microdisplay controller. Therefore, the present list is not considered limiting.

FIG. 8B depicts a functional schematic of microdisplay controller 420. Digital data of an image to be displayed is received by terminal 433 on HDMI (High Definition Multimedia Interface) Interface 421. Alternatively, the digital data may be received from any industry standard or proprietary digital image interface. The digital data may be received from another device capable of rescaling images or enacting frame rate change or other changes or combination of changes. HDMI interface 422 receives the incoming digital data from a digital video source comprising a pixel clock, horizontal and vertical sync signals, and pixel data for one or more colors. Bit depth may be an industry standard such as 8 bits per color or another arbitrary or emerging standard.

Data received is transferred by logical/serial interface 429 to color shading correction unit 422. Color shading correction unit 422 receives digital image data and acts upon that data to apply correction factors to the image data such that the hue of the final display image is close to the desired color. The origins of color shading errors may originate in a number of causes, including non-uniformities in the display device. A more detailed explanation of color shading correction is found in U.S. Pat. Nos. 7,129,920 and 7,990,353, the contents whereof are incorporated into the present patent application by reference. In one embodiment the output data upon which color shading correction unit 422 has acted has different bit depth to that of the input data.

Color shading correction unit 422 delivers its output data to look-up table (LUT) unit 423 through logical/serial interface 434. LUT unit 423 acts upon the input data to apply a set of corrections for liquid crystal non-linearity and for other desirable corrections such as for gamma correction, thereby assuring that changes in the image data result in the expected change in the luminance of the image when displayed.

LUT unit 423 delivers its output data to byte-explode unit 424 via logical/serial interface 435. Byte-explode unit 424 acts upon data received from LUT unit 423 to convert said data into a form suitable for display. Byte-explode unit 424 takes the data and expands the number of bits comprising the data. In one embodiment byte-explode unit 424 maps the binary data to a larger number of binary weighted and non-binary weighted bits. In one embodiment the non-binary weighted bits comprise a set of "thermometer" or unary (Base 1) bits of higher order than the set of binary weighted bits. In one embodiment at least one of the unary bits is of different temporal weighting than the other unary bits. In one embodiment the temporal ordering of the unary bits differs from the order in which the unary bits are activated with increasing gray scale.

The expanded byte count data output of Byte-Explode unit 424 is transferred over logical interface 436 to DDR SDRAM Controller/Interface 425 for transfer to DDR SDRAM 430 (not shown) over memory data interface 432 for buffering. Placement and retrieval of the transferred data is responsive to instructions sent over memory control interface 431. In one embodiment the expand byte count data for a row is stored according the temporal order in which the data is to be displayed.

The expanded byte count data remains in DDR SDRAM 430 until retrieved by DDR SDRAM controller/Interface 425 over logical interface 432. DDR SDRAM Memory Controller/Interface 425 delivers the retrieved data over logical interface 437 to Bit Plane Scheduler and Sequencer 426.

Bit Plane Scheduler and Sequencer 426 receives expanded byte count data and converts the data into a time ordered sequence of row write events A row write event is the writing of an entire row of the display with binary data corresponding to a modulation state for each pixel on the row. In one embodiment the binary data is preceded by data defining the row to which the subsequent data is to be written. The time ordered sequence of row write events is delivered to microdisplay buffer and interface 427 by logical interface 438.

Microdisplay buffer and interface 427 performs actions such as voltage scaling to the signals representing the data for the row write actions to enable it to be electrically transferred to microdisplay 440 over output interface 439. Output interface 439 may be preferably a flexible printed circuit assembly (FPCA) or alternatively may form part of the same printed circuit board as the other components of microdisplay controller 420 or some other form as is known in the art. Output interface 439 comprises a set of parallel lines configured so as to enable the transfer of the row write information to microdisplay 440.

FIG. 8C depicts a functional diagram of the data transfer sections of microdisplay 440. Microdisplay comprises pixel array 441, left row decoder 445, right row decoder 446, column data register array 444, control block 443, and wire bond pad block 442. Wire bond pad block 442 is configured so as to enable contact with an FPCA or other suitable connecting means so as to receive data and control signals over lines from microdisplay controller 420. The data and control signal lines comprise compromise clock signal line 402, op code signal lines 404, serial input-output signal lines 406, bidirectional temperature signal lines 408, and parallel data signal lines 410.

Wire bond pad block 442 receives image data and control signals and moves these signals to control block 443. Control block 443 receives the image data and routes the image data to column data register array 444. Row address information is routed to row decoder left 445 and to row decoder right 446. In one embodiment the value of Op Code line 404 determines whether data received on parallel data signal lines 410 is address information or image data. In one embodiment the row address information acts as header, appearing first in time, to be followed by data for that row.

Row decoder left 445 and row decoder right 446 are configured so as to pull the word line for the decoded row high so that data for that row may be transferred from column data register array 444 to the storage elements resident in the pixel cells of that row of pixel array 441, as previously described in FIG. 6 and associated text.

Digital pulse width modulated displays offer several advantages over analog driven displays. First, it is possible to control time more precisely than voltage. Second, the pixel voltage can be constantly supplied and does not rely upon a capacitive element in the pixel to hold the charge. Third, it is less prone to be affected by high light loads. Prior art scrolling color systems have used analog pixels with one exception. Texas Instruments developed a scrolling color projector based on a multicolor spiral color wheel and a digital micromirror device (DMD). The Texas Instruments DMD uses pulse width modulation as described in U.S. Pat. No. 6,897,019 but does not use line by line row addressing as disclosed in the present application. Rather the DMD display is divided into groups of rows in which all rows in a group are written with that group in an off state and afterwards the modulation is applied to that group of rows. Applicant has developed hardware and software to enable application of its pulse width modulated spatial light modulators to the task of pulse width modulating a scrolling color display.

SUMMARY OF THE PRESENT INVENTION

It is therefore an objective of the present invention to further improve a scrolling color projection display by providing a system and method to pulse width modulate the display with a full range of gray scale steps within a limited bandwidth interface. A further object of the present invention is to provide means for reducing left-eye, right-eye latency in a stereoscopic display.

In summary, this invention discloses a method of organizing and ordering pulse width modulation image data so that it may be displayed on the pixels of a scrolling color display. The method includes a method of formatting received image data into a different form suitable for driving a pulse width modulated display and a method of distributing image data across a series of different image modulation segments to minimize flicker and gray scale errors. The method includes means for reducing lateral field effects between adjacent pixels in different data states.

These and other objects and advantages of the present invention will no doubt become obvious to those of ordinary skill in the art after having read the following detailed description of the preferred embodiments, which is illustrated in the various drawing figures.

BRIEF DESCRIPTION OF THE DRAWINGS

FIG. 9A is a diagram of a major modulation segment moving down a display over time;

FIG. 9B is a diagram of a major modulation segment moving down a display over time including a terminated write pointer;

FIG. 13A is a diagram of a pulse width modulation scheme which varies the pulse width duration attributed to a least significant bit segment based on external criteria;

FIG. 13B is a diagram of a pulse width modulation scheme utilizing terminated write pointers which varies the pulse width duration attributed to a least significant bit segment based on external criteria;

FIG. 19A is operated;

DETAILED DESCRIPTION OF THE INVENTION

Figure 1:
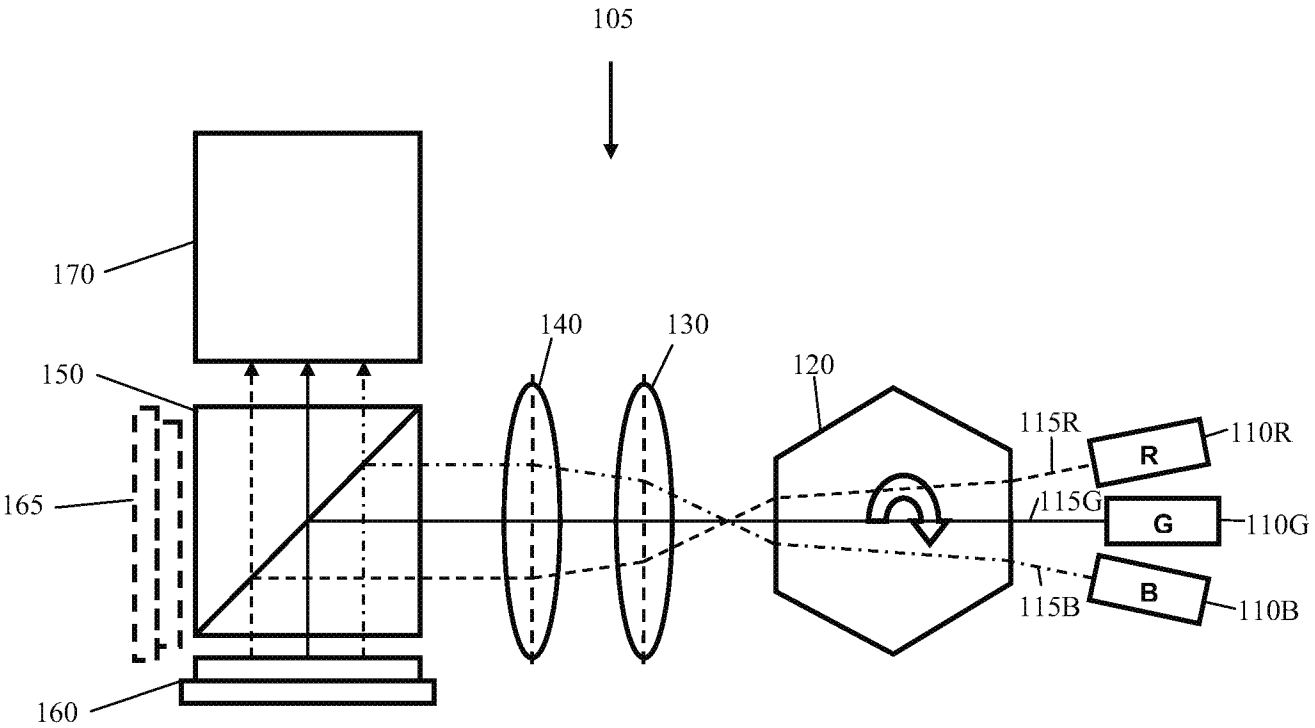
FIG. 1 is a schematic diagram of a scrolling color projection display.

It is to be understood that both the foregoing general description and the following detailed description are exemplary and explanatory only and are not restrictive of the invention, as claimed. It should be noted that, as used in the specification and the appended claims, the singular forms "a", "an" and "the" include plural referents unless the context clearly dictates otherwise. Thus, for example, reference to "a material" may include mixtures of materials; reference to "a display" may include multiple displays, and the like. References cited herein are hereby incorporated by reference in their entirety, except to the extent that they conflict with teachings explicitly set forth in this specification.

In the following description applicant makes use of the term "write pointer." The term "virtual write pointers" is also used for a pattern of row write actions accomplished in a time ordered sequence. Each member of the pattern of "virtual write pointers" is serviced by a "physical write pointer" in turn according to the predetermined order of execution. Because the pattern is always repeated precisely in both spacing and in the order of execution of the row write actions the spacings may be considered a template or pattern. The pattern of row write pointers may be termed a "modulation sequence."

A "terminated write pointer" is a special class of write pointer that is writes a single value to the pixels of a specific row in conjunction with the writing of image data to a different row. A terminated row is normally set to the dark state. In some instance "terminated write pointer" may be understood from context to mean "row write action by a terminated write pointer." The concept is fully described in U.S. Pat. No. 7,852,307, the contents whereof are incorporated into the present application by reference.

A "row write action" in this application takes place when a (virtual) write pointer points or directs image data for a row to that row. The physical write pointer is implemented through a row decoder circuit as is explained in this application. "Data" refers to "image data" unless otherwise stated.

Writing to a row shall mean writing image data to each of the pixels of that row. Writing data to a pixel shall mean writing image data to a memory located at that pixel.

The use of the term "time slot" or "time segment" in discussions of this application is a convention well known in the art. The time slots are of substantially equal duration and can be determined by an understanding of the limiting bandwidth for writing data to the display device. The limiting bandwidth may occur in a controller at its interface to external memory, between the display controller and its display, or within the controller. The interface between the display controller and its external memory is often the bandwidth limiter because data must be written to the external memory and then retrieved to be delivered to the display, making it the interface with the highest amount of data traffic.

"Modulation segment" means a pulse width modulation segment of some fixed duration. "Major modulation segment" means a group of modulation segments adjacent or nearly adjacent in time. The major modulation segment may comprise less than the full range of modulation segments available to create gray scale. "Bit plane" may be used in place of "modulation segment". "Modulation segments" begin when a write pointer directs image data to a row and end when a next write pointer directs image data to that row.

In this application "scrolling color band" or "color band" is substantially coextensive with a "dynamic display section" or "display section". A reference to modulation in a "color band" or "scrolling color band" is equivalent to modulation in a "display section" or "dynamic display section."

In this application a template as previously described is depicted in grid form wherein rows are presented along the vertical axis of the grid and time is presented in the form of time slots along the horizontal axis.

FIG. 9A depicts a major modulation segment similar to that of U.S. Pat. No. 8,421,828 and pending patent application Ser. No. 13/790,120. A write sequence comprises a set of 6 write pointers termed $A_i$ through $F_i$ where i=1, 2, 3 . . . throughout a full sequence of a display. The vertical axis of FIG. 9A is a set of rows numbered from 1 to 28 and the horizontal axis is a set of time intervals or slots numbered 1 to 28. The row spacings between write pointers $A_i$ through $F_i$ comprise a plurality of different spacings. In the example, the spacing between write pointer $A_i$ and write pointer $B_i$ is 8 rows as is the spacing between write pointer $B_i$ and write pointer $C_i$. The spacing between write pointer $C_i$ and write pointer $D_i$ is 4 rows. The spacing between write pointer $D_i$ and write pointer $E_i$ is two rows, and the spacing between write pointer $E_i$ and write pointer $F_i$ is one row. The row write actions directed by the 6 write pointers take 6 time slots to occur. At the seventh time slot the pattern is repeated with a single row offset, in this example lower, from the previous set of write pointers.

The major modulation segment of FIG. 9A creates gray scale through the use of the different row spacings and through the stated offset from the previous start point in successive applications of the template of write pointers. For example, write pointer $D_1$ directs image data to row 4 at time slot 4. Row 4 will remain in the state written at that point until another write pointer directs the next image data for that row to that row. In this case the next write pointer action on row 4 occurs when write pointer $E_3$ directs image data to row 4 at time slot 17. Thus 13 time slots have elapsed before row 4 changes. Row 2 has image data directed to it by write pointer E1 at time slot 5. Write pointer $F_2$ directs image data to row 2 at time slot 12. Thus 7 time slots have elapsed before row 2 changes. Write pointer $C_1$ directs image data to row 8 at time slot 3. Write pointer $D_5$ directs image data to row 8 at time slot 28. Thus 25 time slots have elapsed before row 8 changes. In summary, row spacings of 1, 2, and 4 create time slot durations of 7, 13, and 25. While the time slot intervals are not identically proportional to the row spacings they are reasonably close. Over a more typical modulation sequence encompassing more rows and more time slots these values tend to converge closely to the row spacings.

A modulation scheme as disclosed here has one important characteristic relating to the time frame over which it operates. In the example of FIG. 9A write pointer sequence lasts from the start of a first application of a sequence until the start of the next sequence. In this example, the duration, as previously noted, is 6 time slots. The modulation time associated with the generation of a modulation value of 1, normally defined as the least significant bit or LSB, is determined, in this example, by the time required to generate the modulation segment of shortest duration is the time between when write pointer $E_1$ directs image data to row 2 at time slot 5 and the when write pointer $F_1$ directs image data to row 2 at time slot 12. The 7 time slots required to generate a least significant bit exceeds the 6 time slots required to generate one instance of application of the full modulation sequence. Thus it can be stated clearly that the modulation sequence can occur with a time duration shorter than the time required to generate an LSB.

Those of experience in the art will recognize that these modulation methods can be applied to emissive displays as well as to displays that modulate polarized light. In one embodiment the emissive display modulate an organic light emitting diode material (OLED). In one embodiment the OLED material is modulated by a pixel comprising a constant current source driver circuit.

FIG. 9B presents a major modulation segment similar to that of FIG. 9A. The sequence of FIG. 9B applies the concept of terminated write pointers disclosed in U.S. application Ser. No. 11/740,244, now U.S. Pat. No. 7,852,307, in which a single row is written to a single image data value by an instruction that is included with image data directed by a write pointer to a different row. Thus, in time slot 6 write pointer $A_2$ directs image data to row 25 and also directs off state data to row 1 through terminated write pointer $A_2T$. This is useful in that it reduces the number of time slots required to write a modulation sequence by one write pointer. The cost of this improved efficiency is that the row written to by the terminated write pointer is set to a single value, normally off or the dark state.

In the example of FIG. 9B the relationship between the time required to generate an LSB and the time required to generate an LSB is less straightforward than in the example of FIG. 9A. The time required to generate an LSB begins where write pointer E1 directs image data to row 2 at time slot 5 and ends when terminated write pointer A3T directs off state image data to row 2 at time slot E11. This is clearly 6 time slots. It is also clear that the start of the second instance of the write pointer sequence is substantially contemporaneous with the end of the first instance of the write pointer sequence. Since the writing of a sequence still takes 6 time slots the two values are equal. Therefore, the duration of an LSB is substantially the same as the duration of the write sequence. Thus it can be stated clearly that the modulation sequence can occur within a time duration substantially equal to the time required to generate an LSB.

Figures 9C, 9D, 9E, 9F:
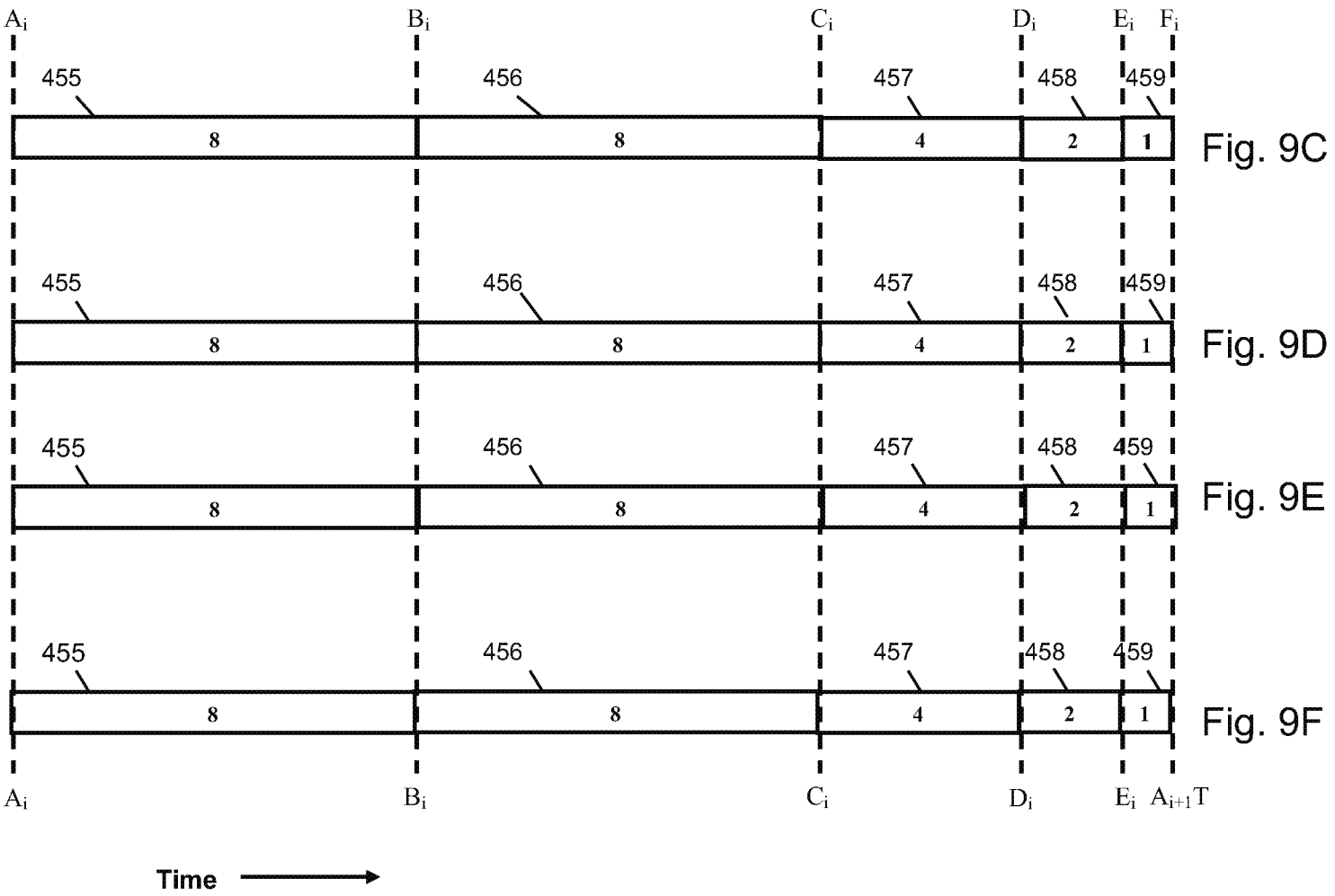
FIGS. 9C-9F are diagrams of various pulse width modulation activations corresponding to different gray levels.

FIGS. 9C through 9F depict different data states for a modulation sequence after FIG. 9A and FIG. 9B. Modulation segments 455 and 456 are both valued at 8 time increments. Modulation segment 457 is valued at 4 time increments. Modulation segment 458 is valued at 2 time increments and modulation 459 is valued at 1 time increment. In FIG. 9C modulation segments 457 and 459 are on and all others are off, thus yielding a total modulation data state corresponding to 5 time increments. In FIG. 9D modulation segments 456 and 458 are on and all others are off, thus yielding a total modulation data state corresponding to 10 time increments. In FIG. 9E modulation segments 456, 457, 458, and 459 are active, thus yielding a total modulation data state corresponding to 15 time increments. In FIG. 9F modulation segments 455, 456, and 457 are on and all others are off, thus yielding a total modulation data state corresponding to 20 time increments. By inspection, if all modulation segments are on, a total modulation data state corresponding to 23 time increments is possible. It is conclusive that by the use of row spacing to create a plurality of modulation segment durations, gray scale can be achieved.

Figure 10A:
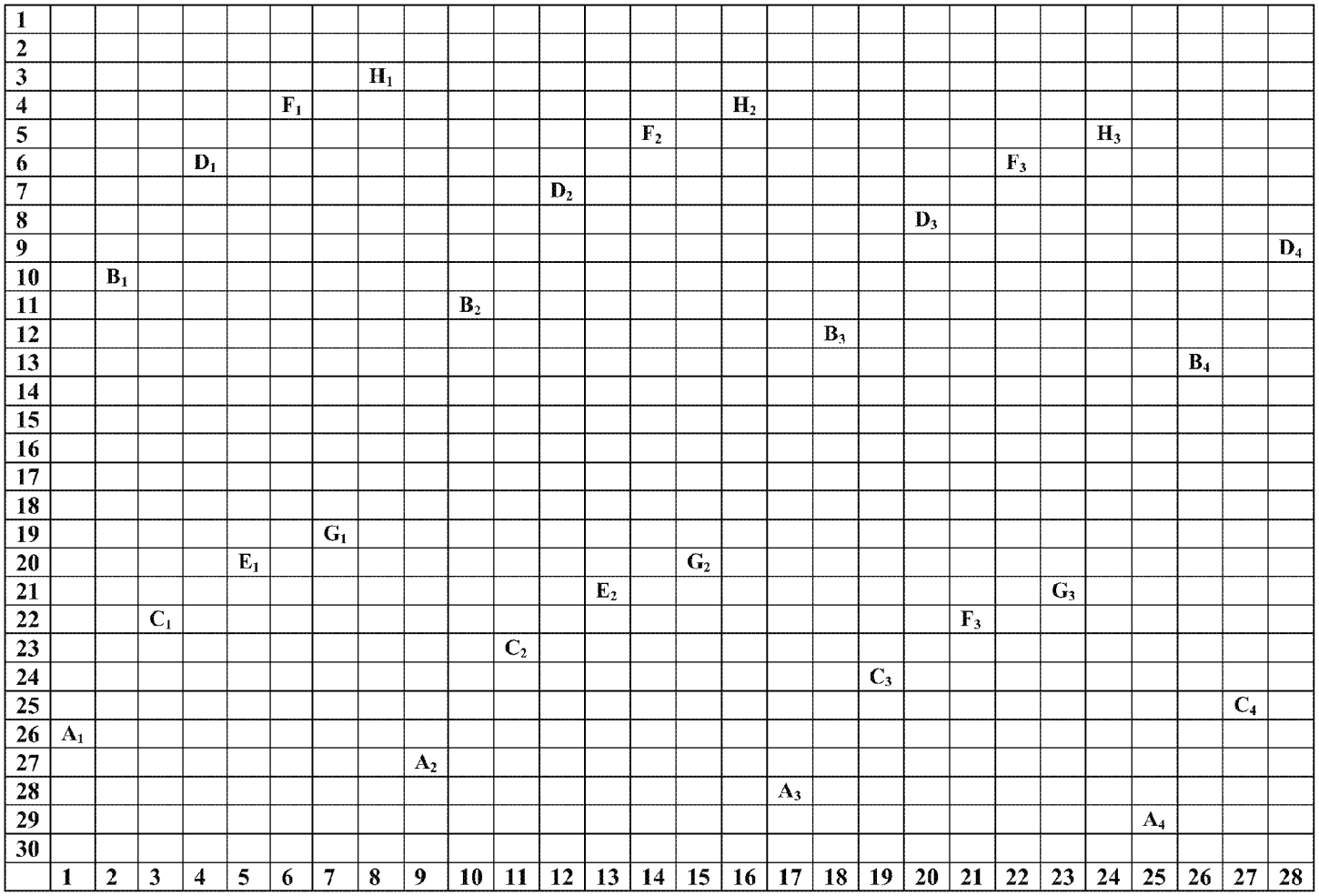
FIG. 10A is a diagram of an interlaced pulse width modulation scheme in which the display comprises a plurality of segments.

FIG. 10A depicts a display in which has a first imaging section and a second imaging section, wherein each of the imaging sections has a plurality of rows. The modulation method comprises modulating a first row in the first imaging section and modulating a first row in the second imaging section. The data writing alternates between the first imaging section and the second imaging section and progresses sequentially through all of the rows of each imaging section. The imaging sections may comprise static divided section or alternatively may move dynamically down the display before wrapping over to the top of the display.

The important step in implementing the above drive is that while the imaging sections are operated quasi-independently, it is necessary to schedule the application of the write pointers in a coordinated manner. A first write pointer directs image data to a row i the first imaging section, a second write pointer directs image data to a row in the second imaging section, a third write pointer directs image data to a row in the first imaging, a fourth write pointer directs image data to a row in the second image section, and so forth. The spacing between rows of the first and between the rows of the second imaging sections is arbitrary and need not be identical in the two sections. The scheduling of the application of the write pointers is not arbitrary and must be adhered to. This can be extended to additional imaging sections, by determining a temporal order to the imaging sections. A first rule to apply is that a single write pointer is to be scheduled in the first imaging section, followed by a single write pointer to the second image section, followed by additional single write pointer to any additional imaging sections, followed by starting again with a second single write pointer to the first imaging section, and so forth. This manner of operation may be referred to as "interlaced." The row spacing between rows within an imaging section form the same template described above with respect to FIGS. 9A-9F.

When the imaging section boundaries are fixed, the write pointers in the two imaging sections do not overlap, and the spacing between any write pointer operating in the first section and any write pointer in the second section does not affect gray scale. Any number of possibilities could be implemented, such as having the motion of the modulation sequence of write pointers in one imaging section move opposite to the direction of motion in another imaging section. When the imaging section boundaries are dynamic and move on the display in the same direction, it is best that the modulation sequences of write pointers move in the same direction. There is some possibility of interaction they may affect gray scale. This interaction can be eliminated by a last write pointer in a modulation sequence that directs off state image data to the rows it points to. This is depicted elsewhere in this application.

In FIG. 10A row 26 receives image data directed to it by write pointer $A_1$ in time slot 1, after which row 10 receives image data directed to it by write pointer $B_1$ in time slot 2. Rows 10 and 26 are clearly in distinct sections of the display, and write pointers A1 and B1 clearly form part of distinct and separate modulation sequences. In one embodiment rows 1 through 15 may form a first imaging section, the rows of which received image data directed by write pointers $A_i$, $C_i$, $E_i$ and $G_i$, and rows 16 through 30 may form a second imaging section, the rows of which receive image data directed by write pointers $B_i$, $D_i$, $F_i$ and $H_i$. In a second embodiment the two separate and distinct modulation sequences may each modulate the entire display.

Figure 10B:
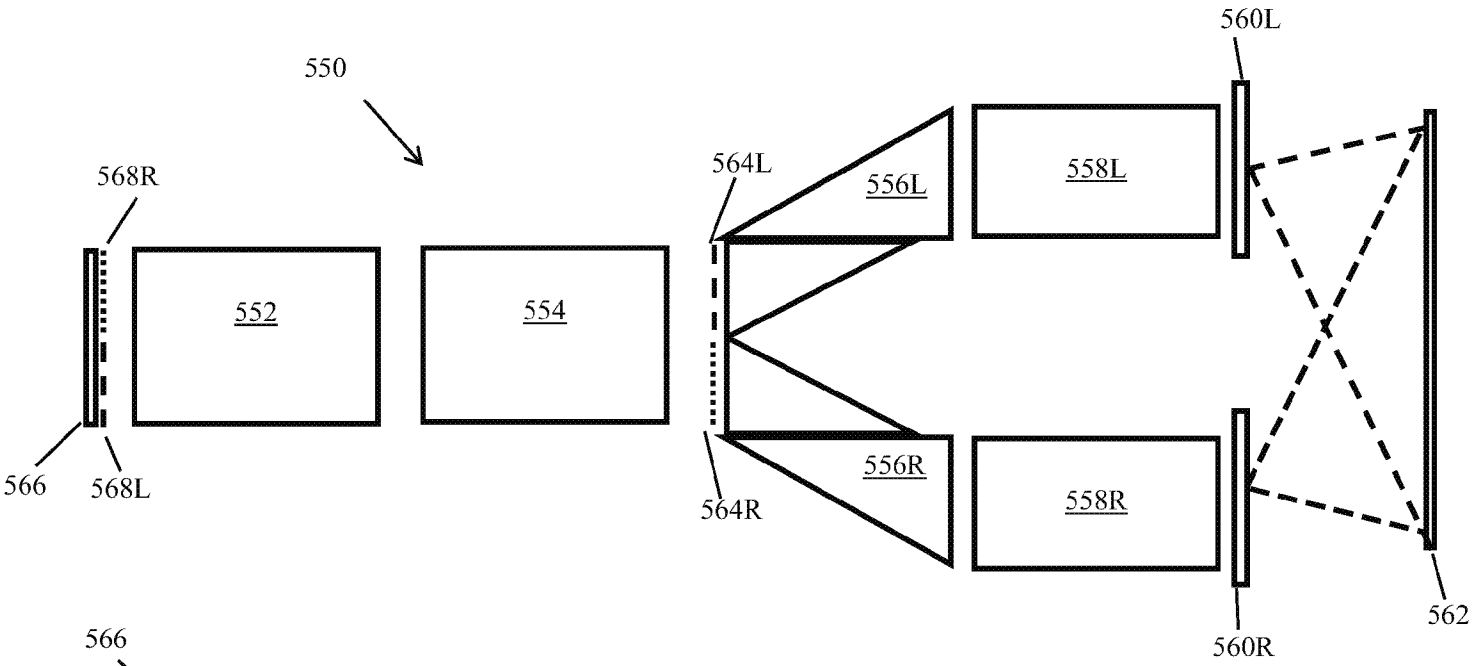
FIG. 10B is a diagram of a stereoscopic projection system wherein a microdisplay modulates image data for the left eye and the right eye at the same time.

FIG. 10B depicts a stereoscopic digital cinema projection system developed and reported by Sony Corp. in 2009. The projection optics project one part of a microdisplay to present stereoscopic data for one eye and project a second part of the same microdisplay to present stereoscopic data for the other eye. Marketing material released in 2008 noted that an advantage of this system is that it presents information to the left eye and the right eye simultaneously whereas other solutions time multiplex between the two eyes. Anecdotally skilled observers have reported a small time lag between the left eye and the right eye when witnessing a stereoscopic image that they have attributed to the nature of the microdisplay used to generate the two images. The microdisplays in Sony digital cinema projectors are known to be analog devices. It is further estimated that the microdisplays use shift register addressing to deliver data to the rows of the display. Normally this would be done in a single stroke beginning at the top of the display and proceeding row by row until the bottom of the display is reached. This has not been confirmed but it would be consistent with prior industry practice. If true this would mean that the image for a first eye would be fully formed before the image for the remaining eye begins to be formed.

The microdisplay driving method of FIG. 10A would alleviate some of this lag since both parts of the display would be written in an interlaced fashion. Additionally since the images are generated through a series of pulse width modulation segments the lag between eyes would be approximately the time required to write one row on the display.

Figure 10C:
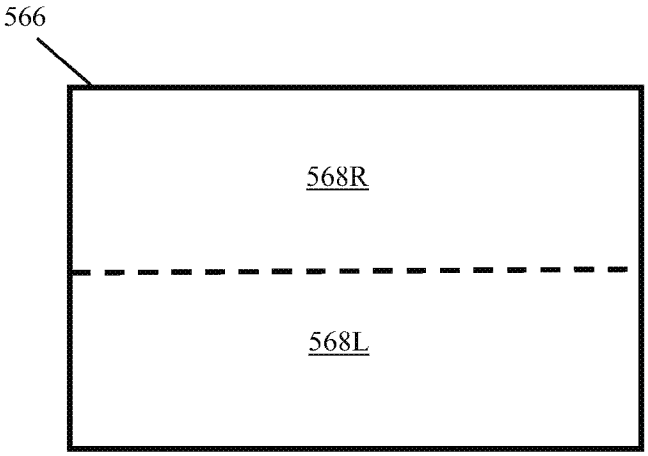
FIG. 10C is a diagram of a microdisplay after FIG. 10B wherein there are two imaging sections.

Stereoscopic projection system 550 of FIG. 10B comprises microdisplay 566, prism unit 552, relay lens assembly 554, separation prism assemblies 556L and 556R, projection lenses 558L and 558R, 3D filters 560L and 560R, and viewing screen 562. It is understood that three or more microdisplays may be present in the stereoscopic projection system. A part of a stereoscopic image for the right eye is formed on imaging section 568R of microdisplay 566 and a part of a stereoscopic image for the left eye is formed on imaging section 568L of microdisplay 566 as shown in FIG. 10C. Prism unit 552 and relay lens assembly 554 form an image of the aforementioned image sections of microdisplay 566 on separation prism assemblies 556L and 556R at positions 564L and 564R. At this point the image for the left eye and the image for the right eye are separate and remain separate until combined at screen 562. Projection lenses 558L and 558R condition the images to be presented on the screen with similar parts of the image overlying one another. 3D filters 560L and 560R modify the image light exiting projection 558L and 558R such that a viewer equipped with appropriate glasses sees a stereoscopic image. Filters 560L and 560R may be color filters with pass spectra that do not overlap. Filters 560L and 560R may alternatively be linear polarizers with or without accompanying retarders that create image light of one polarization state for the left eye and of the orthogonal polarization state for the right eye. Filters 560L and 560R may alternatively be quarter wave retarders with or without linear polarizers that are oriented so as to create left hand circularly polarized light for one eye and right hand circularly polarized light for the other eye. When the stereoscopic images are polarization encoded viewing screen 562 must be a polarization preserving screen. Suitable glasses for the foregoing alternatives are well known in the art and are available commercially from many sources.

Figure 11A:
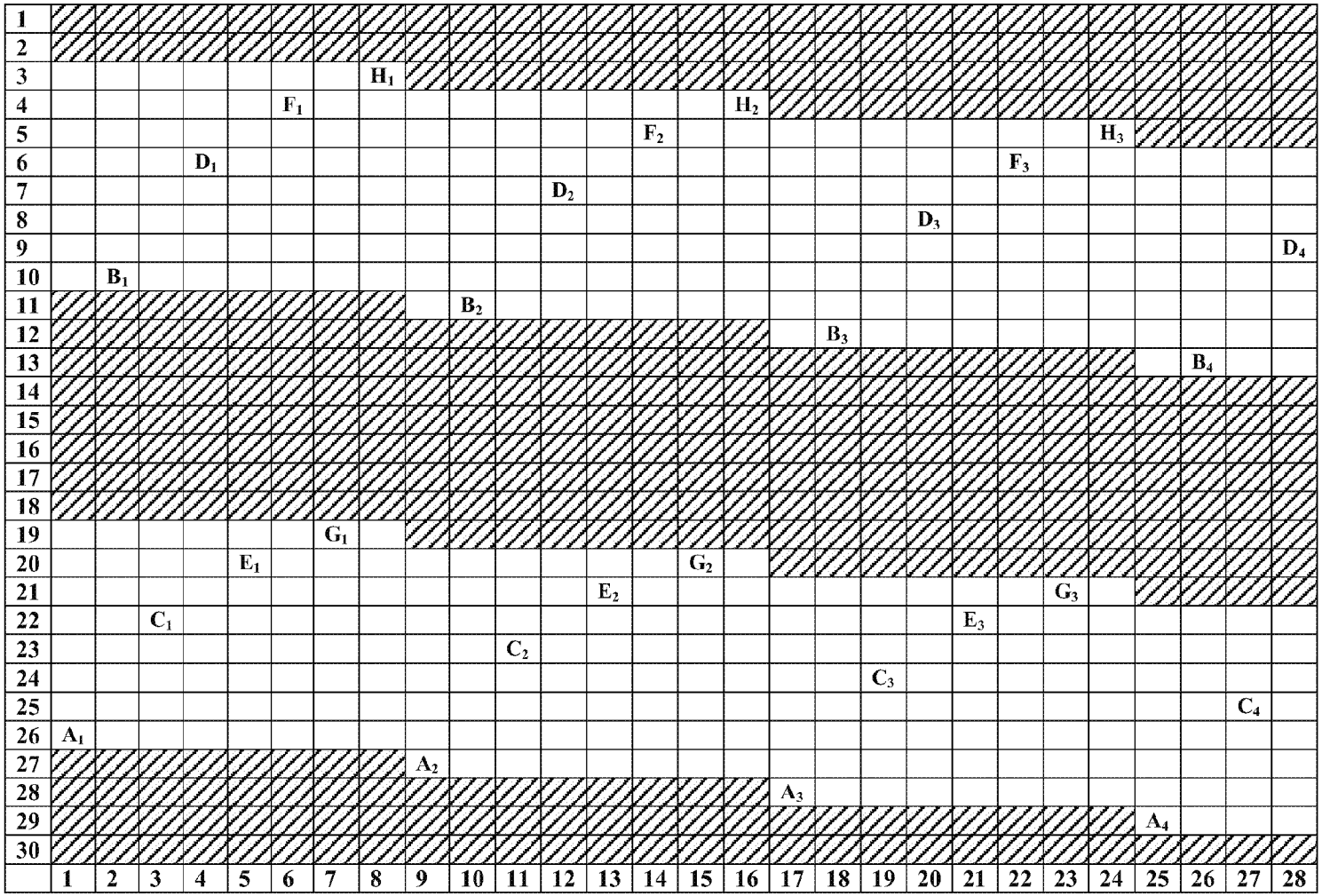
FIG. 11A is a diagram of an interlaced pulse width modulation scheme in which the display comprises a plurality of scrolling color bands.

FIG. 11A depicts a display pulse width modulated after the present invention. The display is a scrolling color display that is pulse width modulated. The vertical axis represents rows 1 through 30 of the display and the horizontal axis represents time slots 1 through 30. The shaded areas beginning in time slot1 at rows 1-2, 11-18, and 27-30 represent the dark gaps between bands of scrolling color. The unshaded areas beginning in time slot 1 at rows 3-10 and 19-26 represent areas illuminated by the scrolling color bands with the two unshaded areas representing different, unspecified colors. Note that the major modulation segments are substantially coextensive with the color bands in this example.

The major modulation segment in the lower band comprises write pointers $A_i$, $C_i$, $E_i$ and $G_i$ which direct data to rows separated by 4, 2 and 1 rows respectively. The same holds true for the modulation sequence in the upper band for write pointers $B_i$, $D_i$, $F_i$, and $H_i$. The two major modulation segments are not constrained to be identical in order. In the lower band row 22 receives image data directed to it by write pointer C1 at time slot 3. Row 22 receives image data directed to it by write pointer $E_3$ at time slot 21, thus setting 18 time slots as the duration. Row 20 receives image data directed to it by write pointer $E_1$ at time slot 5. Row 20 receives image data directed to it by write pointer $G_2$ at time slot 15, thus establishing 10 time slots as a least significant bit (lsb). Again the relationship between row spacing and pulse width duration is not precise but it is again clear that a sequence with a significantly larger number of write pointers will be closer.

In this example write pointers $A_1$ and $B_1$ are termed a first group of write pointer in their respective color bands or display sections, and write pointers $C_1$ and $D_1$ are termed a second group of their respective color bands or display sections. Write pointers $E_1$ and $F_1$ and write pointers $G_1$ and $H_1$ form third and fourth groups of writer pointer in their respective color bands or display sections. This terminology is to be applied throughout the present application.

Figure 11B:
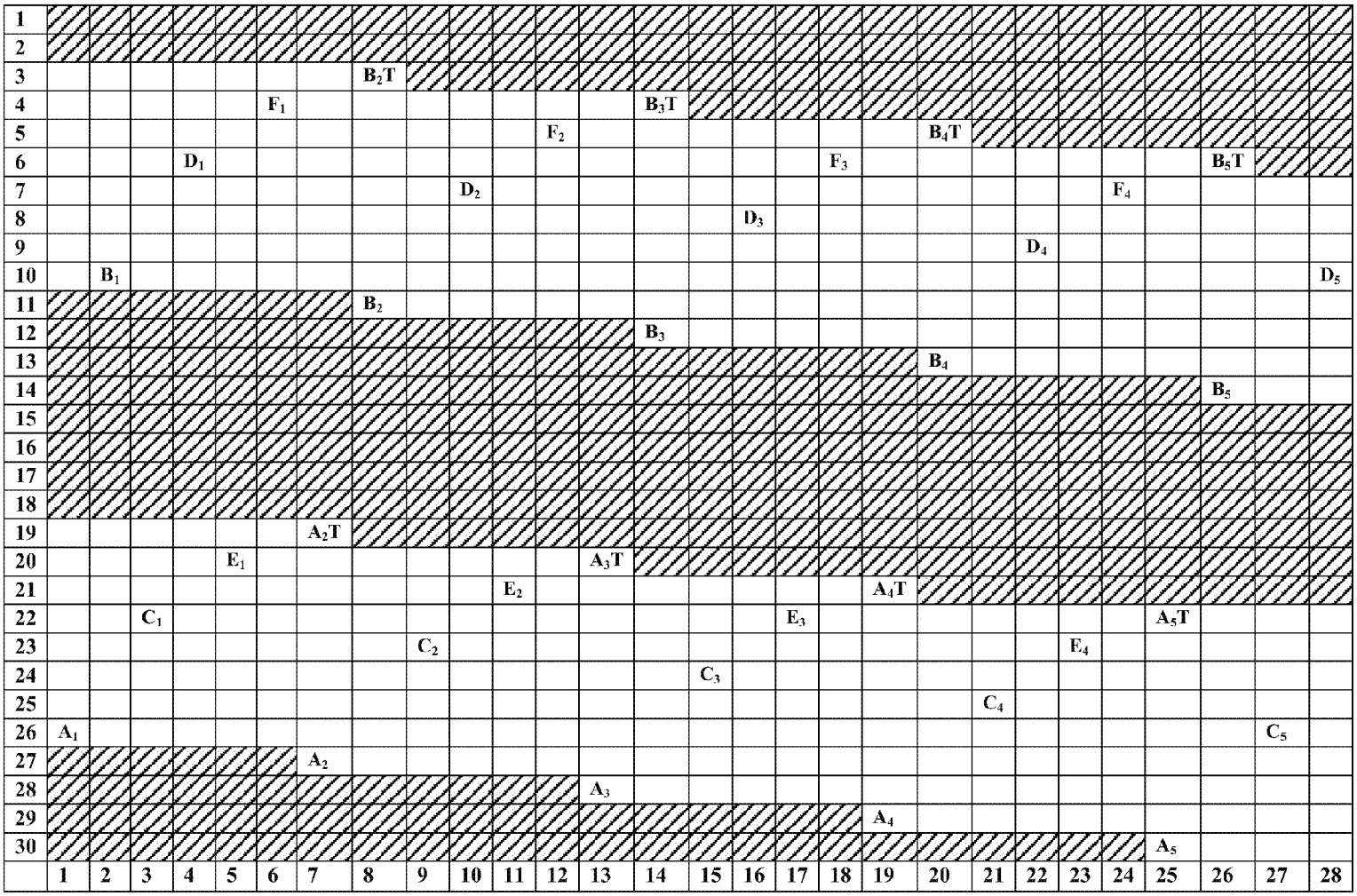
FIG. 11B is a diagram of an interlaced pulse width modulation scheme utilizing terminated write pointers in which the display comprises a plurality of scrolling color bands.

FIG. 11B presents a display modulated by a major modulation segment utilizing terminated write pointers in a manner similar to that discussed in conjunction with FIG. 9B. Row 20 receives data directed to it by write pointer $E_1$ at time slot 5. Row 20 receives image data directed to it by terminated write pointer $A_3T$ at time slot 13. Thus row 20 was in the state established by $E_1$ for 8 time slots.

The advantage of the use of terminated write pointers is that because row 20 is about to be covered by a dark band in which no light is present to be modulated the pixel of row 20 can be set to off or 0. A first advantage of doing this is that one row write cycle is saved. One additional benefit is that terminating the row sets it to a known state that will settle the liquid crystal and make the next modulation cycle using those pixels more predictable as will be shown later.

Figures 11C, 11D, 11E, 11F:
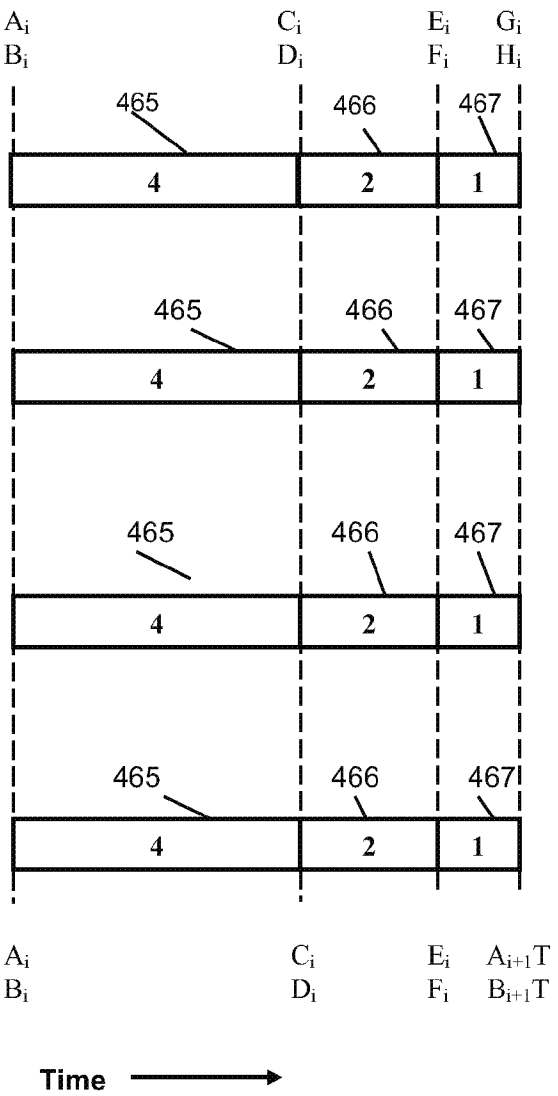
FIGS. 11C-11F are diagrams of various pulse width modulation activations corresponding to different gray levels.

FIGS. 11C-11F depict four different data states for the lesser significant bit write sequences of a pixel after this invention. In FIG. 11C modulation segment 466 is on and modulation segments 465 and 467 are off, thus establishing a modulation data state of 2. In FIG. 11D modulation segment 465 is on and all other modulation segments are off, thus establishing a modulation data state of 4. In FIG. 11E modulation segments 465 and 466 are on and modulation segment 467 is off, thus establishing a modulation data state of 6. In FIG. 11F all modulation segments are on thus establishing a modulation data state of 7.

Figure 12A:
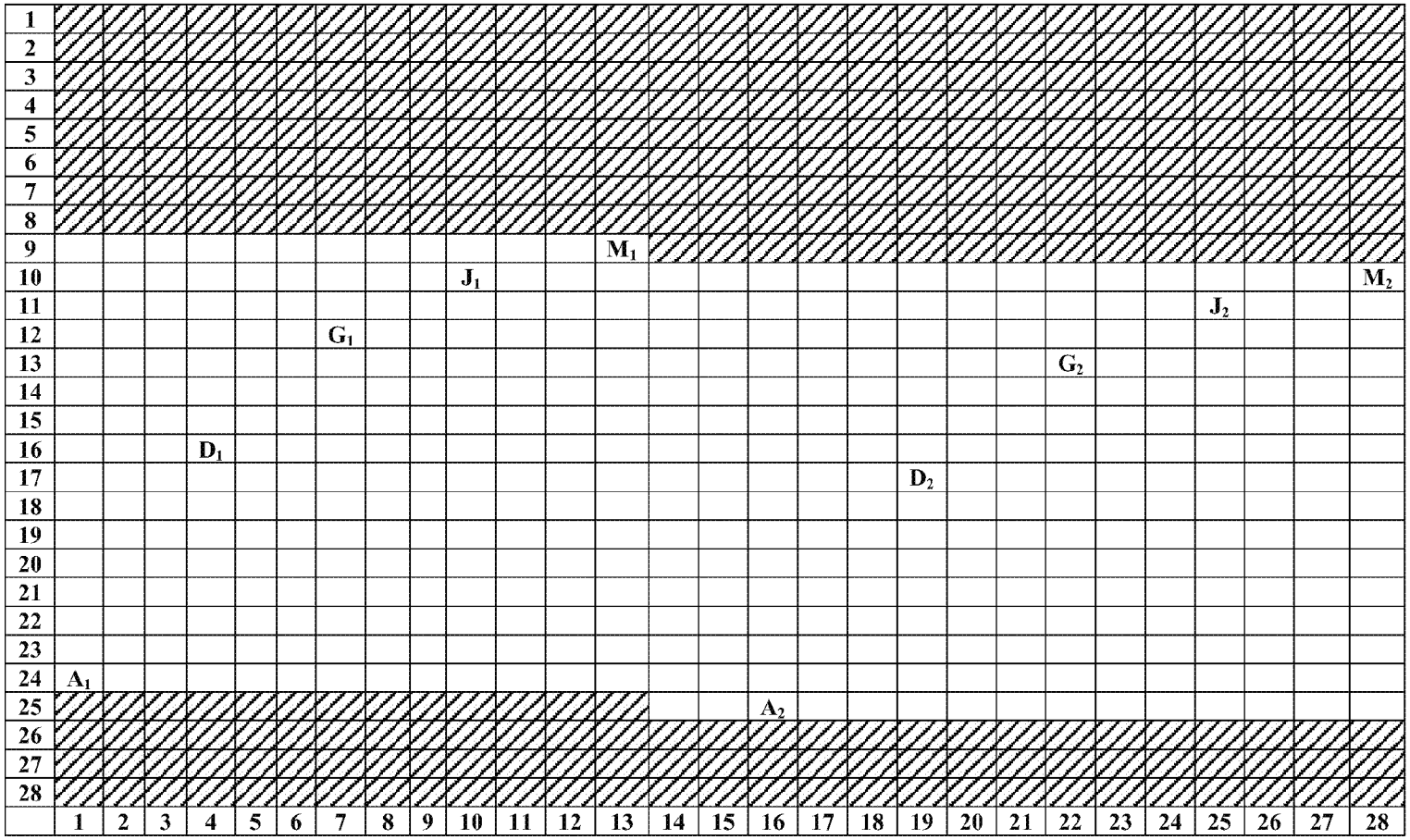
FIGS. 12A-12C are diagrams of an interlaced pulse width modulation scheme spread over three scrolling color bands.
Figure 12B:
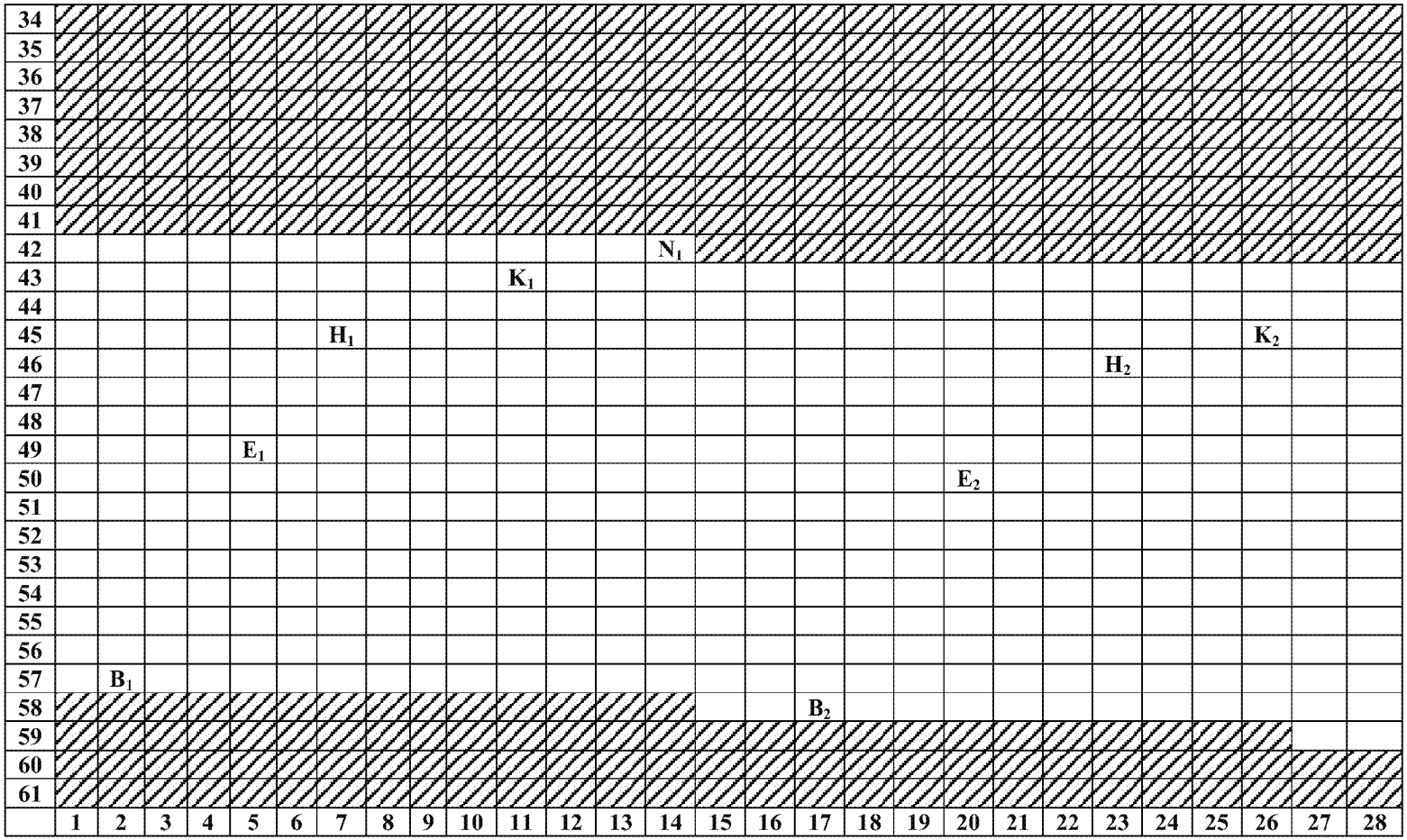
Figure 12C:
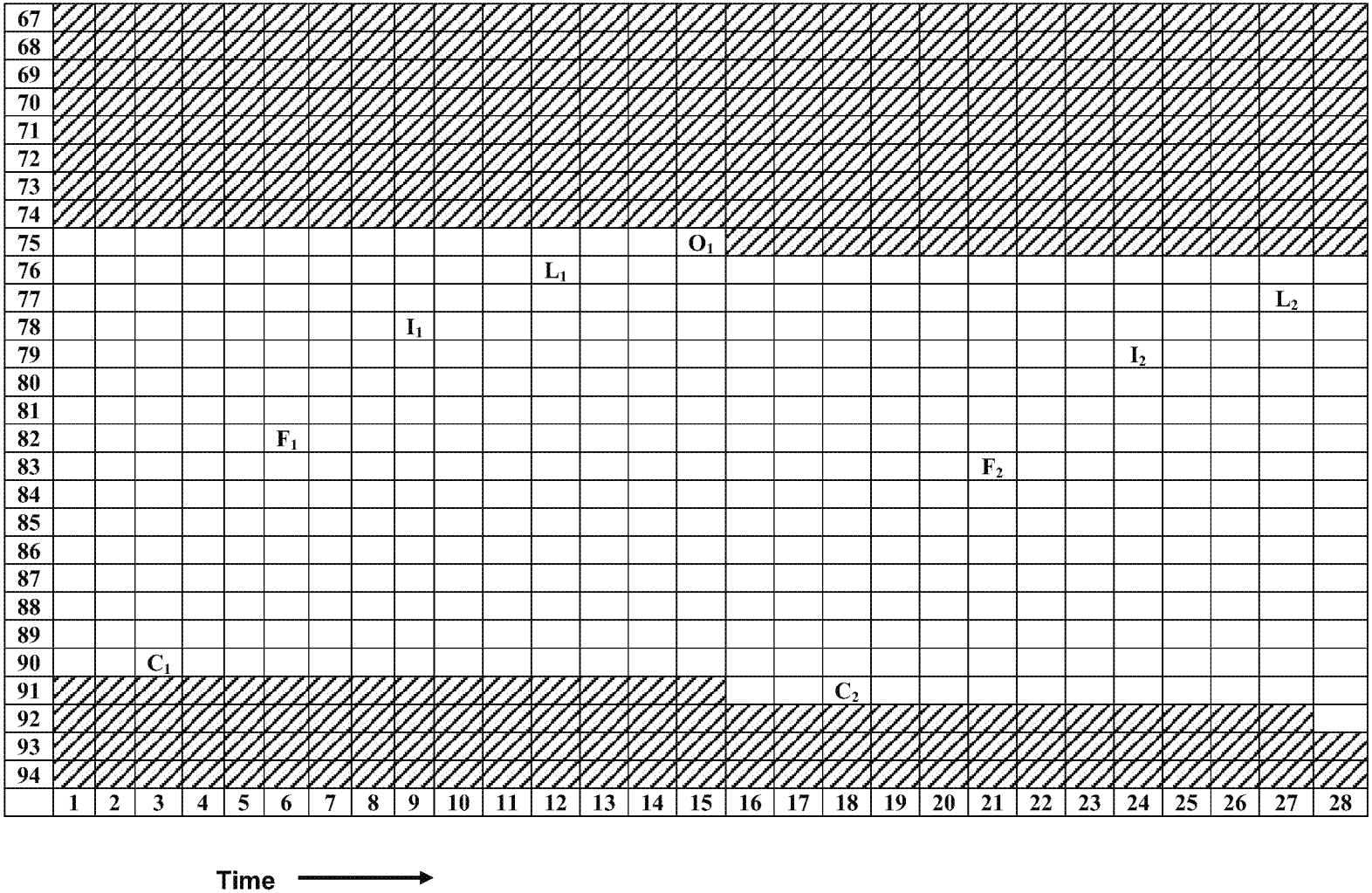

FIGS. 12A-12C present a scrolling color pulse width modulation implementation spread across three color bands after the present invention. All shaded areas on the three drawing represent dark areas between the three color bands. The vertical axis represents rows of the display with FIG. 12A representing rows 1-28. FIG. 12B represents rows 34-61, and FIG. 12C represents rows 67-94. Time slots 1-28 are represented on FIGS. 12A-12C. The write pointers are spread across FIGS. 12A-12C with write pointer $A_1$ at row 24 at time slot 1 on FIG. 12A. Write pointer $B_1$ is set to row 57 at time slot 2 on FIG. 12B. Write pointer C1 is set to row 90 at time slot 3 on FIG. 12C. All write pointers are distributed across the 3 color bands in a similar manner.

FIG. 12A presents a first scrolling color band extending from row 9 to row 24 at time slot 1 shifting to rows 10-25 at time slot 28. Write pointers $A_1$, $D_1$, $G_1$, $J_1$, and $M_1$ represent a first instance of a major modulation based on row spacing between the write pointers of 8, 4, 2 and 1 respectively. Row 10 receives image data directed to it by write pointer $J_1$ at time slot 10. Row 10 next receives image data directed to it by write pointer $M_1$ at time slot 28. This establishes a modulation duration as 18 time slots.

FIG. 12B presents a second scrolling color band extending from row 42 to row 57 at time slot 1 shifting to rows 43-58 at time slot 28. Write pointers $B_1$, $E_1$, $H_1$, $K_1$, and $N_1$ represent a first instance of a major modulation segment based on row spacing between the write pointers of 8, 4, 2 and 1 respectively. Row 43 receives image data directed to it by write pointer $K_1$ at time slot 11. Row 43 next receives image data directed to it by write pointer $N_2$ at time slot 29 (not shown). This establishes a modulation duration of 18 time slots.

FIG. 12C presents a third scrolling color band extending from row 75 to row 90 shifting to rows 76-91 at time slot 28. Write pointers $C_1$, $F_1$, $I_1$, $L_1$, and $O_1$ represent a first instance of a major modulation segment based on row spacing between the write pointers of 8, 4, 2 and 1 respectively. Row 76 receives image data directed to it by write pointer $L_1$ at time slot 12. Row 76 next receives image data directed to it by write pointer $O_2$ at time slot 30 (not shown). This establishes a modulation duration of 18 time slots.

Figure 12D:
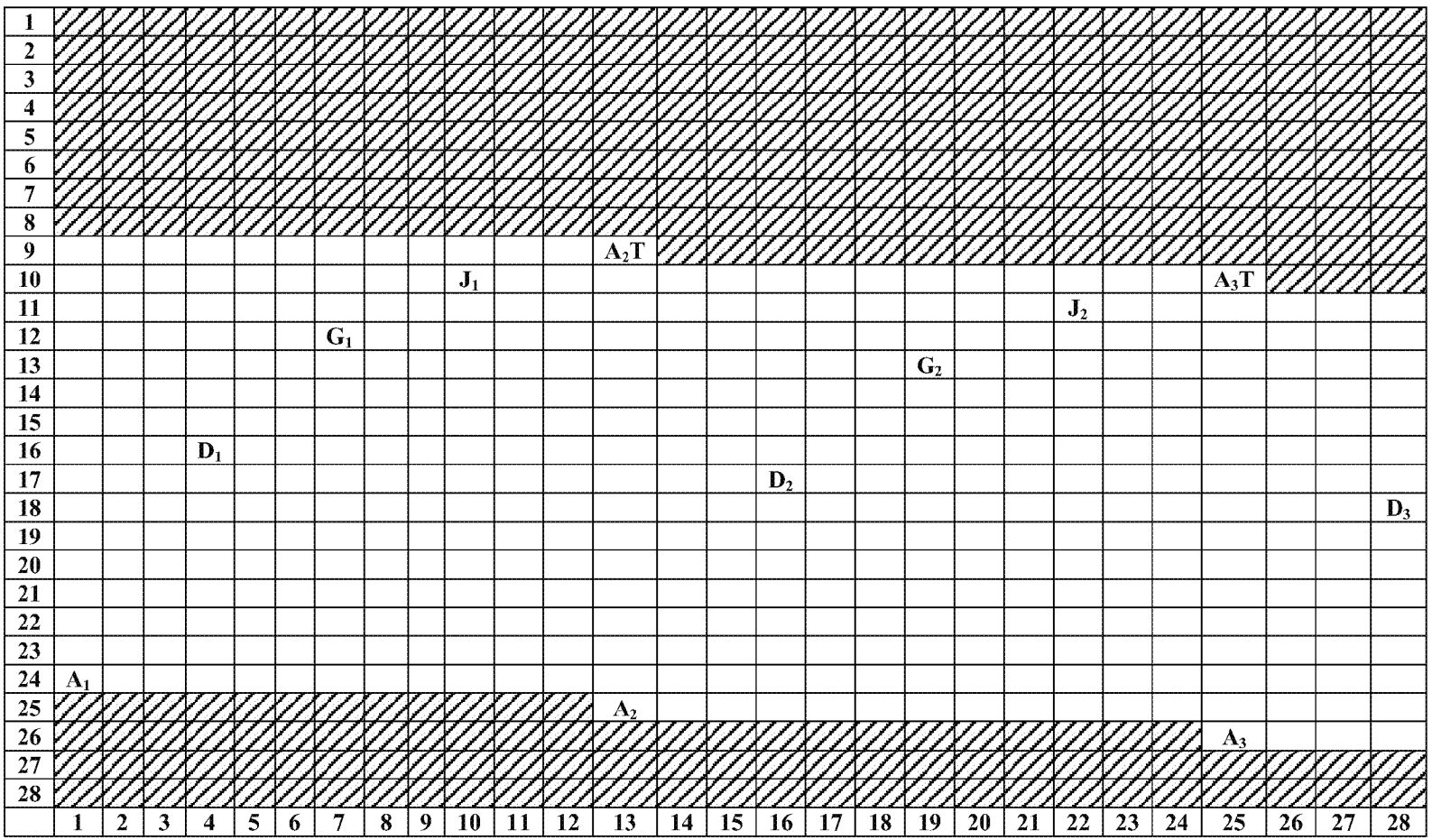
FIGS. 12D-12F are diagrams of an interlaced pulse width modulation scheme utilizing terminated write pointers spread over three scrolling color bands.
Figure 12E:
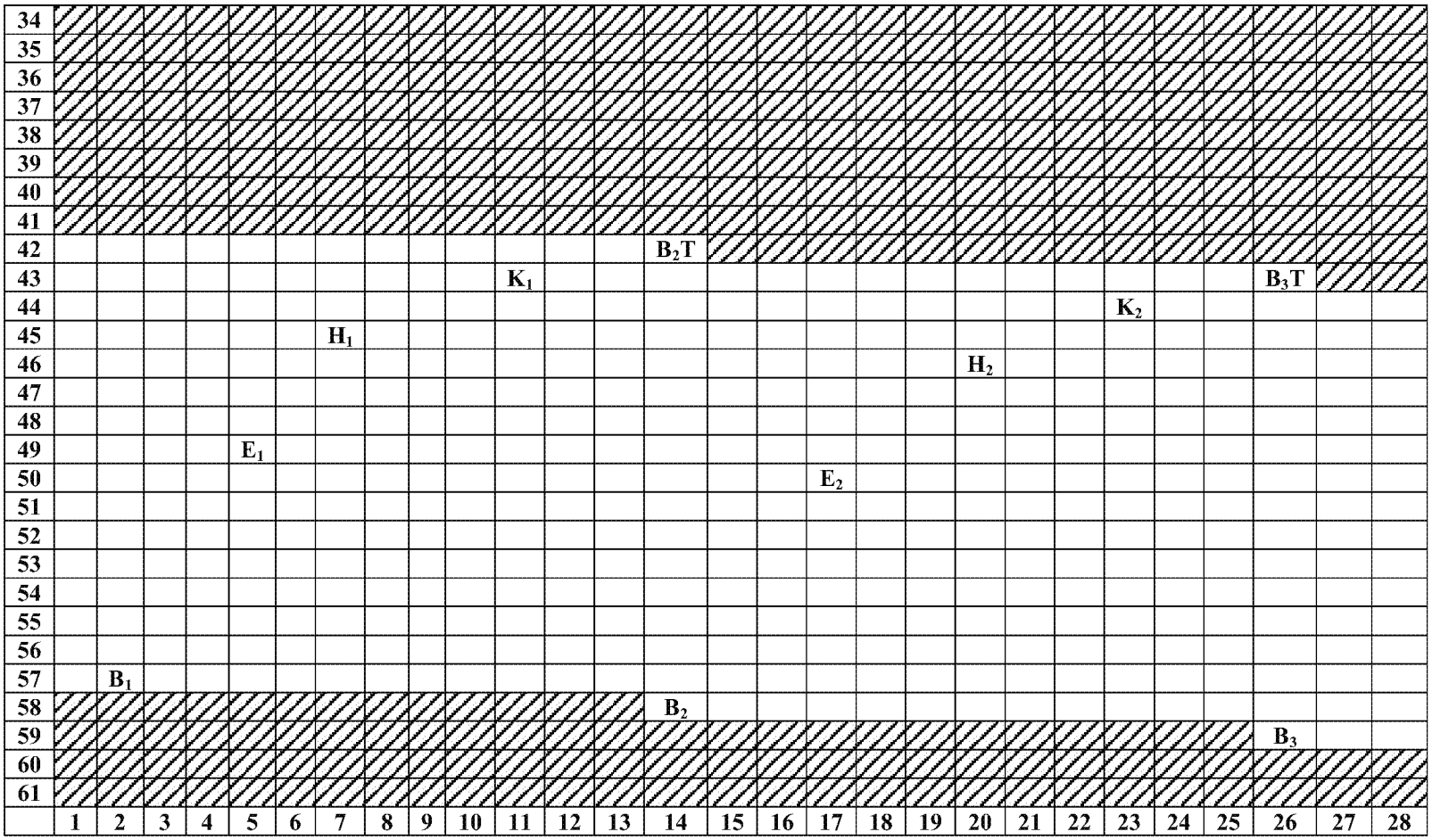
Figure 12F:
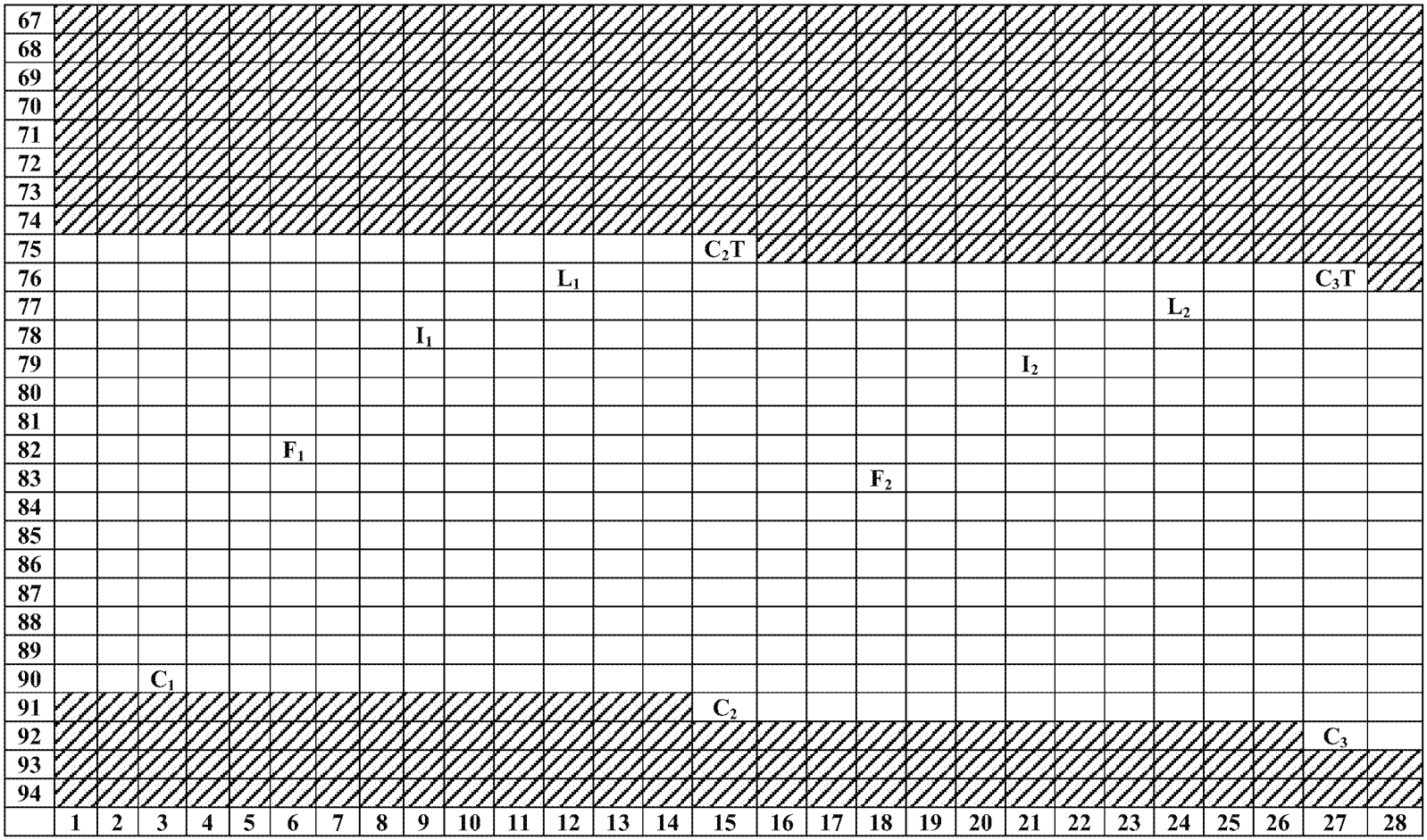

FIGS. 12D-12F present a scrolling color pulse width modulation implementation utilizing terminated write pointers spread across three color bands after the present invention. All shaded areas on the three drawing represent dark areas between the three color bands. The vertical axis represents rows of the display with FIG. 12D representing rows 1-28. FIG. 12E represents rows 34-61, and FIG. 12F represents rows 67-94. Time slots 1-28 are represented on FIGS. 12D-12F. Write pointers are spread across FIGS. 12D-12F with write pointer $A_1$ at row 24 at time slot 1 on FIG. 12A. Write pointer $B_1$ directs image data to row 57 at time slot 2 on FIG. 12B. Write pointer C1 directs image data to row 90 at time slot 3 on FIG. 12C. All remaining write pointers are distributed across the 3 color bands in a similar manner.

FIG. 12D presents a first scrolling color band extending from row 9 to row 24 at time slot 1 shifting to rows 11-26 at time slot 28. Write pointers $A_1$, $D_1$, $G_1$, $J_1$, and $A_2T$ represent a first instance of a major modulation segment based on row spacing between the write pointers of 8, 4, 2 and 1 respectively. Row 10 receives image data directed to it by write pointer $J_1$ at time slot 10. Row 10 next receives off state image data directed to it by terminated write pointer $A_3T$ at time slot 25. This establishes a modulation duration of 15 time slots.

FIG. 12E presents a second scrolling color band extending from row 42 to row 57 at time slot 1 shifting to rows 43-58 at time slot 28. Write pointers $B_1$, $E_1$, $H_1$, $K_1$, and $B_2T$ represent a first instance of a major modulation segment based on row spacing between the write pointers of 8, 4, 2 and 1 respectively. Row 43 receives image data directed to it by write pointer $K_1$ at time slot 11. Row 43 next has off state image data directed to it by terminated write pointer B3T at time slot 26. This establishes a modulation duration of 15 time slots.

FIG. 12F presents a third scrolling color band extending from row 75 to row 90 shifting to rows 77-92 at time slot 28. Write pointers $B_1$, $E_1$, $H_1$, $K_1$, and terminated write pointer $C_2T$ represent a first instance of a major modulation segment based on row spacing between the write pointers of 8, 4, 2 and 1 respectively. Row 76 receives image data directed to it by write pointer $K_1$ at time slot 12. Row 76 next receives image data directed to it by terminated write pointer $C_3T$ at time slot 27. This establishes a modulation duration of 15 time slots.

In the present example all terminated write pointers are shown as being associated with a write pointer or row write action within the same color band. Instances where the terminated write pointer is associated with a write pointer or row write action in a different color band are within the scope of this invention.

Figures 12G, 12H, 12I, 12J:
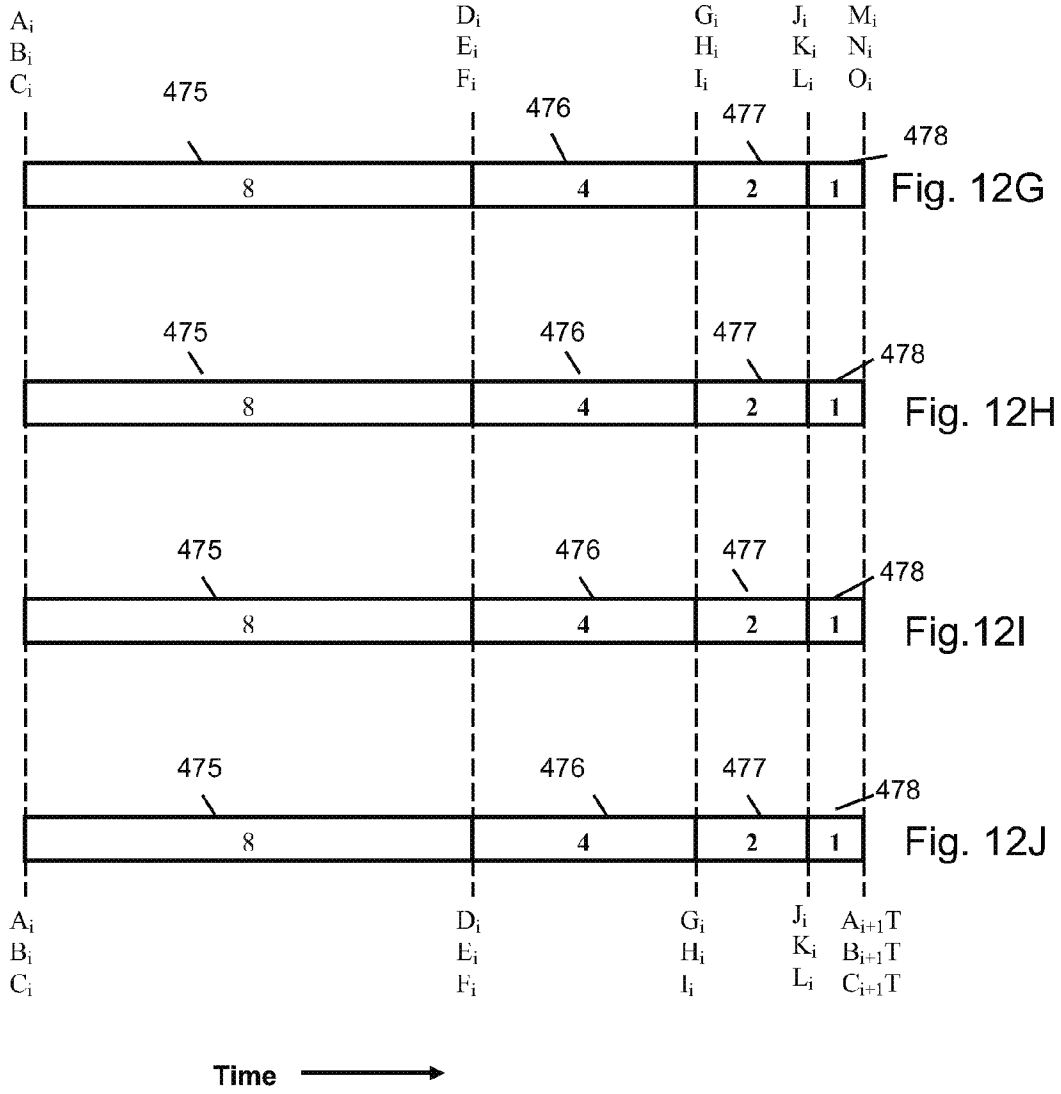
FIGS. 12G-12J are diagrams of various lesser significant bit pulse width modulation activations corresponding to different gray levels.

FIGS. 12G-12J depict four different data states for the lesser bit segment write sequences of a pixel after this invention. In FIG. 12G modulation segment 477 is on and modulation segments 475, 476 and 478 are off, thus establishing a modulation data state of 2. In FIG. 12H modulation segment 476 is on and all other modulation segments are off, thus establishing a modulation data state of 4. In FIG. 12I modulation segments 476 and 477 are on and modulation segments 475 and 478 are off, thus establishing a modulation data state of 6. In FIG. 12J modulation segments 476, 477 and 478 are on and modulation segment 475 is off thus establishing a modulation data state of 7. By inspection the maximum bit depth available is 15 if all segments are on.

In the present example all three colors are presented with the same major modulation segment. It is within the scope of this invention for the modulation segment applied to one color to differ from that applied to another color.

A reason for implementing a modified modulation sequence is to have means to compensate for differences in the authority of a given duration of pulse width modulation on the light modulating means, such as a nematic liquid crystal cell. This becomes very important when leaving the dark state of a nematic liquid crystal cell a pulse width of sufficient duration to have the desired effect may have too much effect on the same liquid crystal cell when operating at the middle of its modulation operating range. The presence of a second modulation segment in addition to a least significant bit segment wherein the second modulation segment is set to assist the least significant bit segment when operating at the low end of its operating range. In brief, the second modulation segment is turned on when certain boundary conditions are met relating to other data in the same data stream. Examples follow.

FIG. 13A presents a major modulation segment wherein an adjustment to the duration of a least significant bit is possible. Means for implementing this are explained in detail in U.S. application Ser. No. 11/740,238, now U.S. Pat. No. 8,111,271, and in U.S. application Ser. No. 13/340,100, now U.S. Pat. No. 8,264,507. In a first instance of a major modulation segment, write pointer $D_1$ directs image data to row 3 in time slot 4. Write pointer $E_1$ directs image data to row 2 in time slot 5 and write pointer $F_1$ directs image data to row 1 in time slot 6. Row 3 receives image data directed to it to when write pointer $E_2$ directs image data to row 3 at time slot 11 and row 2 next has image data directed to it by write pointer $F_2$ at time slot 12, a different of 7 time slots for both. Row 3 again has image data directed to it by write pointer $F_3$ at time slot 18, a different of 7 time slots from write pointer $E_2$ and 14 from write pointer $D_1$. Note that there are now two modulation segments that correspond to the minimum row spacing between row write actions of one row and that these segments are now temporally adjacent.

FIG. 13B presents a major modulation segment similar to that of FIG. 12A wherein the last element of the major modulation segment is a terminated write pointer as previously described. Row 3 receives image data directed to it by write pointer $D_1$ at time slot 4. Row 2 receives image data directed to it by write pointer $E_1$ at time slot 5 and row 1 receives image data directed to it by terminated write pointer $A_2T$ associated with write pointer $A_2$ in time slot 5. Row 3 next receives image data directed to it by write pointer $E_2$ at time slot 10 and row 2 next receives data directed to it by terminated write pointer $A_3T$ associated with write pointer $A_3$ at time slot 11, a difference of 6 time slots for both. Row 3 next receives data directed to it by terminated write pointer $A_4T$ at time slot16, again a different of 6 time slots from write pointer $E_2$. Thus the same condition as found in FIG. 12A is created.

It is appropriate to consider when to use the extra least significant bit weighting. FIGS. 13C-13F depict a series of binary weighted modulation segments. The modulation segments comprise the lesser binary weighted segment including a least significant bit segment (lsb). In FIGS. 13C-13F item 488 is an lsb segment that is always activated when the data contains "on" data for an lsb. Lsb segment 489 is an lsb segment that is activated when system logic determines that an extra lsb segment is needed according to a predetermined, external logic. The exact criteria are difficult to generalize because of the large number of different electro-optical liquid crystal modes that exist. Each mode has its own set of response characteristics that will create a requirement for solutions that are different from other modes. In the examples of FIGS. 13C-13F the absence of lsb segment 486 is a first trigger for activation of second lsb segment 489. A second trigger is that first lsb segment 488 must be on for activation of second lsb segment 489. In practice a different set of triggers may be selected.

Figures 13C, 13D, 13E, 13F:
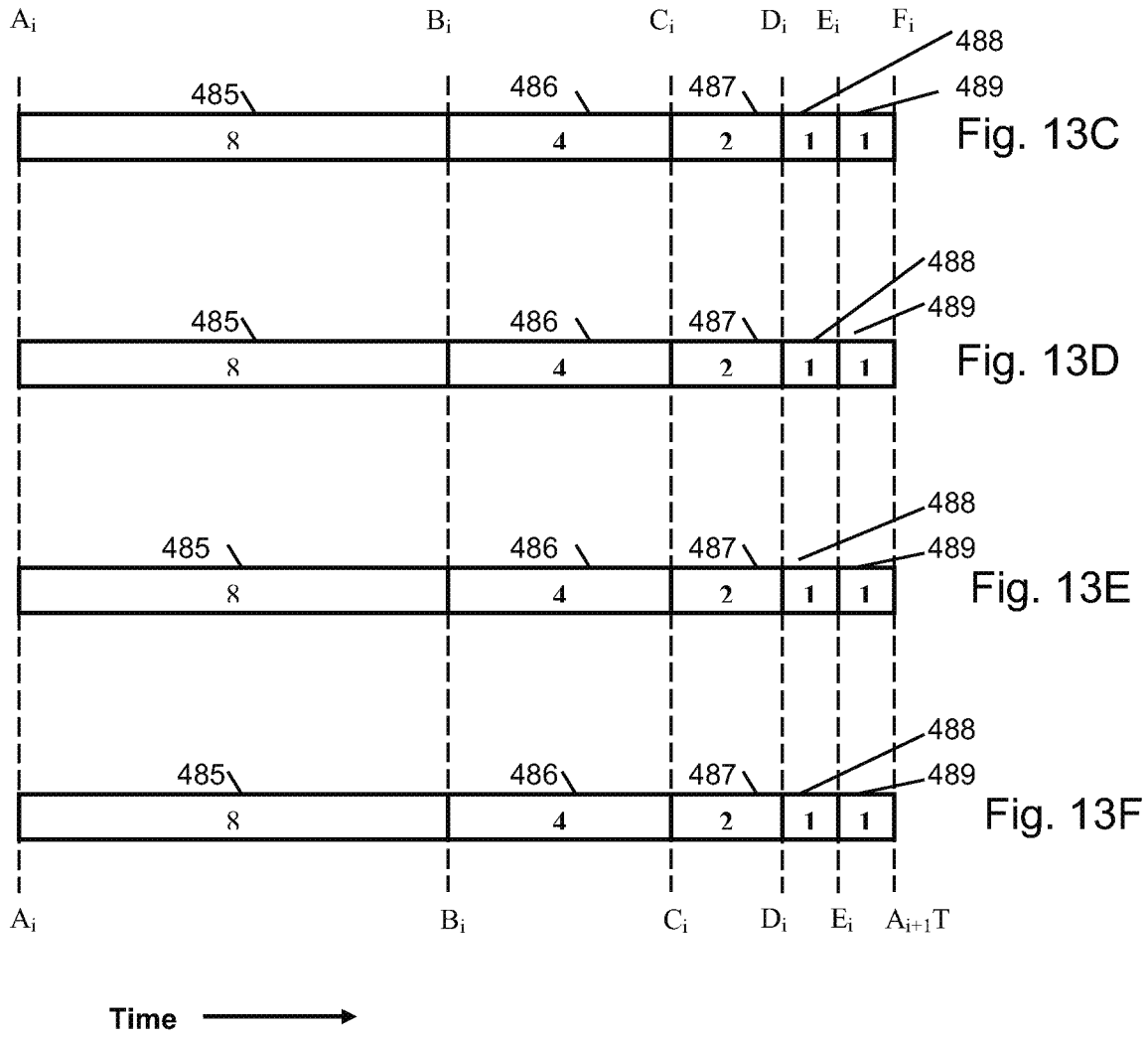
FIGS. 13C-13F are diagrams of various lesser significant bit pulse width modulation activations corresponding to different gray levels.

The write pointers of FIG. 13A that begin and end each segment are annotated at the top of FIGS. 13C-13F, and the write pointers of FIG. 13B are annotated at the bottom.

In FIG. 13C modulation segment 488 is on and no other modulation segments are on. This corresponds to a low modulation state and modulation segment 489 is also turned on as a consequence.

In FIG. 13D modulation segment 486 is on so according to the above stated logic second lsb segment 489 is off.

In FIG. 13E modulation segment 486 is off and first lsb segment 488 is on. Therefore second lsb segment 489 is on.

In FIG. 13F modulation segments 485, 486 and 487 are on and first lsb segment 488 is on. Therefore second lsb segment 489 is not on.

Figure 14A:
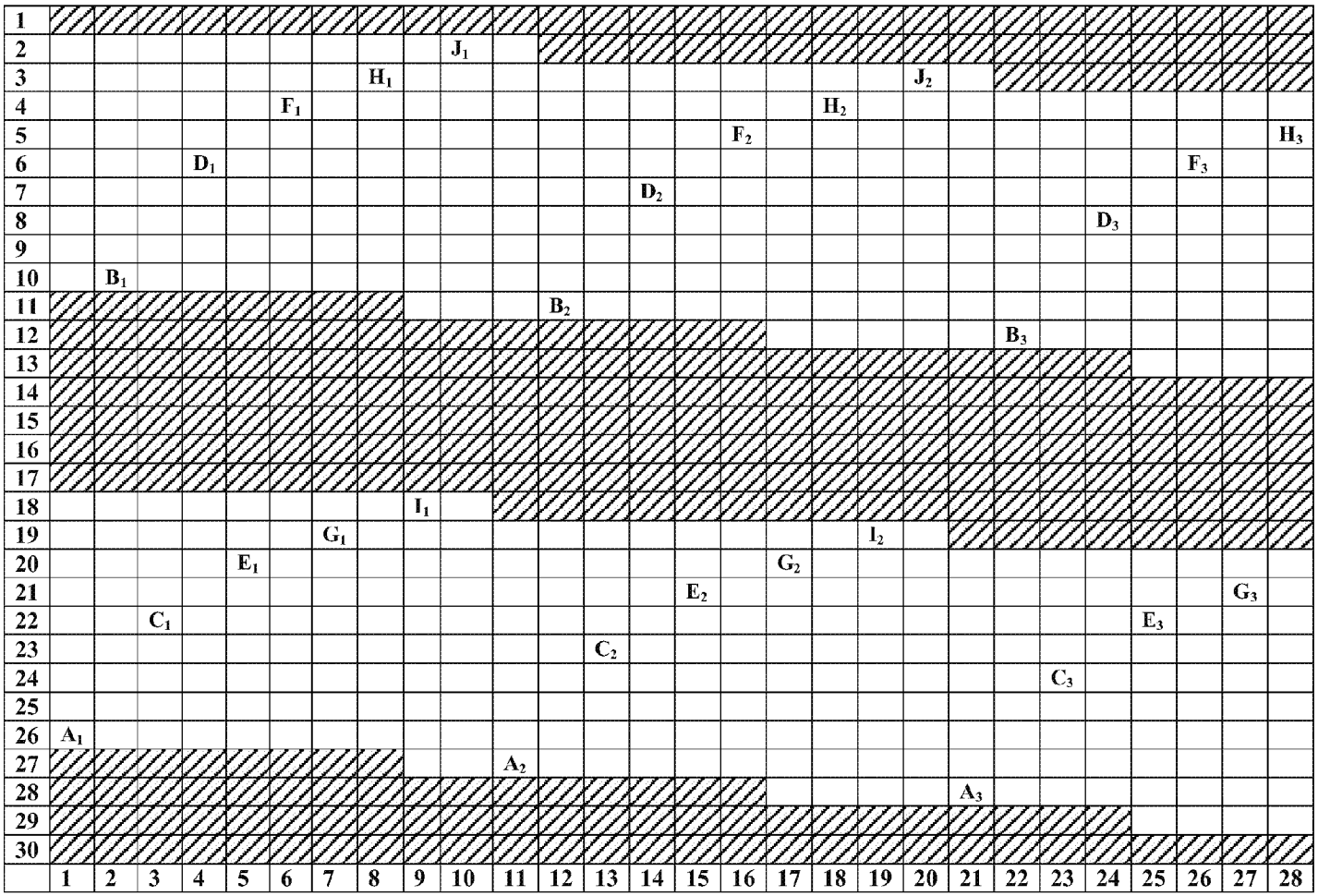
FIG. 14A is a diagram of an interlaced pulse width modulation scheme which varies the pulse width duration attributed to a least significant bit segment based on external criteria in which the display comprises a plurality of scrolling color bands.

FIG. 14A depicts a display pulse width modulated after the present invention. The display is a scrolling color display that is pulse width modulated. The vertical axis represents rows 1 through 30 of the display and the horizontal axis represents time slots 1 through 28. The shaded areas beginning in time slot1 at rows 1, 11-17, and 27-30 represent the dark gaps between bands of scrolling color. The unshaded areas beginning in time slot 1 at rows 2-10 and 18-26 represent areas illuminated by the scrolling color bands with the two unshaded areas representing different, unspecified colors.

The major modulation segment in the lower band comprises write pointers $A_i$, $C_i$, $E_i$, $G_i$ and $I_i$ separated by 4, 2, 1, and 1 rows respectively. The interval between write pointers $E_i$ and $G_i$ represents a first lsb segment as described for FIG. 14A. The interval between write pointers $G_i$ and $I_i$ represents a second lsb segment as described for FIG. 14A. The same holds true for the major modulation segment in the upper band for write pointers $B_i$, $D_i$, $F_1$, $H_i$ and $J_1$. The major modulation segments in the upper and lower bands are not constrained to be identical in order.

In the lower band write pointer $C_1$ directs image data to row 22 at time slot 3. Row 22 has image data directed to it by write pointer $E_3$ at time slot 25, thus setting 22 time slots as the duration of a modulation segment of two least significant bits duration. Write pointer $E_1$ directs image data to tow 20 at time slot 5. Row 20 next has image data directed to it by write pointer $G_2$ at time slot 17, thus establishing 12 time slots as a first least significant bit (lsb) duration. Write pointer $G_1$ directs image data to row 19 $G_1$ at time slot 7 and has image data next directed to it by write pointer $I_2$ at time slot 19, thus establishing 12 time slots as the duration of a second lsb duration. Again the relationship between row spacing and pulse width duration is not precise but it is again clear that a major modulation segment with a significantly larger number of write pointers will be closer.

The duration of the modulation segments in the upper color band are identical to those in the lower color band in this example.

Figure 14B:
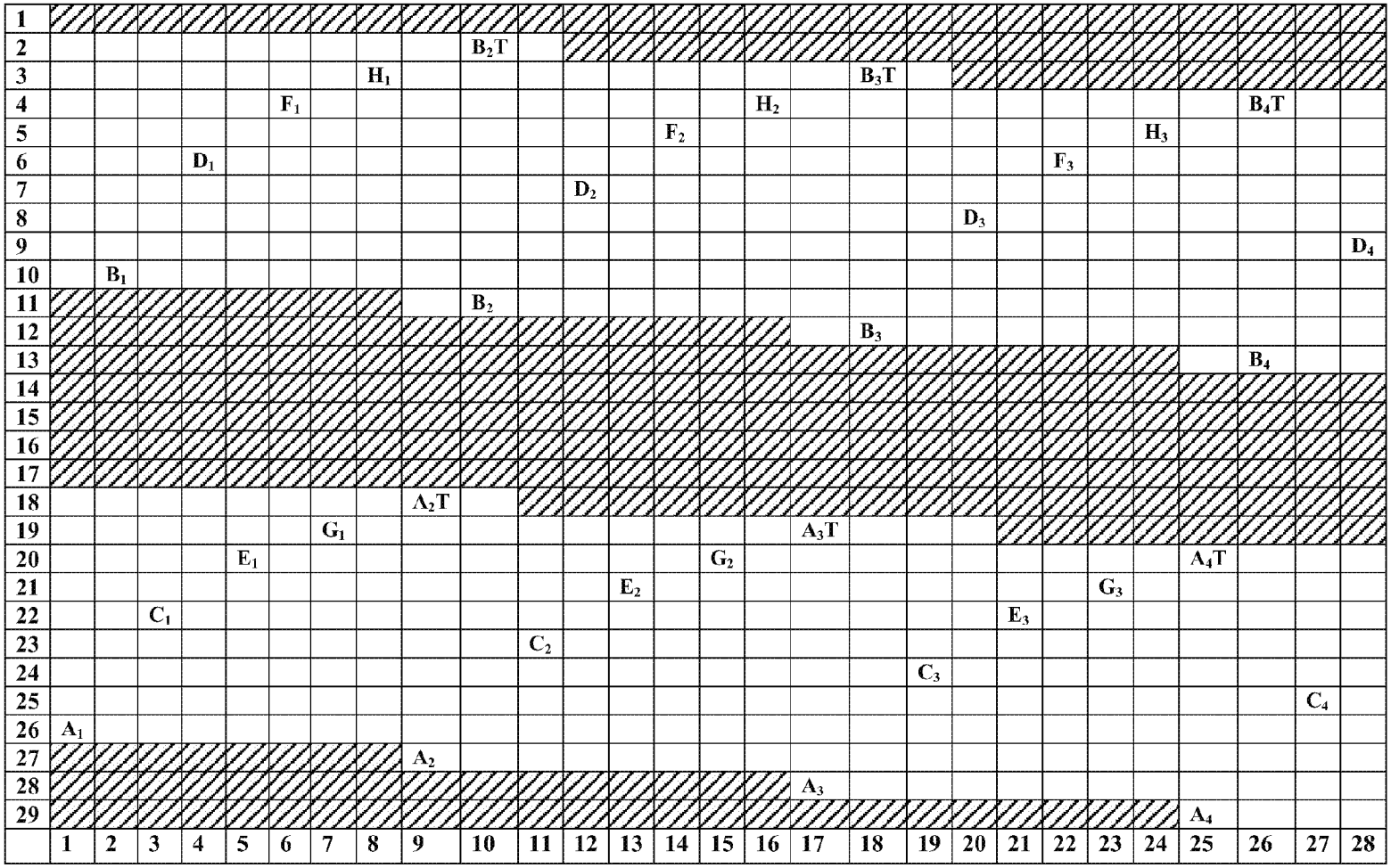
FIG. 14B is a diagram of an interlaced pulse width modulation scheme utilizing terminated write pointers which varies the pulse width duration attributed to a least significant bit segment based on external criteria in which the display comprises a plurality of scrolling color bands.

FIG. 14B presents a display modulated by a major modulation segment utilizing terminated write pointers in a manner similar to that discussed in conjunction with FIG. 9B. The row spacing between write pointers $A_1$ and $C_1$ is 4 rows. The row spacing between write pointer $C_1$ and $E_1$ is 2 rows. The row spacing between write pointers $E_1$ and $G_1$ is 1 row, and the row spacing between write pointer $G_1$ and terminated write pointer $A_2T$ is one row. These two intervals establish a first lsb segment and a second lsb segment. Row 20 first has image data directed to it by write pointer $E_1$ at time slot 5. Row 20 next has image data directed to it by write pointer $G_2$ at time slot 15, thus establishing the duration of a first lsb segment as 10 time slots. Row 20 next has off state data directed to it by terminated write pointer $A_4T$ at time slot 25. Thus row 20 was in the state established by $E_1$ for 10 time slots and was held at the state established by $G_2$ for an additional 10 time slots.

The use of a terminated write pointer in place of a write pointer offers the previously mentioned advantage of reducing the required number of write pointers by one each time the modulation sequence is applied.

The duration of the modulation segments in the upper color band are identical to those in the lower color band in this example.

FIGS. 14C-14F depict four different data states for the lesser bit segment write sequences of a pixel after this invention. The write pointers that begin and end the modulation segments in FIG. 14A are annotated at the top of the figures. Those for FIG. 14B are annotated at the bottom of the figures.

In the examples of FIGS. 14C-14F the absence of lsb segment 496 is a first trigger for activation of second lsb segment 489. A second trigger is that first lsb segment 497 must be on for activation of second lsb segment 498. In practice a different set of triggers may be selected.

Figures 14C, 14D, 14E, 14F:
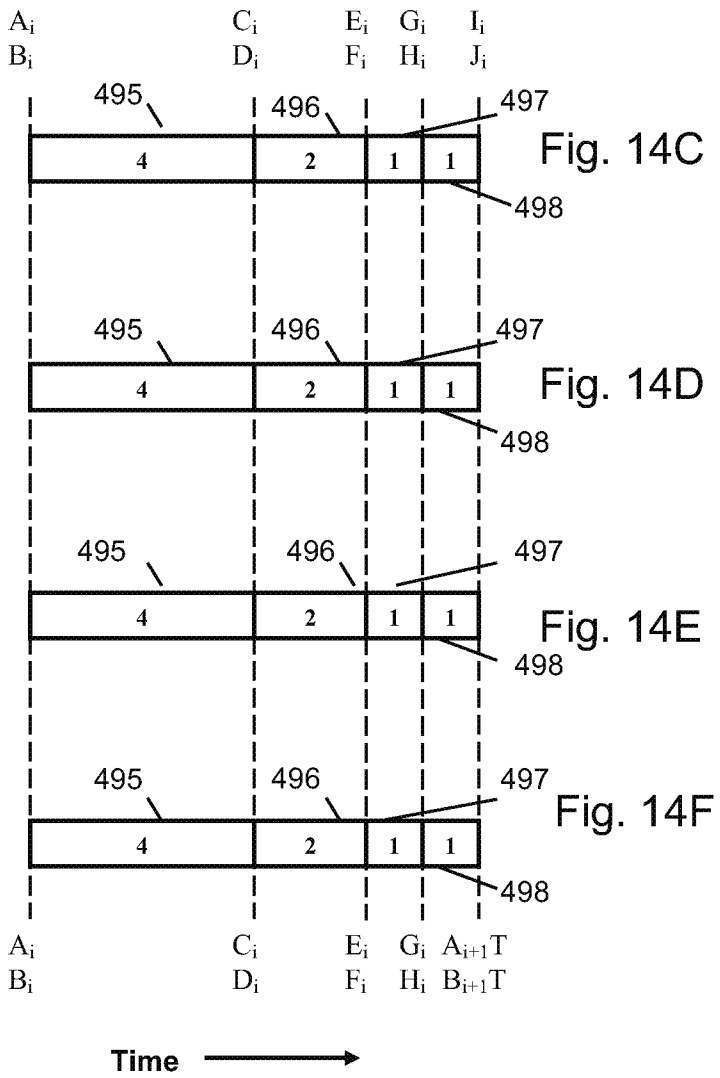
FIGS. 14C-14F are diagrams of various lesser significant bit pulse width modulation activations corresponding to different gray levels in which the duration attributed to a least significant bit is based on external criteria.

In FIG. 14C modulation segment 497 is on and modulation segments 495 and 496 are off. Because modulation segment 496 is off and first lsb segment 497 is on, second lsb segment 498 is also set to on.

In FIG. 11D modulation segment 495 and first lsb segment 497 are on and modulation segment 496 is off. Since lsb segment 496 is off and first lsb segment 497 is on, second lsb segment 498 is turned on.

In FIG. 11E modulation segments 495 is off and modulation segment 496 is on. First lsb segment 497 is on and second lsb segment 498 is turned off since modulation segment 496 is on.

In FIG. 11F modulation segments 495 and 496 are on and first lsb segment 497 are on. Since modulation 496 is on second lsb segment 498 is off.

The examples of FIG. 14A and FIG. 14B can be extended to systems where three or more colors bands are present on the face of the display within the scope of this invention.

One of the problems with any pulse width modulation device is to find a way to create the full range of required gray scale while avoiding visual artifacts such as flicker or other artifacts such as lateral field effects in liquid crystal devices. A scrolling color system placed additional constraints on previously developed solutions that require a new approach.

Figure 8A:
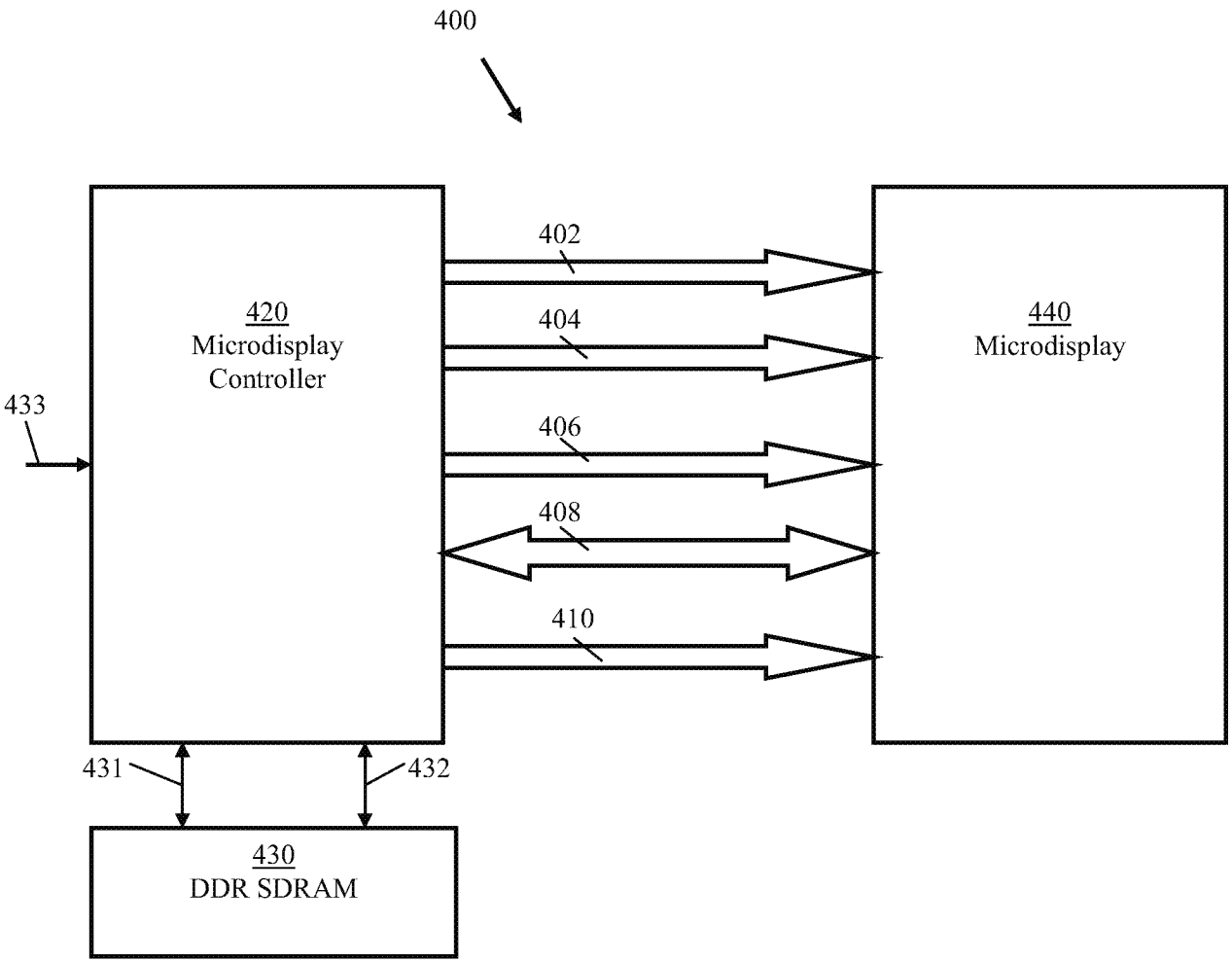
FIG. 8A is a data and logic diagram of a multi pixel liquid crystal display in accordance with the present invention.
Figure 8B:
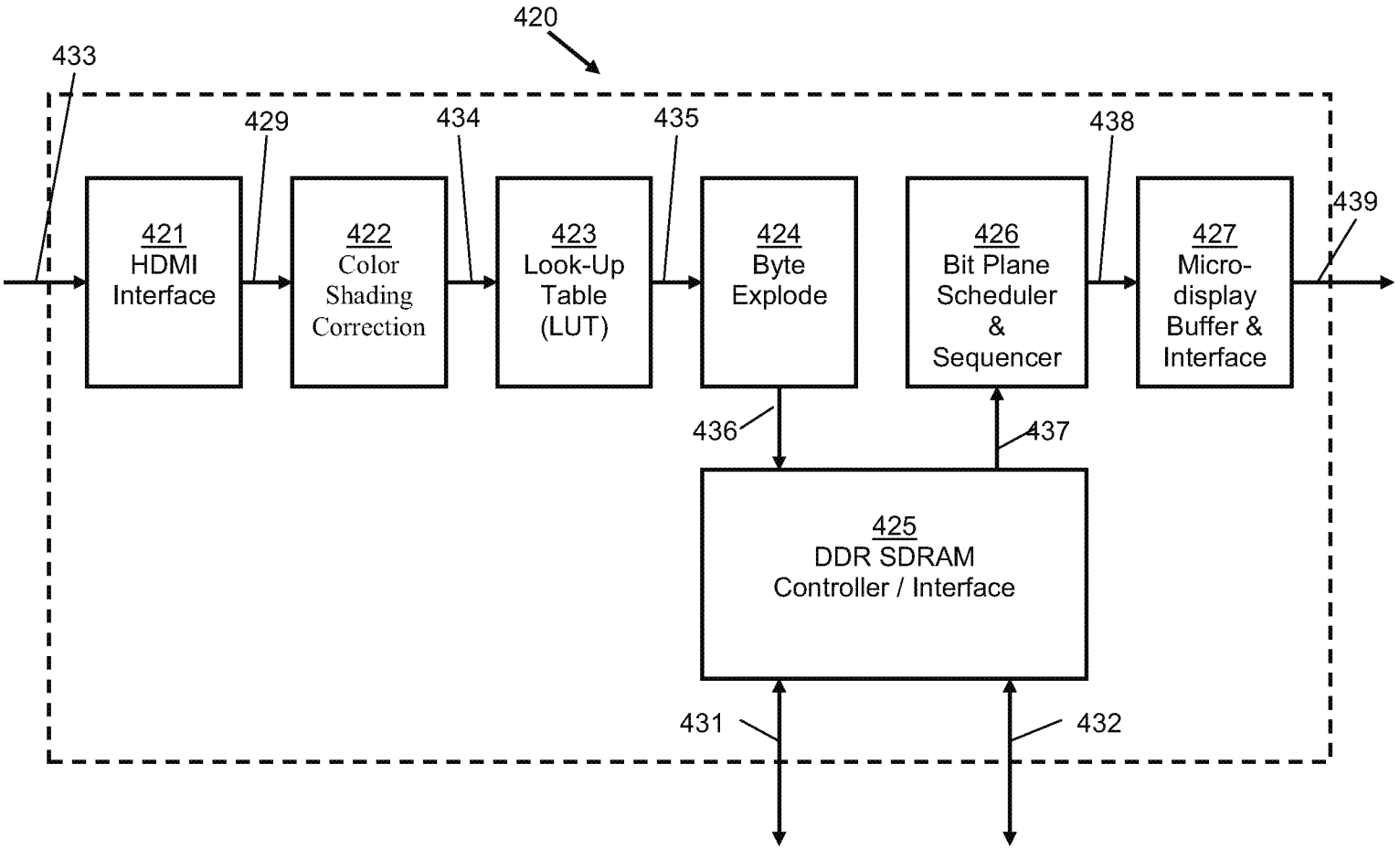
FIG. 8B is a block diagram of a microdisplay logic and data controller for a multi pixel liquid crystal display in accordance with the present invention.
Figure 8C:
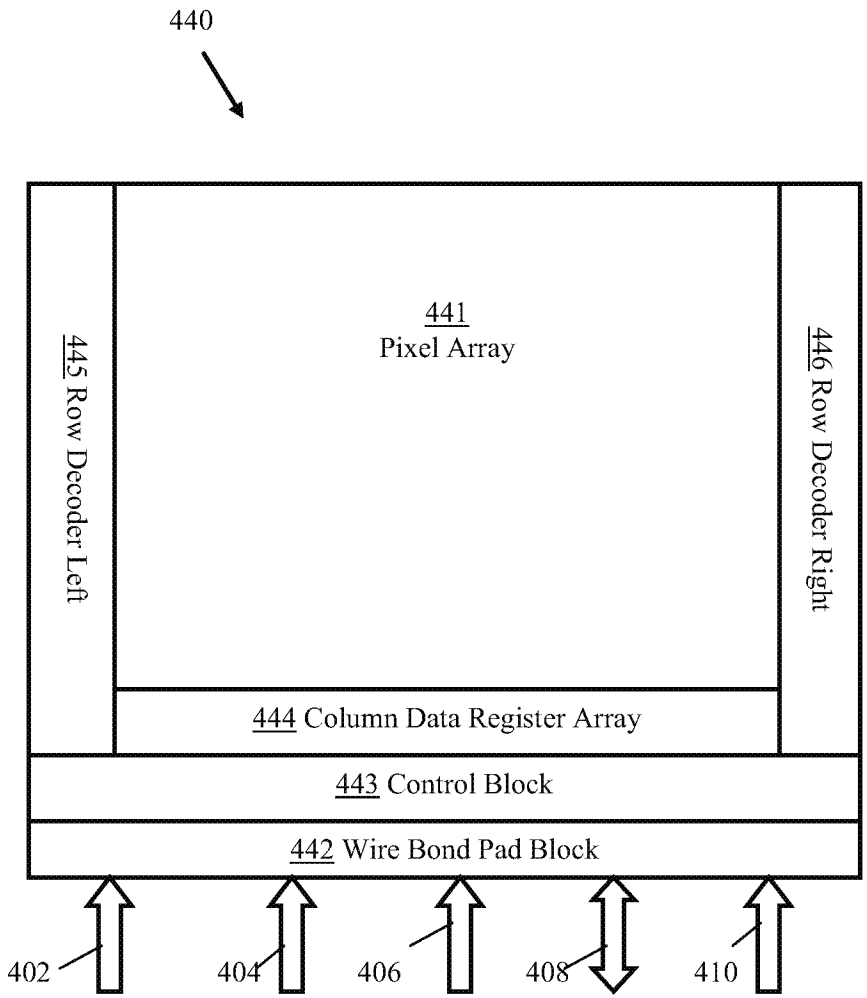
FIG. 8C is a block diagram of a liquid crystal display in accordance with the present invention.
Figure 15A:
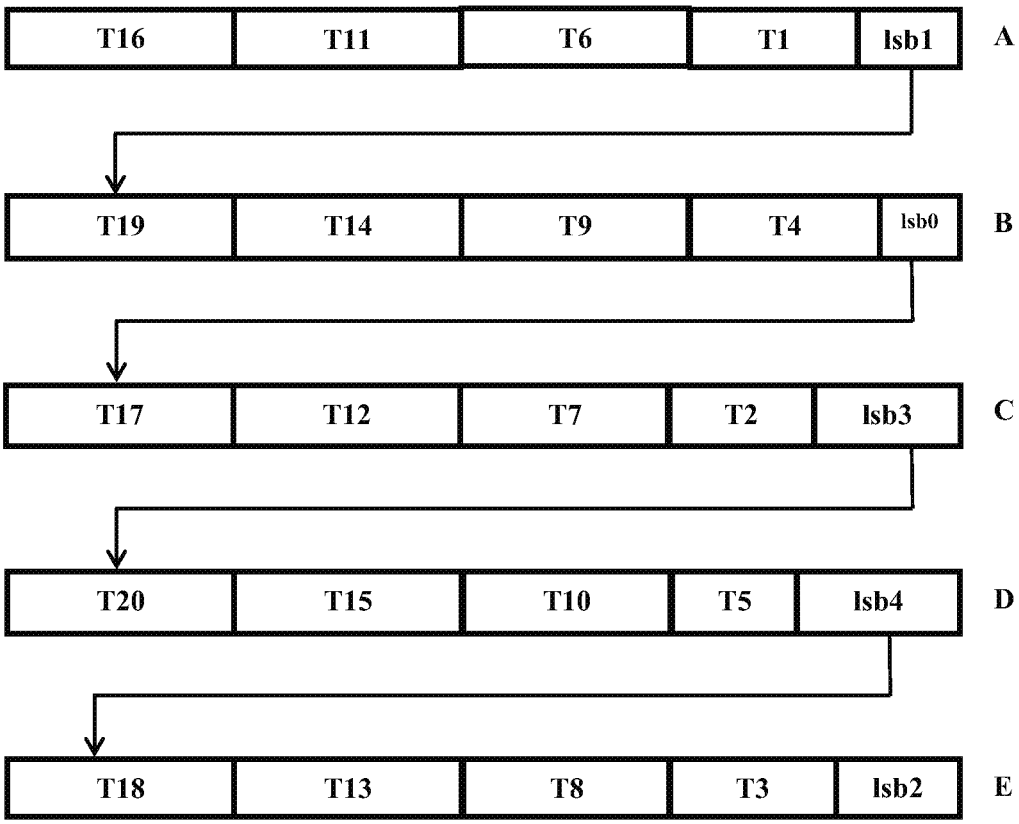
FIG. 15A is a diagram of a series of temporally separated pulse width modulation segments comprising a full modulation range for a scrolling color projection display.

FIG. 15A depicts one method of solving the aforementioned problem. First the data for each color is reformatted within a controller such as that of FIG. 8B. The lesser five binary bits may be retained in that form while the upper bits are reformatted into a set of thermometer bits as previously described in this application. The key feature of a thermometer bit is that it is always populated in the same order. If a first thermometer bit is turned on at a certain gray level then it will always remain on at any higher gray levels. In FIG. 15A T1 is the first thermometer bit turned on as gray scale increases, T2 is the second, and so to T20 as the last thermometer bit turned on. In one embodiment lsb 0 represents 1, lsb1 represents 2, lsb3 represents 4, lsb4 represents 8, and lsb5 represents 16. In another embodiment lsb4 represents 4 and lsb5 represents 4, wherein lsb4 and lsb5 are always operated on or off together. In one embodiment the durations of the individual thermometer bits are determined such that the desired intensity output is achieved for a given image data input received. These durations may compensate for gamma correction and for non-linearities in the electro-optic curve of a liquid crystal cell.

The reformatted data for each color is then separately divided into 5 separate major modulation segments, designated in this example as A, B, C, D, and E. It is understood that in FIG. 15A the temporal order in which the major modulation segments are applied to a row begins with A and ends with E in alphabetical order.

Major modulation segment A comprises thermometer bit segments T16, T11, T6, and T1 and lesser bit segment lsb1. The temporal order in which the bit segments are applied to a row of the display begins with T16, followed by T11, T6, T1 and lsb1 in that order. As the gray scale value for the individual pixels of a row increase the segments earlier in time in the major modulation segments will be turned on. If T1 is on, the next thermometer modulation segment that is to be turned on is T6. The next one after T6 is T11 and the next one after that is T16. Because no earlier thermometer bit is turned off as a result of the increase in gray scale, the result is a continuous rise in the liquid crystal to its on state without interruption during that major modulation segment. The lesser bit segments may be turned on or off depending on the exact nature of the lesser bits in the image data. By positioning a single lesser bit segment at the end of each major modulation segment the unpredictable nature of whether a particular lesser bit segment is on or off is rendered moot. It is also important that the image data on each row be turned to off when the major modulation segment is completed. A first reason is that the exact position of the color bands relative to the data may vary slightly for various reasons, including mechanical ones. The second reason is that setting all the image data values for a row to off will drive the liquid crystal associated with the pixels of that row to a known state prior to the start of the next major modulation segment.

In some instances it may be necessary to place two lesser bits at the end of a major modulation segment. In that case it is preferable to make the first of the two the smaller of the two segments.

Major modulation segment B comprises thermometer bits T19, T14, T9, and T4 and lesser bit segment lsb0. The same arguments presented for major modulation segment A apply here at to major modulation segments C, D, and E as well.

The allocation of a particular thermometer bit to a given major modulation segments is done in order to keep the intensity of the major modulation segments roughly the same. This is an important part of keeping flicker under control. For example, consider the allocation of thermometer bit segments T1, T2, T3, T4, and T5. Thermometer bit segment T1 is allocated to major modulation segment A and thermometer bit segment T2 is allocated to major modulation segment C. If T2 had been allocated to major modulation segment B, then there would be an inherently higher probability that a viewer would see some flicker. If T2 had been allocated to major modulation segment A then there would be a far greater probability that a viewer would see flicker.

In summary, a set of rules to guide the distributing of thermometer bits and binary weighted lesser significant bits among the major modulation segments must take into account the need to minimize visual artifacts such as flicker and lateral field effects. Following this set of rules will establish a set of modulation sequences that can be tested. Ultimately a visual test of reference material of known qualities is required but these steps have been tested and found to yield good results.

First, determine the number of major modulation segments required for each color and set a time order for the major modulation segments in an overall modulation scheme.

Second, allocate the binary weighted lesser significant bits for a color to the major modulation segments for that color. Guiding principles include dividing the lesser significant bits such that the overall temporal duration of lesser significant bits is as equal as possible and allocating as few as possible to each major modulation segment.

Third, allocate the thermometer bits to the major modulation segments according to the following principles. A first step is to place the thermometer bits in the major modulation segments such that a first thermometer bit is located in a first major modulation segments and a second thermometer bit is located in a second major modulation segments.

If there are only two major modulation segments then clearly the third major modulation segments can be placed in either segment provided the fourth thermometer bit is placed in the remaining major modulation segment. This insures that the on state times in the major modulation segments will grow evenly, thus minimizing the possibility of flicker.

If there are three major modulation segments, then the first thermometer bit can be placed in the first major modulation segment, the second thermometer bit can be placed in the third major modulation segment, and the third thermometer bit can be placed in the second major modulation segment. It is also possible to allocate the thermometer bits as first thermometer bit to first major modulation segment, second to second and third to third. This is approach may generate a transitory flicker phenomena depending on major changes to gray scale levers between data frames.

If there are four major modulation segments, then the first thermometer bit can be placed in the first major modulation segment, the second thermometer bit can be placed in the third major modulation segment, the third thermometer bit can be place in the second major modulation segment, and the fourth thermometer bit can be place in the fourth major modulation segment. Alternative the third thermometer bit can be placed in the fourth major modulation segment and the fourth thermometer bit can be placed in the second major modulation segment.

If there are five major modulation segments, then the first thermometer bit can be placed in the first major modulation segment, the second thermometer bit can be placed in the third major modulation segment, the third thermometer bit can be placed in the fifth major modulation segment, the fourth thermometer bit can be placed in either the fourth or the second major modulation segment and the fifth thermometer bit can be placed in the remaining major modulation segment.

The guiding principle is that the thermometer bits are to be distributed so that two general conditions are satisfied. First, as the thermometer bits are turned set to an on state the on state time duration of any one of the major modulation segments does not differ from the on state time duration of any of the other major modulation segments. Second, the thermometer bits should be placed in non-adjacent major modulation segments to the extent non-adjacent major modulation segments are available provided that the first generation condition of this paragraph takes precedence. Since the on state or off state status of the binary weighted lesser significant bits is unpredictable those bit are ignored in the application of the guiding principle.

Figure 2:
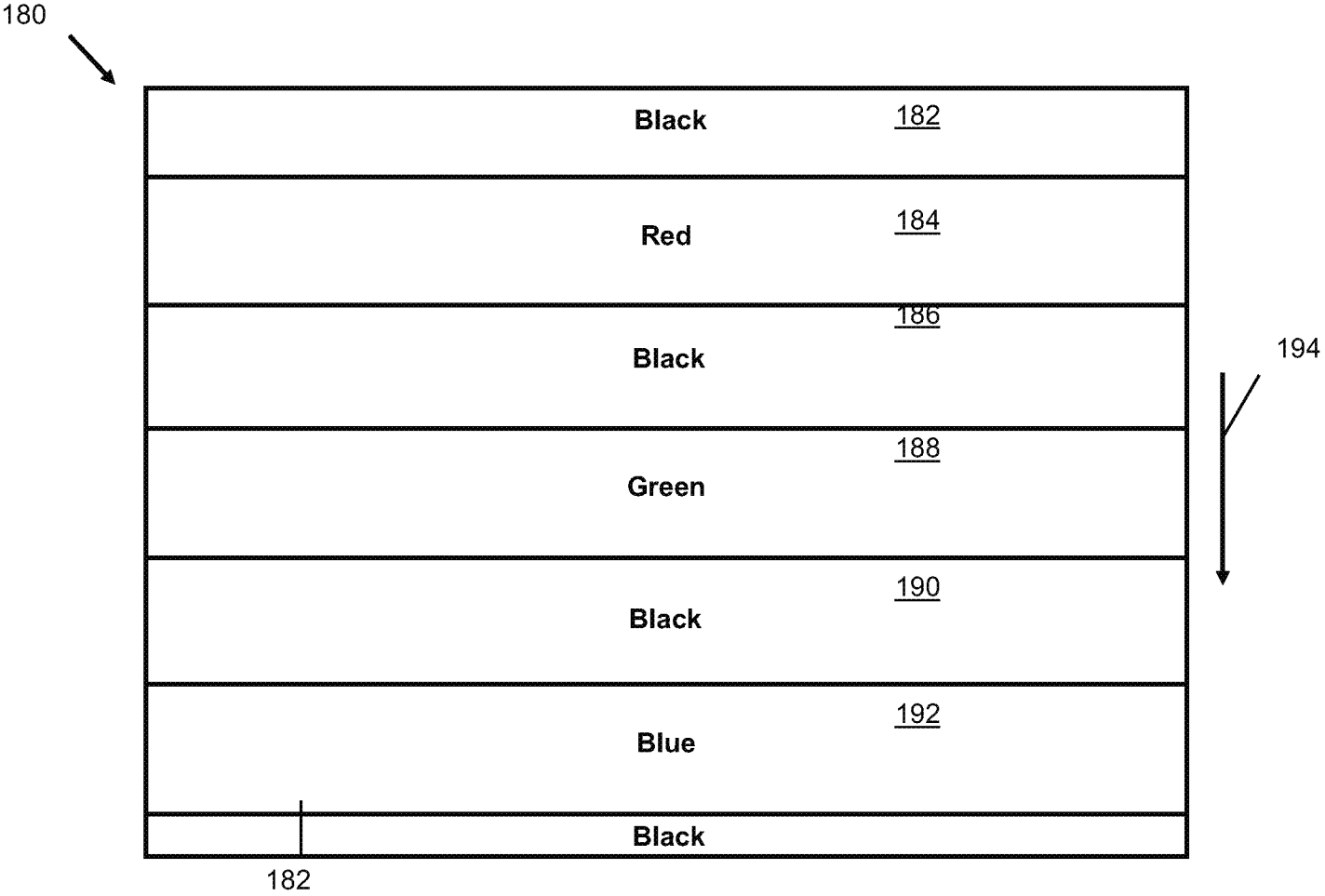
FIG. 2 is a diagram of movement of color bands across the face of a microdisplay in a scrolling color projection display.
Figure 3:
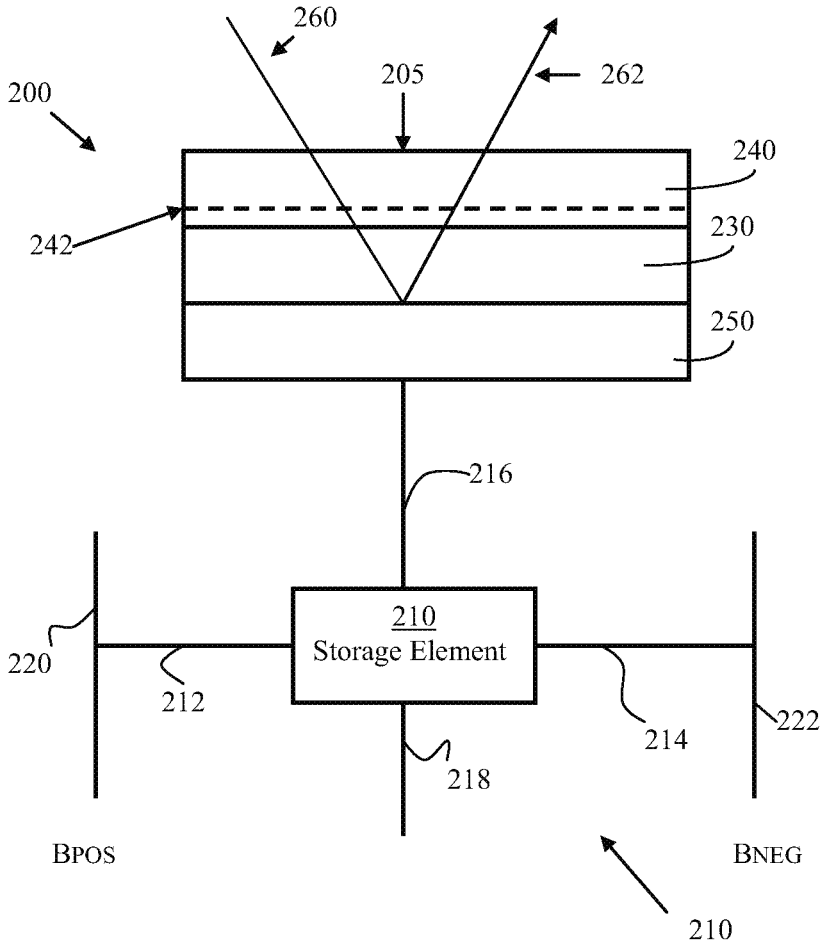
FIG. 3 is a diagram of a single pixel of a liquid crystal on silicon display.
Figure 4:
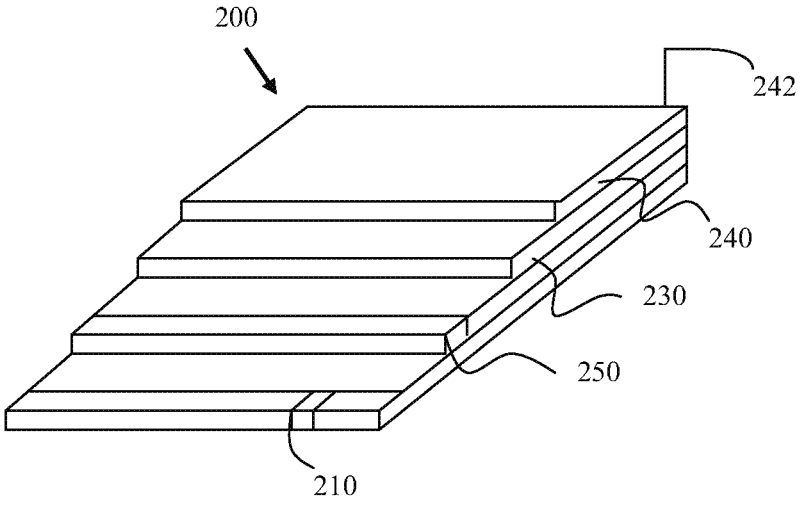
FIG. 4 is a perspective view of the layers of a liquid crystal on silicon display.
Figure 5:
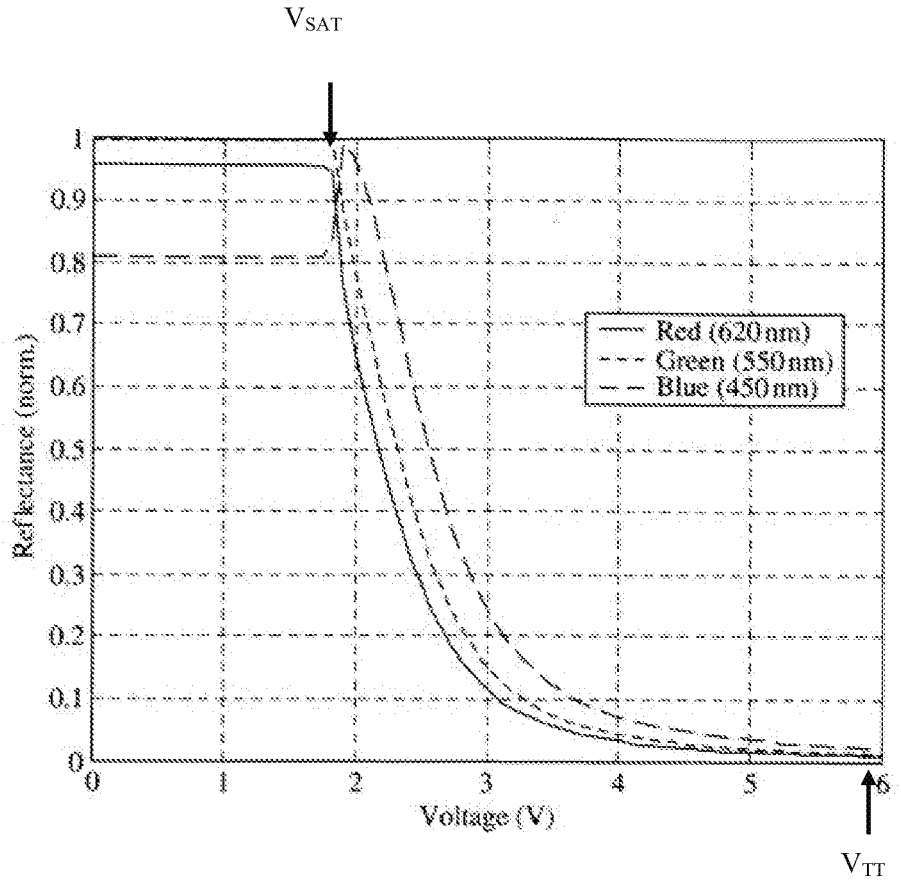
FIG. 5 is a drawing of the voltage response of a nematic liquid crystal cell.
Figure 6:
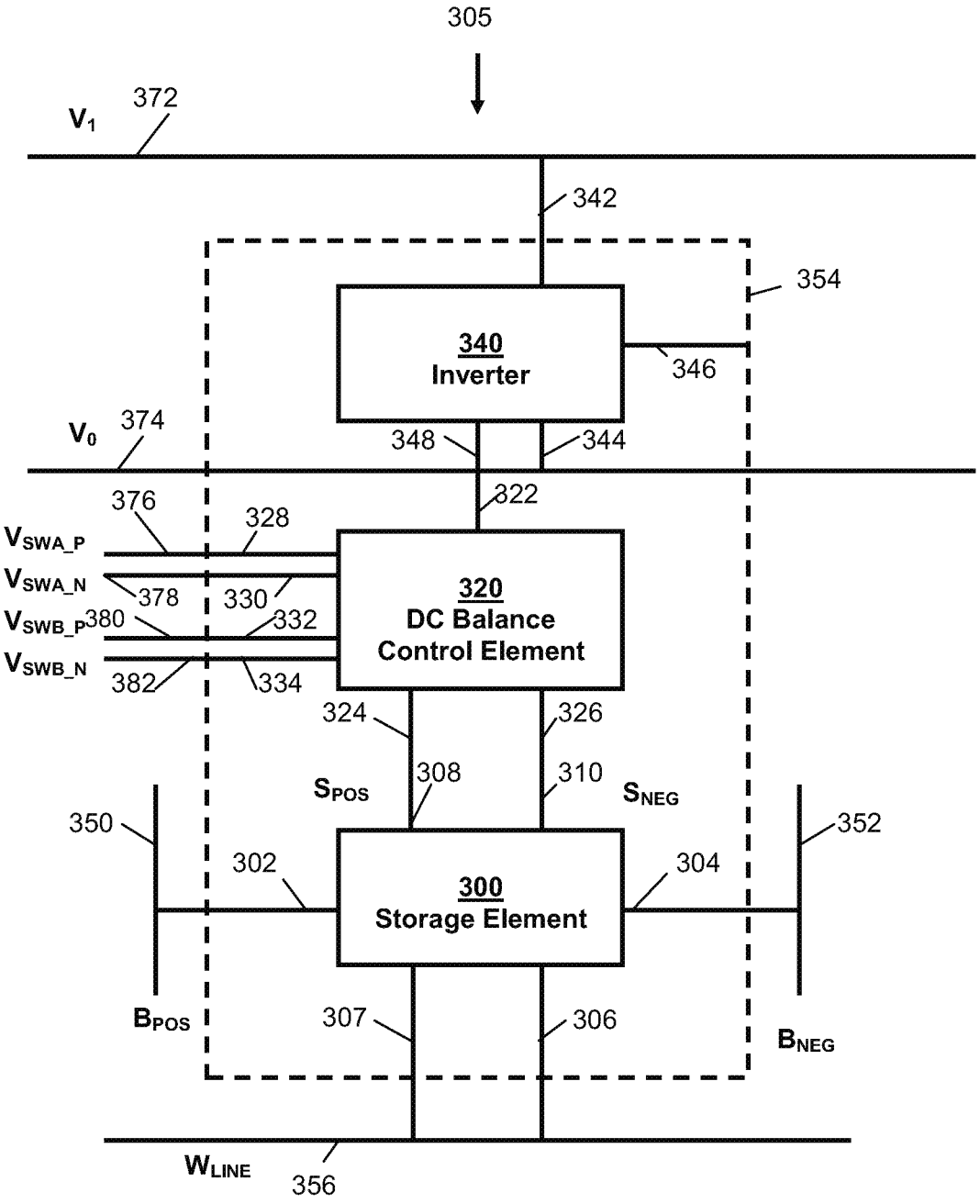
FIG. 6 is a block diagram of a pixel circuit for a liquid crystal on silicon display.
Figure 7:
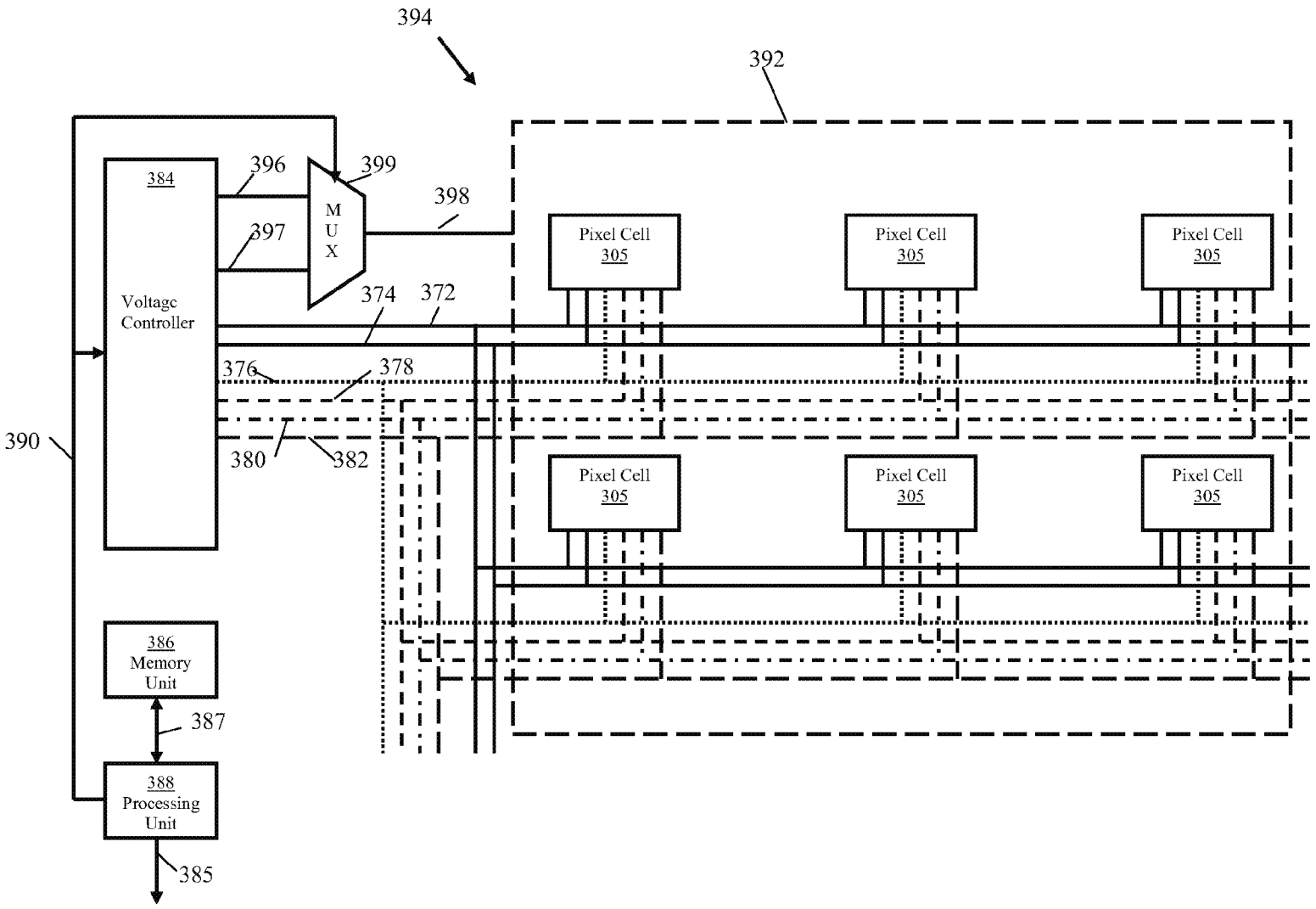
FIG. 7 is a voltage and control diagram of a multi pixel liquid crystal display in accordance with the present invention.
Figure 15B:
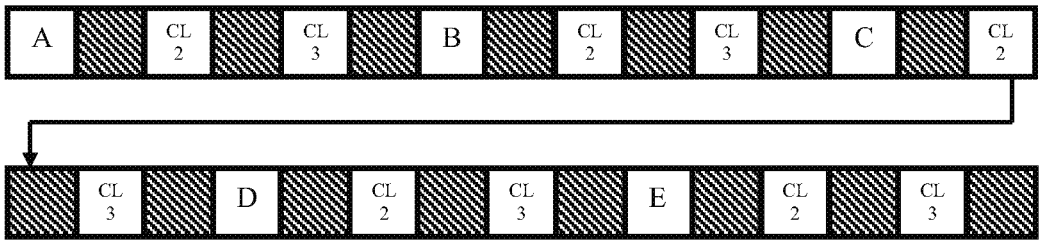
FIG. 15B is a diagram of the operation of the temporally separated pulse width modulation segment of FIG. 15A.

FIG. 15B depicts the temporal order of a set of major modulation segments on a single row. As was previously described in conjunction with FIG. 2, the display is illuminated by a set of scanning color beams. In the example of FIG. 15B major modulation segments A, B, C, D, and E comprise modulation for a single color CL1 (not shown). Two other colors are referred to as CL2 and CL3.

In general the order is CL1 followed by CL2, which is followed by CL3, which is followed by the next instance of CL1. Each color is separated from the color following it by a dark band signified by the shaded blocks of FIG. 15B. The first instance of CL1 is signified by A and comprises the major modulation segment A of FIG. 15A. The second instance of CL1 is signified by B and comprises the major modulation segment B of FIG. 15A. The third instance of CL1 is signified by C and comprises the major modulation segment C of FIG. 15A. The fourth instance of CL1 is signified by D and comprises the major modulation segment D of FIG. 15A. The fifth instance of CL1 is signified by E and comprises the major modulation segment E of FIG. 15A.

The writing of data in the sequential manner of FIG. 15B is a repeating loop. In some instances there may short stalls initiated to permit the transition from one image data source to another but the display may continue operating in this fashion for hours or days.

FIGS. 16A-16E comprise the major modulation segments A-E with the write pointers that begin each modulation segment within the major modulation segment annotated. Each write pointer title comprises three parts in the form $A1_i$. The first letter, A in the instance, denotes which major modulation segment it is associated with. The second item is a number which identifies its position in the temporal order within the major modulation segment. Thus A1 is the first write pointer in major modulation segment A. The letter sub I represents an integer where I=1, 2, 3, etc., in temporal order to denote which instance of the major modulation segment the write pointer belongs to. Thus $A5_1$ is the fifth write pointer of major modulation segment belonging to the first instance thereof. This write pointer notational scheme is used in subsequent figures.

In one embodiment the last write pointer in each of major modulation segments A-E is a terminated write pointer, designated, for example, as $AT1_{i+1}$. In that instance the terminated write pointer is associated with the first write pointer $A1_{i+1}$ of the next instance of the major modulation segment. In one embodiment the last write pointer in a major modulation segment directs off state image data to the last row in each instance of the modulation segment.

FIGS. 17A-17E present to the first 28 rows of a hypothetical display that is 108 rows high. The width of the hypothetical display is not important to this example. Color bands are represented by areas without shading and dark bands are represented by the shaded areas. Each color band and each dark band is 18 rows high. The horizontal axis is time. Each of FIGS. 17A-17E represents a different point in time at which the first write pointer of a major modulation segment is written to row 24 of the display. In this example, because the full range of gray scale is spread across five separate major modulation sequences for each color, the entire display must be written top to bottom five times for each color to achieve full gray scale. Since the display is 108 rows high and it takes 18 time slots for the modulation sequence to advance by one row, the total number of time slots required is 9720, wherein each time slot comprises the act of writing image data to a single row.

A typical frame rate for incoming image data is 60 frames per second, which equates to an image data frame duration of 16.67 milliseconds. 16.67 milliseconds divided by the number of time slots yields 1.715 microseconds per row load time. Applicant has developed a liquid crystal on silicon microdisplay with full high definition resolution, 1920 columns by 1080 rows, exactly 10 times the number of rows in this example. The rows have been demonstrated to load in 0.10 microseconds (100 nanoseconds), so assuming 10 times the number of time slots to modulate the developed full high definition microdisplay after the present invention (since the developed display has 10 times the number of rows in the example), the developed microdisplay could be modulated with a full frame of data as described in this example in 9 milliseconds. This is well under the nominal frame time of 16.67 milliseconds. The circuitry required to accomplish this has been reduced to practice.

Figure 16A:
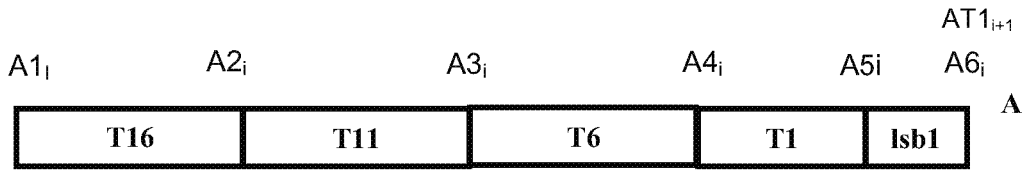
FIGS. 16A-16E are diagrams of a set of temporally separated pulse width modulation segments with write pointers annotated.
Figure 17A:
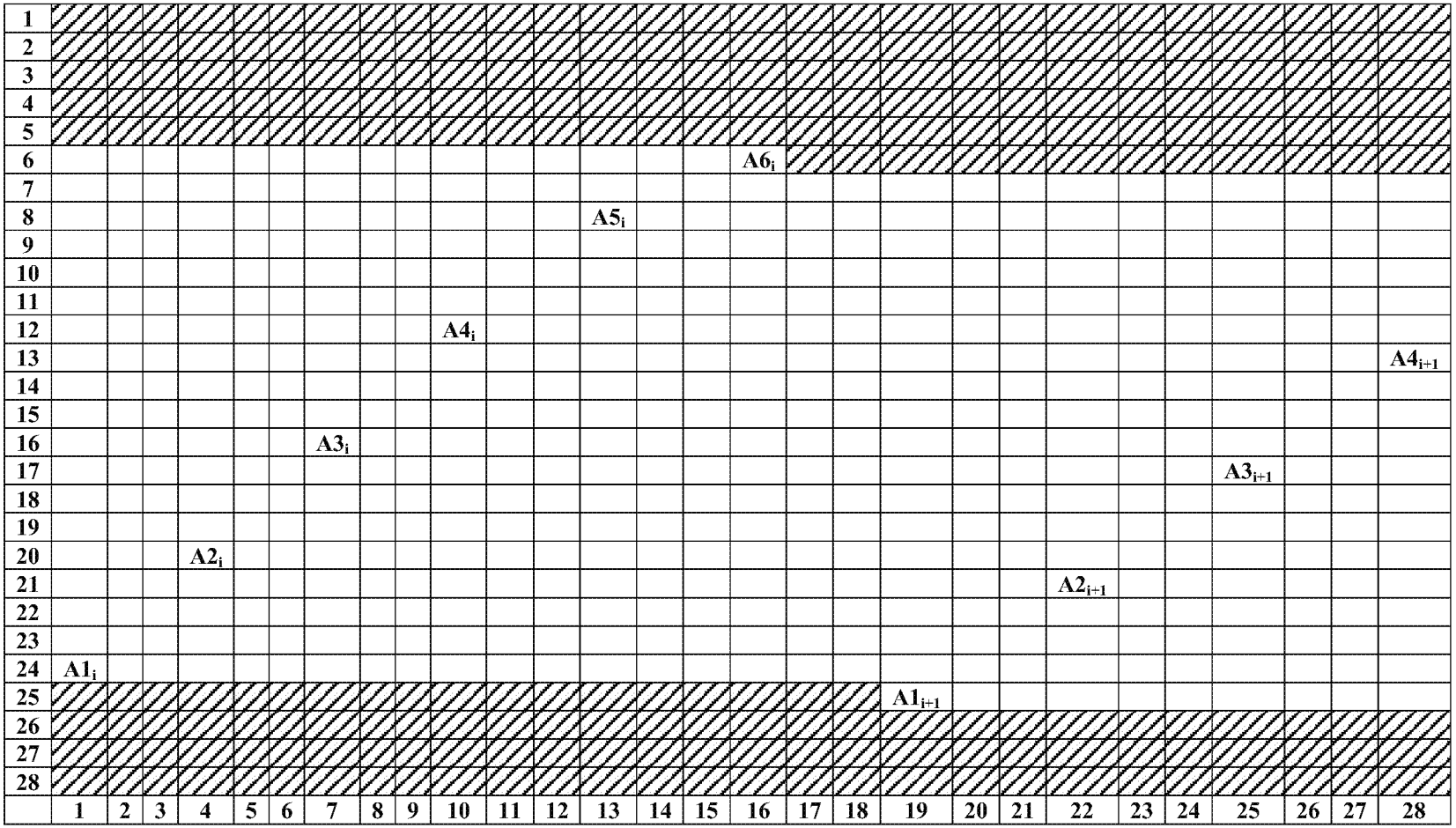
FIGS. 17A-17E are diagrams of a set of rows of a display modulated by an interlaced pulse width modulation scheme in five temporally separated pulse width modulation segments after FIGS. 16A-16E.

FIG. 17A presents a modulation by major modulation segment A after FIG. 16A. A first write point A$\mathbf{1}_i$ initiates a first major modulation segment at row 24 by writing image data to that row at time slot 1. The first major modulation segment ends when write pointer A$\mathbf{6}_i$ directs off state image data to row 6 at time slot 16. The second instance of the major modulation segment starts when write pointer A1i+1 directs image data to row 25 at time slot 19. The major modulation segment ends when A$\mathbf{1}_{i+1}$ directs off state image data to row 7 at time slot 34. (Not shown)

Figure 16B:
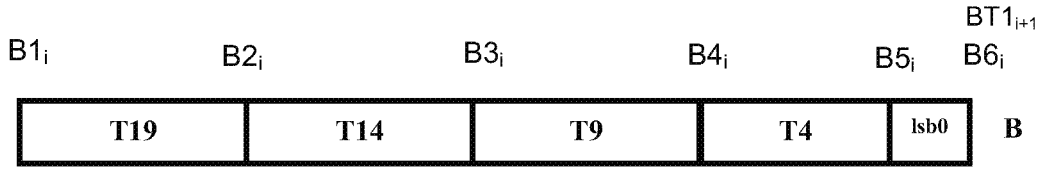
Figure 17B:
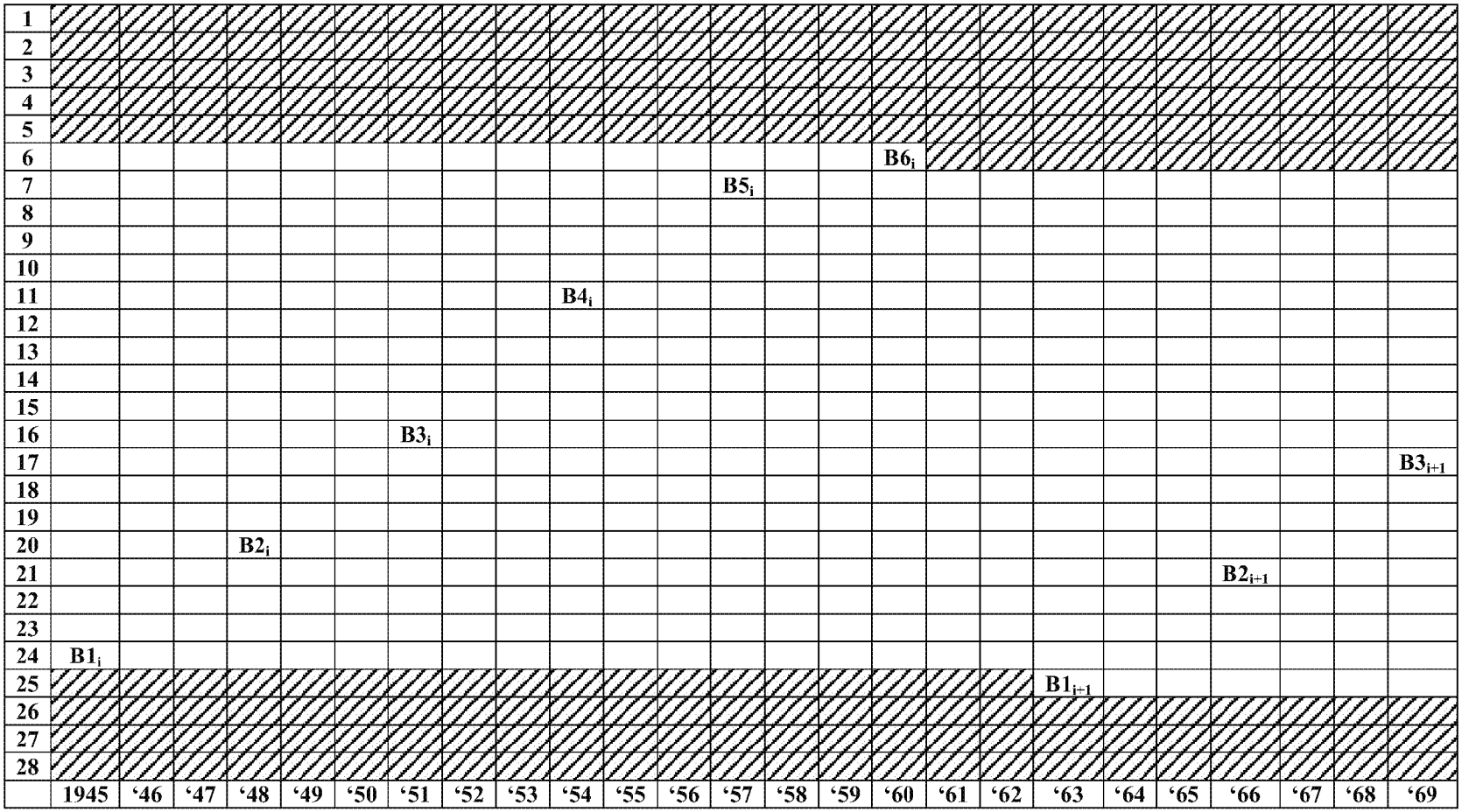

FIG. 17B presents a modulation by major modulation segment B after FIG. 16B. A first write point B$\mathbf{1}_i$ initiates a first major modulation segment at row 24 by directing image data to that row at time slot 1945. The first major modulation segment ends when write pointer B$\mathbf{6}_i$ directs off state image data to row 6 at time slot 1960. The second instance of the major modulation segment starts when write pointer B1i+1 directs image data to row 25 at time slot 1963. The smajor modulation segment ends when B$\mathbf{1}_{i+1}$ directs off state image data to row 7 at time slot 1978. (Not shown)

Figure 16C:
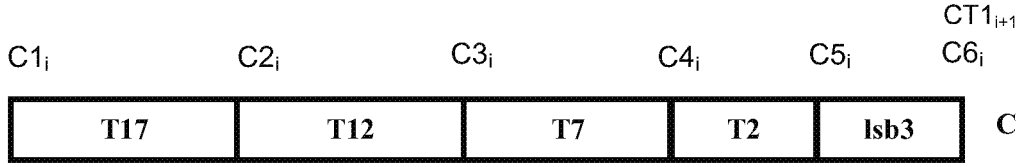
Figure 17C:
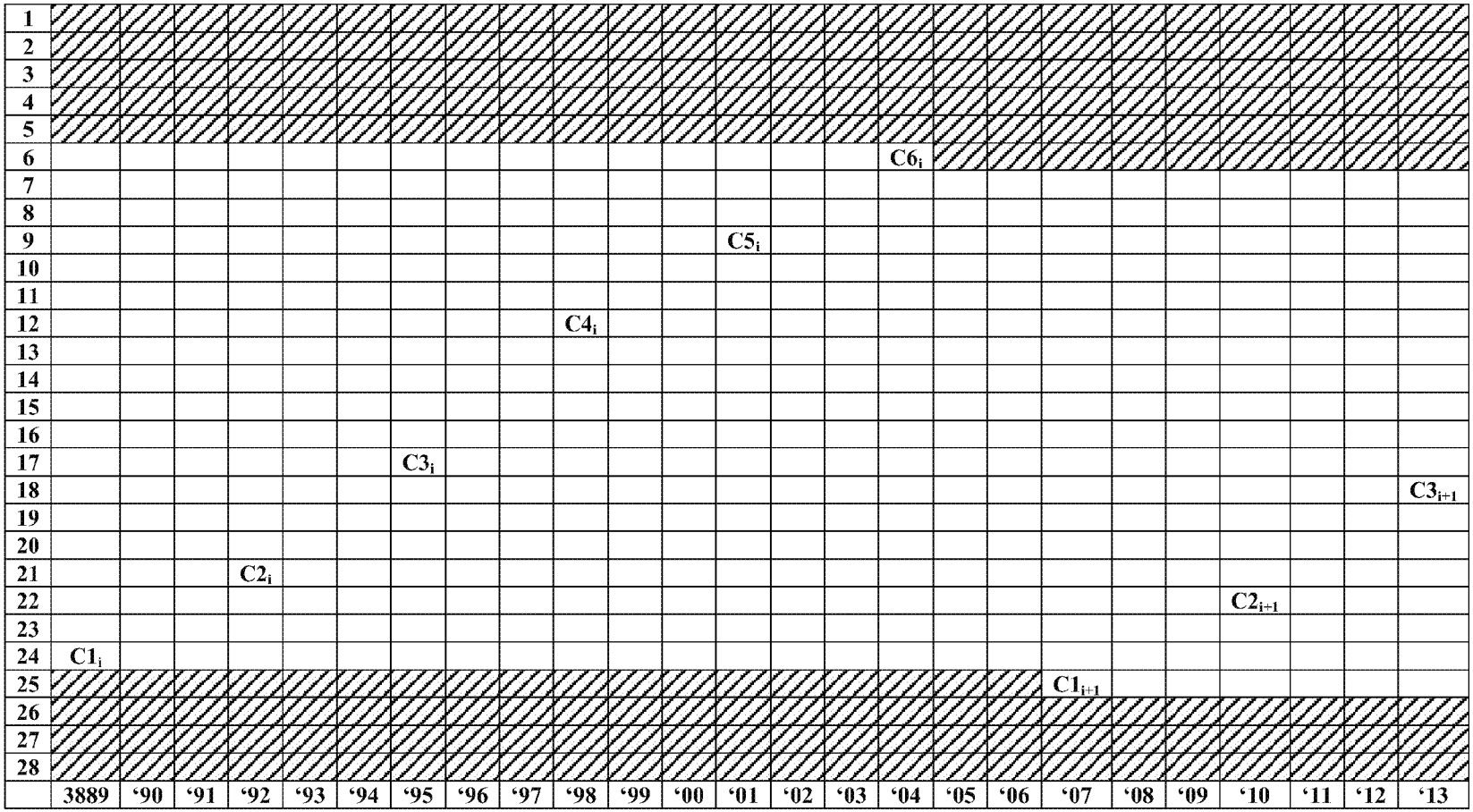

FIG. 17C presents a modulation by major modulation segment C after FIG. 16C. A first write pointer C$\mathbf{1}_i$ initiates a first major modulation segment at row 24 by directing image data to that row at time slot 3889. The first major modulation segment ends when write pointer C$\mathbf{6}_i$ directs off state image data to row 6 at time slot 3904. The second instance of the major modulation segment starts when write pointer C1i+1 directs image data to row 25 at time slot 3907. The major modulation segment ends when C$\mathbf{1}_{i+1}$ directs off state image data to row 7 at time slot 3922. (Not shown)

Figure 16D:
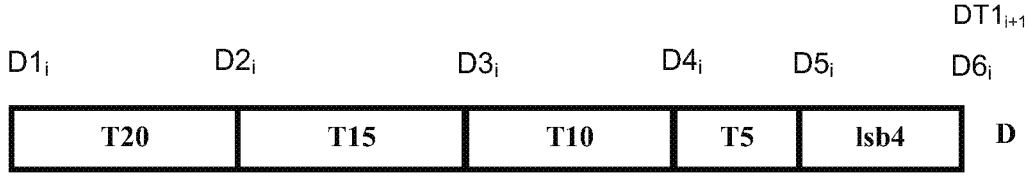
Figure 17D:
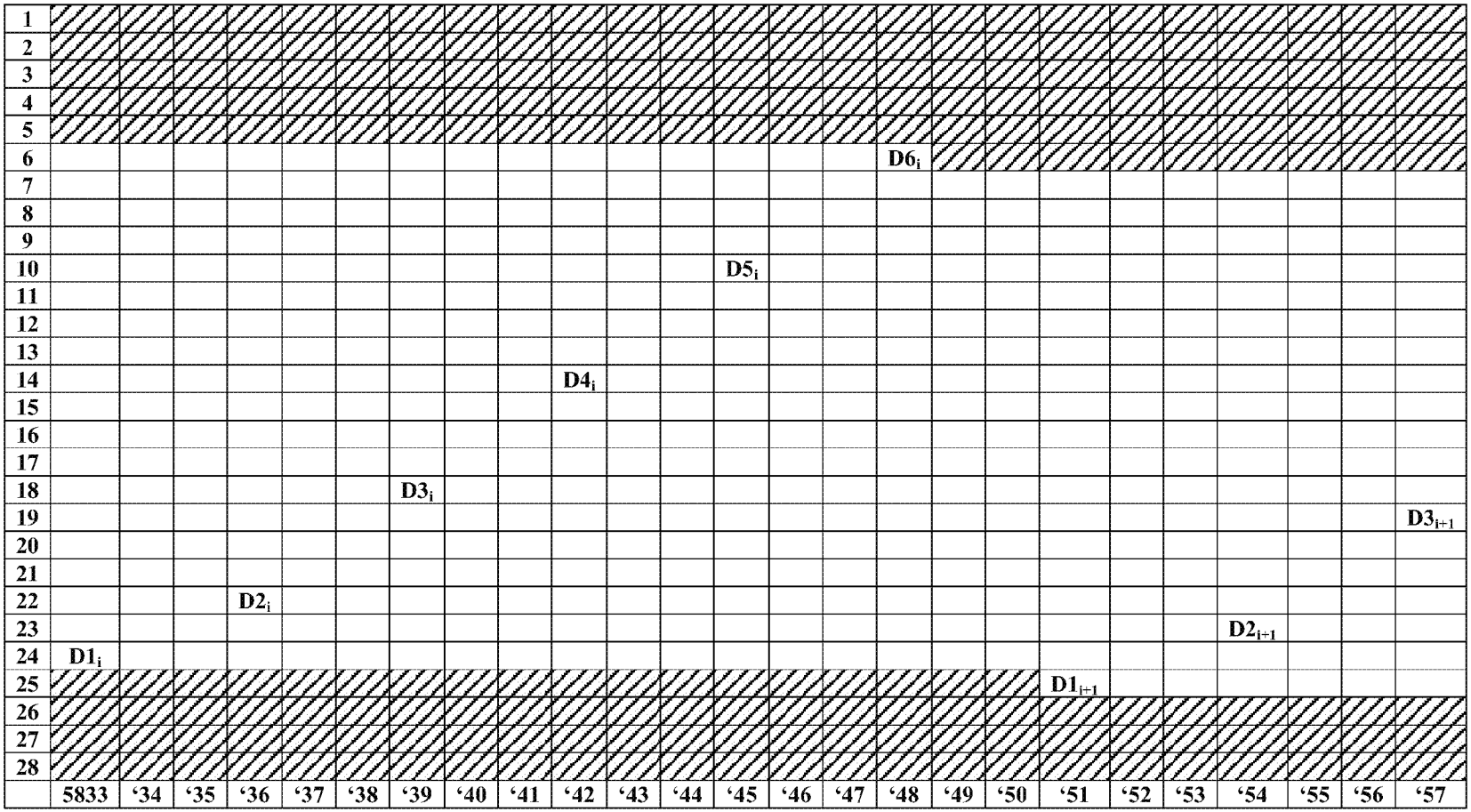

FIG. 17D presents a modulation by major modulation segment D after FIG. 16D. A first write point D$\mathbf{1}_i$ initiates a first major modulation segment at row 24 by directing image data to that row at time slot 5833. The first major modulation segment ends when write pointer D$\mathbf{6}_i$ directs image data rites to row 6 at time slot 5848. For this example write pointer D$\mathbf{6}_i$ directs off state data to all pixels of row 6. The second instance of the major modulation segment starts when write pointer D1i+1 directs image data to row 25 at time slot 5851. The major modulation segment ends when D$\mathbf{1}_{i+1}$ directs off state image data to row 7 at time slot 5866. (not shown)

Figure 16E:
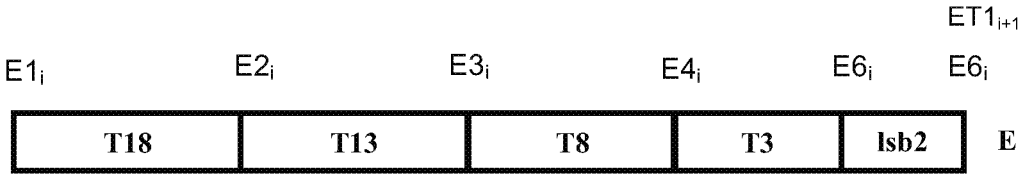
Figure 17E:
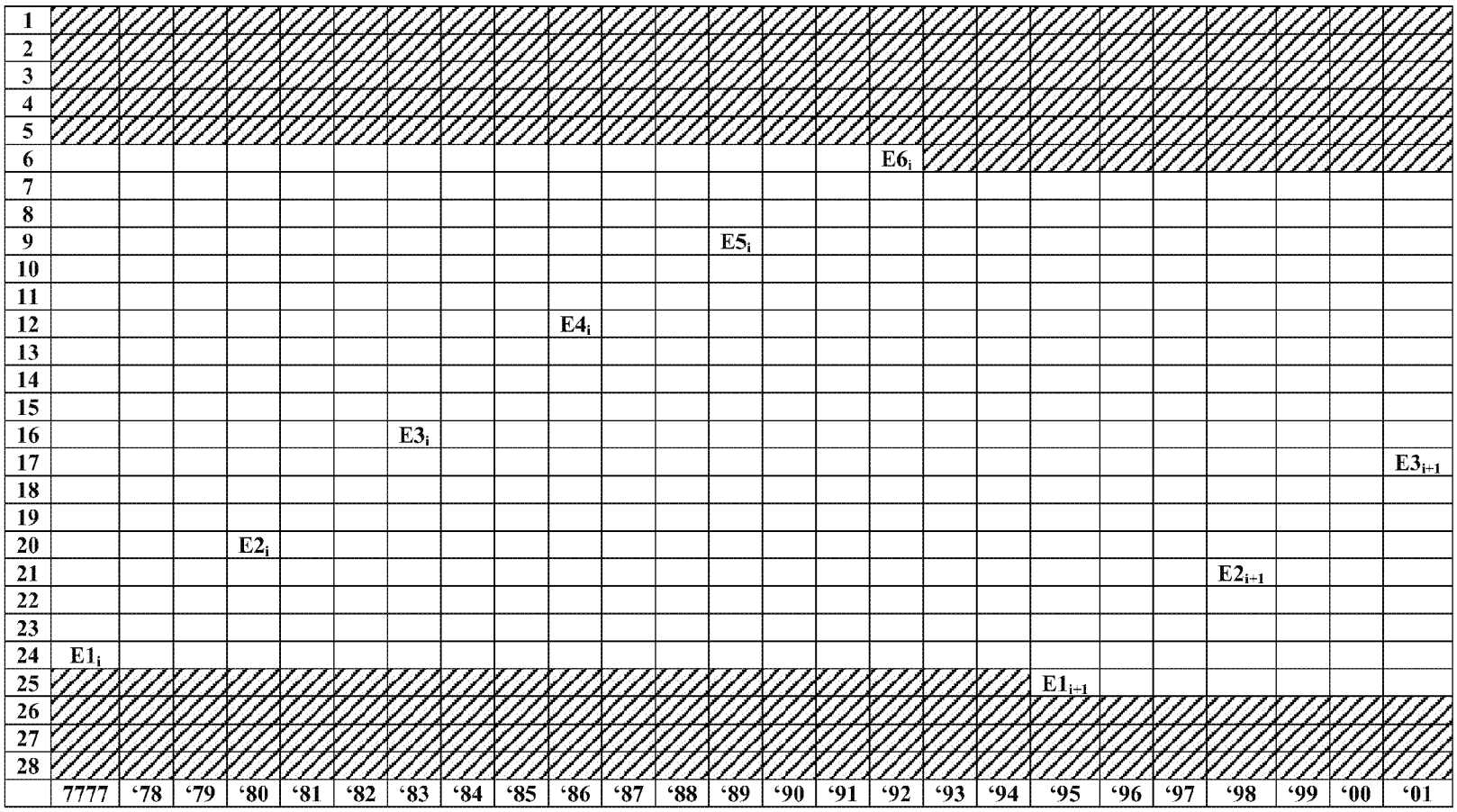

FIG. 17E presents a modulation by major modulation segment E after FIG. 16E. A first write point E$\mathbf{1}_i$ initiates a first major modulation segment at row 24 by directing image data to that row at time slot 7777. The first major modulation segment ends when write pointer E$\mathbf{6}_i$ directs off state image data to row 6 at time slot 7792. The second instance of the major modulation segment starts when write pointer E1i+1 directs image data to row 25 at time slot 7795. The major modulation segment ends when E$\mathbf{1}_{i+1}$ directs off state image data to row 7 at time slot 7810. (Not shown)

Figure 18A:
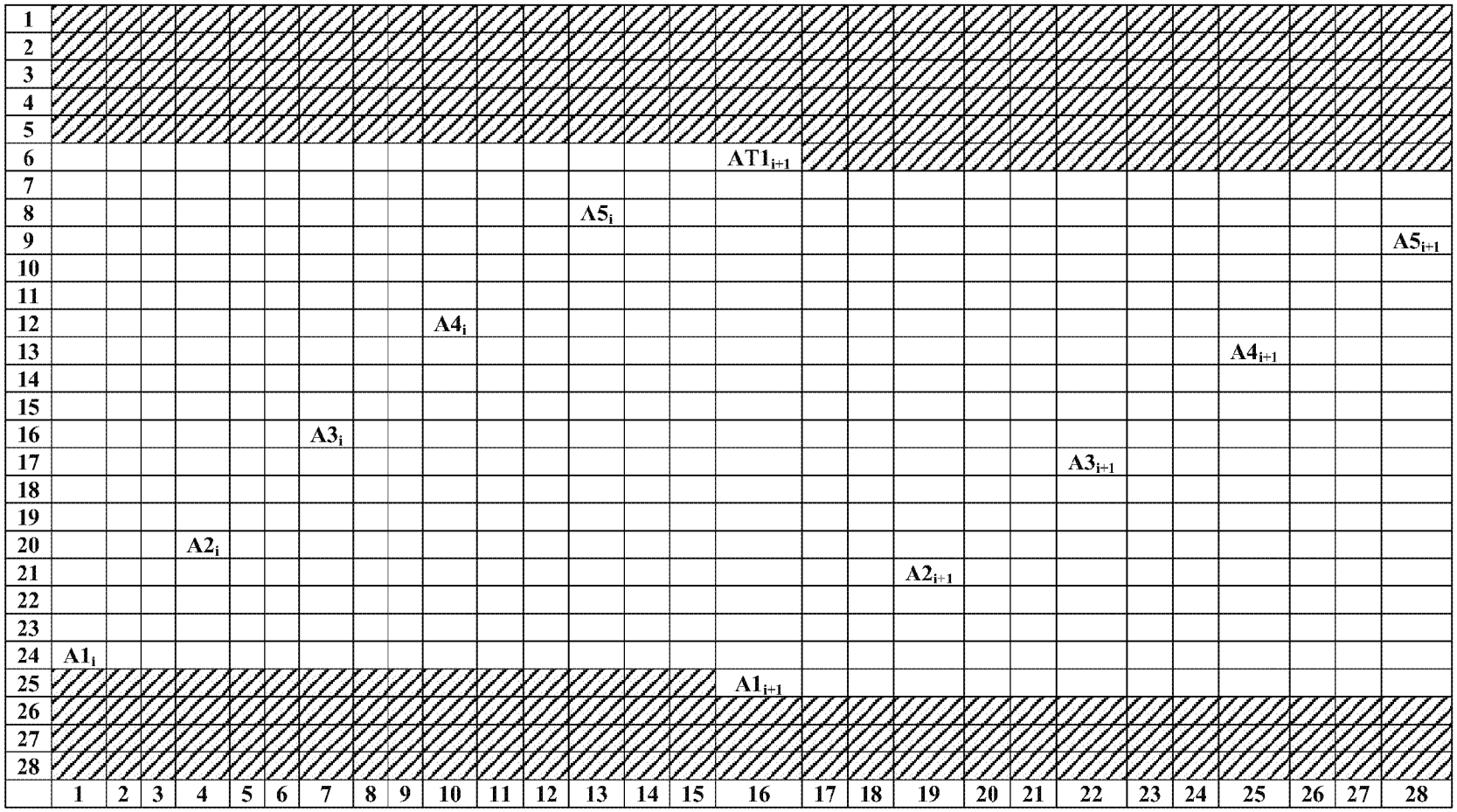
FIGS. 18A-18B are diagrams of a set of rows of a display modulated by an interlaced pulse width modulation scheme utilizing terminated write pointers in a first two of five temporally separated pulse width modulation segments after FIGS. 16A-16B.
Figure 18B:
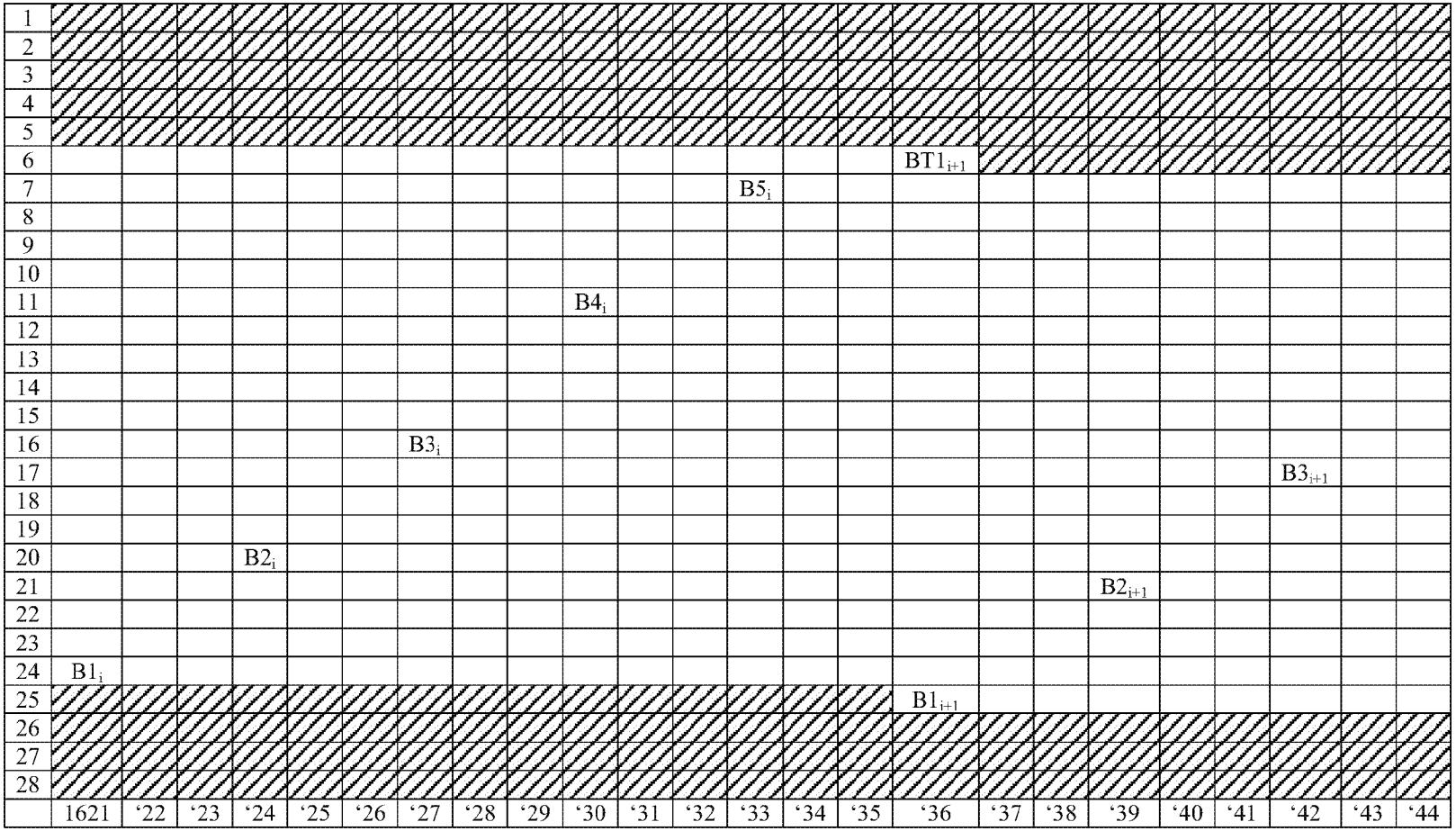

FIGS. 18A and 18B present the first two segments of a set of five major modulation segments that form part of a larger modulation sequence after FIG. 15B comprising three colors, wherein each of the major modulation segments includes a terminated write pointer. FIG. 18A presents a modulation by major modulation segment A after FIG. 16A. A first write pointer A$\mathbf{1}_i$; initiates a first major modulation segment at row 24 by directing image data to that row at time slot 1. The first major modulation segment ends when terminated write pointer AT$\mathbf{1}_{i+1}$ directs off state image data to row 6 at time slot 16. AT is a terminated write pointer associated with write pointer A$\mathbf{1}_{i+1}$. The second instance of the major modulation segment starts when write pointer A1i+1 directs image data to row 25 at time slot 19. The major modulation segment ends when AT$\mathbf{2}_{i+1}$ directs off state image data to row 7 at time slot 34. (Not shown)

FIG. 18B represents the second or "B" segment of the aforementioned set of five major modulation segments. A first write pointer B$\mathbf{1}_i$; initiates the major modulation segment at row 24 by directing image data to that row at time slot 1621. The B major modulation segment ends when BT$\mathbf{1}_{i+1}$ directs off state image data to row 6 at time slot 1636. BT$\mathbf{1}_{i+1}$ is a terminated write pointer associated with B$_{i+1}$ which directs image data value to row 25 at time slot 1636 to begin the next instance of the major modulation segment.

Note that use of the terminated write pointer retains the modulation depth of FIGS. 17A and 17B but requiring fewer time slots to accomplish the bit depth.

Figure 19A:
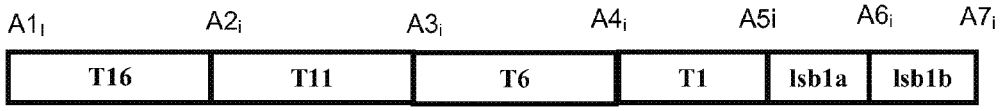
FIG. 19A presents a modulation sequence for one of a set of temporally separated pulse width modulation segments after FIG. 16A with a second least significant bit segment operated according to external criteria.
Figure 19B:
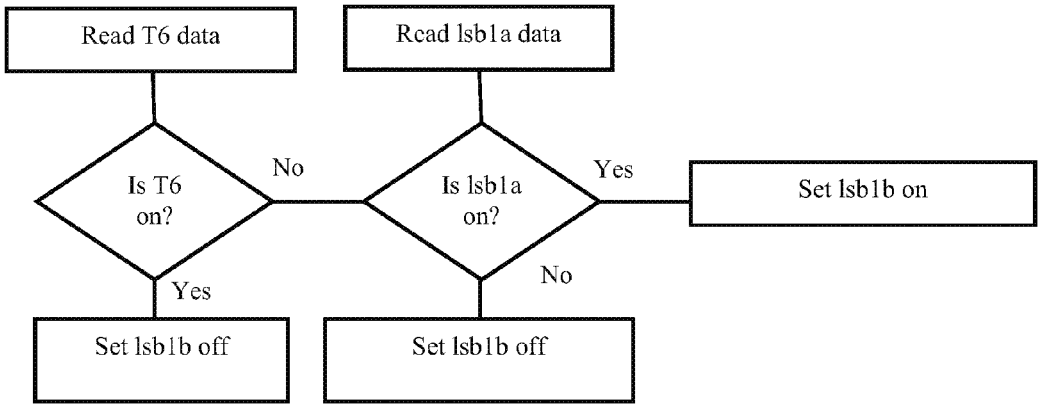
FIG. 19B presents a flow chart of decision criteria to determine when a second least significant bit segment after

FIGS. 19A and 19B illustrate one example of a method for determining when a second lsb segment lsb1*b* should be active or on and when it should inactive or off. The example of 19A is after FIG. 16A but with the addition of the aforementioned lsb segment lsb1*b*. In this example the logic first analyzes the status of thermometer bit T6. If T6 is on then lsb1*b* is off. This is one criterion. If T6 is off, then next lsb1*a* is analyzed. If lsb1*a* is off then lsb1*b* is off. If lsb1*a* is on, then lsb1*b* is on. This is a second criterion. The general principle is that if lsb1*a* is on in the presence of T6, then the extra on time from lsb1*b* is not needed to generate the level of gray scale desired. Those of ordinary experience in the art will recognize that other logic criteria may be used. The logic may be more complex. Those of ordinary experience may recognize that the duration of lsb1*a* and lsb1*b* need not be identical.

Figure 20A:
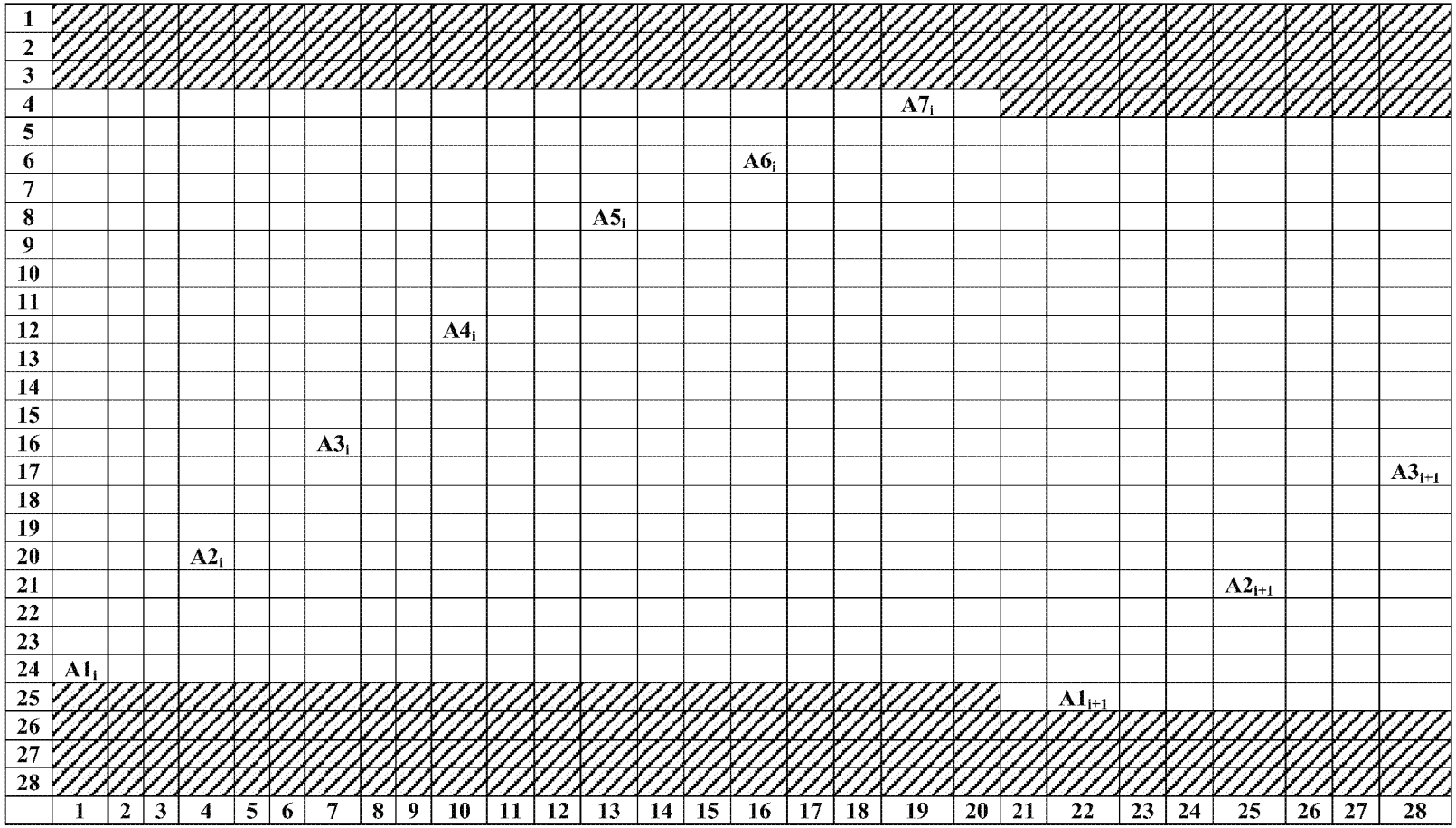
FIGS. 20A and 20B are diagram of a set of rows of a display modulated by an interlaced pulse width modulation scheme in a first two of five temporally separated pulse width modulation segments wherein additional lesser bit segments are operated according to external criteria.
Figure 20B:
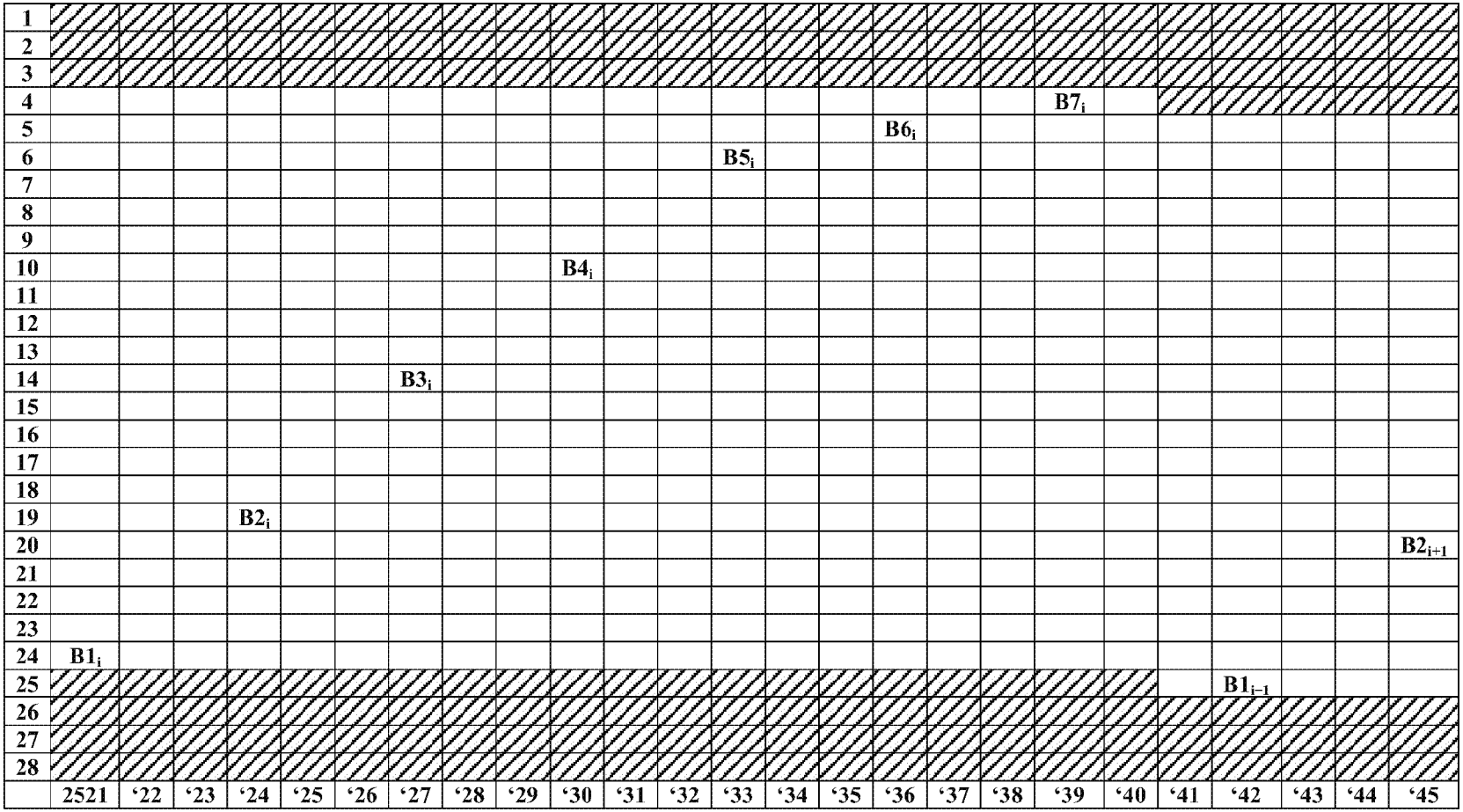

FIGS. 20A and 20B present the first two segments of a set of five major modulation segments that form part of a larger modulation sequence after FIG. 15B comprising three colors, wherein each of the major modulation segments includes a second lsb segment. The display of this example comprises 120 rows. Each color band is 20 rows high and each dark band is 20 rows high (not shown). Each major modulation segment requires 21 rows to fully execute. For this example it is assumed that the last write pointer writes the row to which it is written to the dark or off state.

With 5 major modulation segments for each color, the total number of time slots required to write the entire display is 12,600. Each major modulation segment requires 21 rows to fully execute. For this example it is assumed that the last write pointer directs off state image data to the row to which it is written. The number of time slots per major modulation segment is 21. The major modulation segment is applied and then moved down by one row so to modulate the entire display once will require 21 times 120 total time slots or 2520 time slots. The total number of time slots is therefore 12,600.

FIG. 20A presents a modulation by major modulation segment A after FIG. 16A with the addition of a second lsb. A first write pointer A$\mathbf{1}_i$ initiates a first major modulation segment by directing image data to row 24 at time slot 1. Write pointer A$\mathbf{5}_i$ directs image data to row 8 at time slot 13. Write pointer A$\mathbf{6}_i$ directs image data to row 6 at time slot 16. The first major modulation segment ends when write pointer A$\mathbf{7}_i$ directs off state image data to row 4 at time slot 19. That the row spacing between $A5_i$ and $A6_i$ is two rows with three time slots between them. In like manner the row spacing between $A6_i$ and $A7_i$ is two rows with three time slots between them. The weighting of 2 between $A5_i$ and $A6_i$ is after lsb1 of FIG. 16A. The weighting of 2 between $A6_i$ and $A7_i$ is after the example of 19A. The second instance of major modulation segment A starts when write pointer $A1_{i+1}$ directs image data to row 25 at time slot 22.

FIG. 20B presents major modulation segment B. The first modulation major modulation segment B begins when write pointer $B1_i$ directs image data to row 24 at time slot 2521. Write pointer $B5_i$ directs image data to row 6 at time slot 2533. Write pointer B6i directs image data to row 5 at time slot 2536. The first major modulation segment ends when write pointer $B7_i$ directs off state image data to row 4 at time slot 2539. That the row spacing between $B5_i$ and $B6_i$ is one row with three time slots between them. In like manner the row spacing between $B6_i$ and $B7_i$ is one row with three time slots between them. The weighting of 1 between $B5_i$ and $B6_i$ is after lsb0 of FIG. 16B. The weighting of 1 between $B6_i$ and $B7_i$ is after the example of FIG. 19A. The second instance of major modulation segment B starts when write pointer $B1_{i+1}$ directs image data to row 25 at time slot 2542.

Figure 21A:
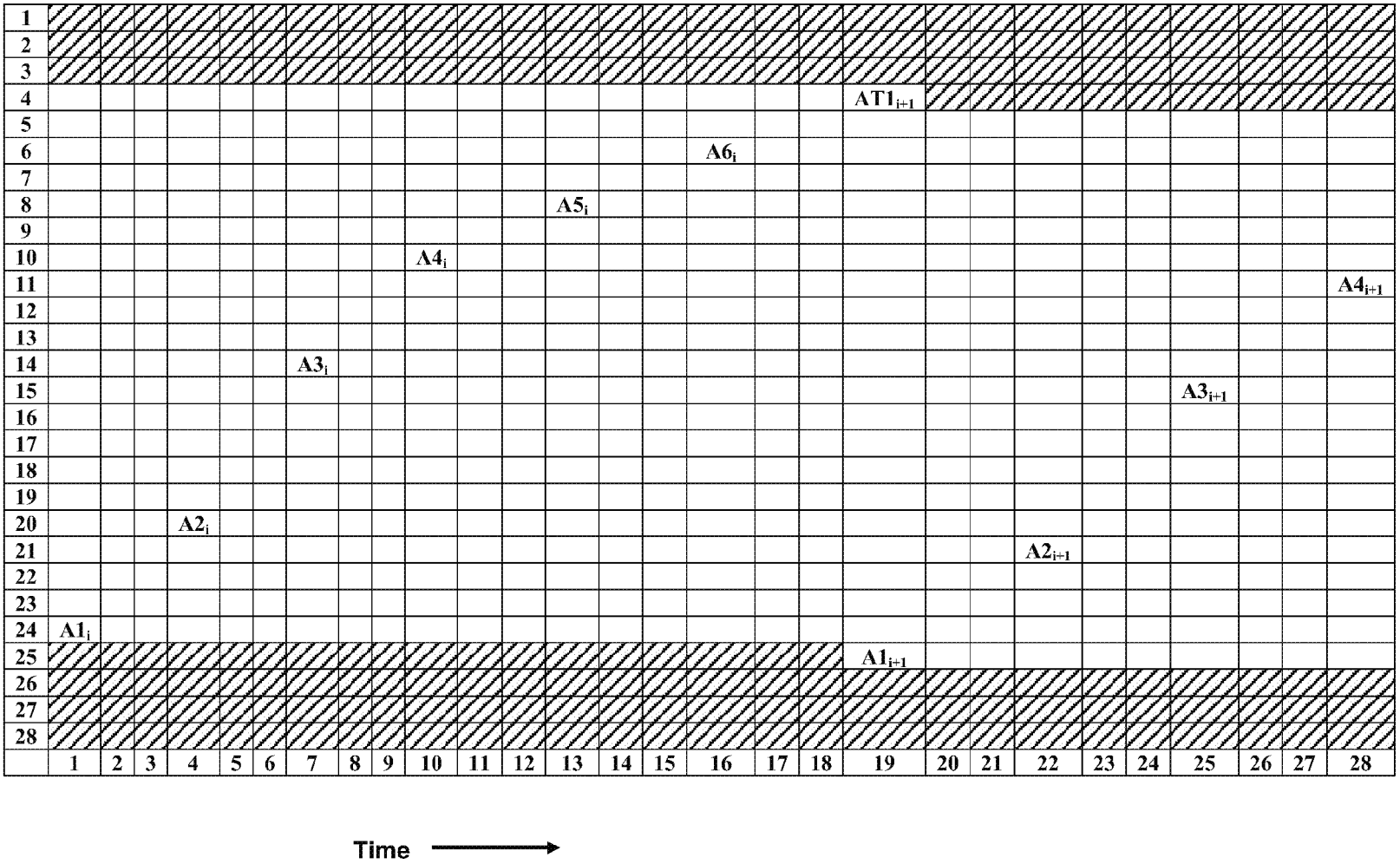
FIGS. 21A and 21B are diagram of a set of rows of a display modulated by an interlaced pulse width modulation scheme utilizing terminated write pointers in a first two of five temporally separated pulse width modulation segments wherein additional lesser bit segments are operated according to external criteria.
Figure 21B:
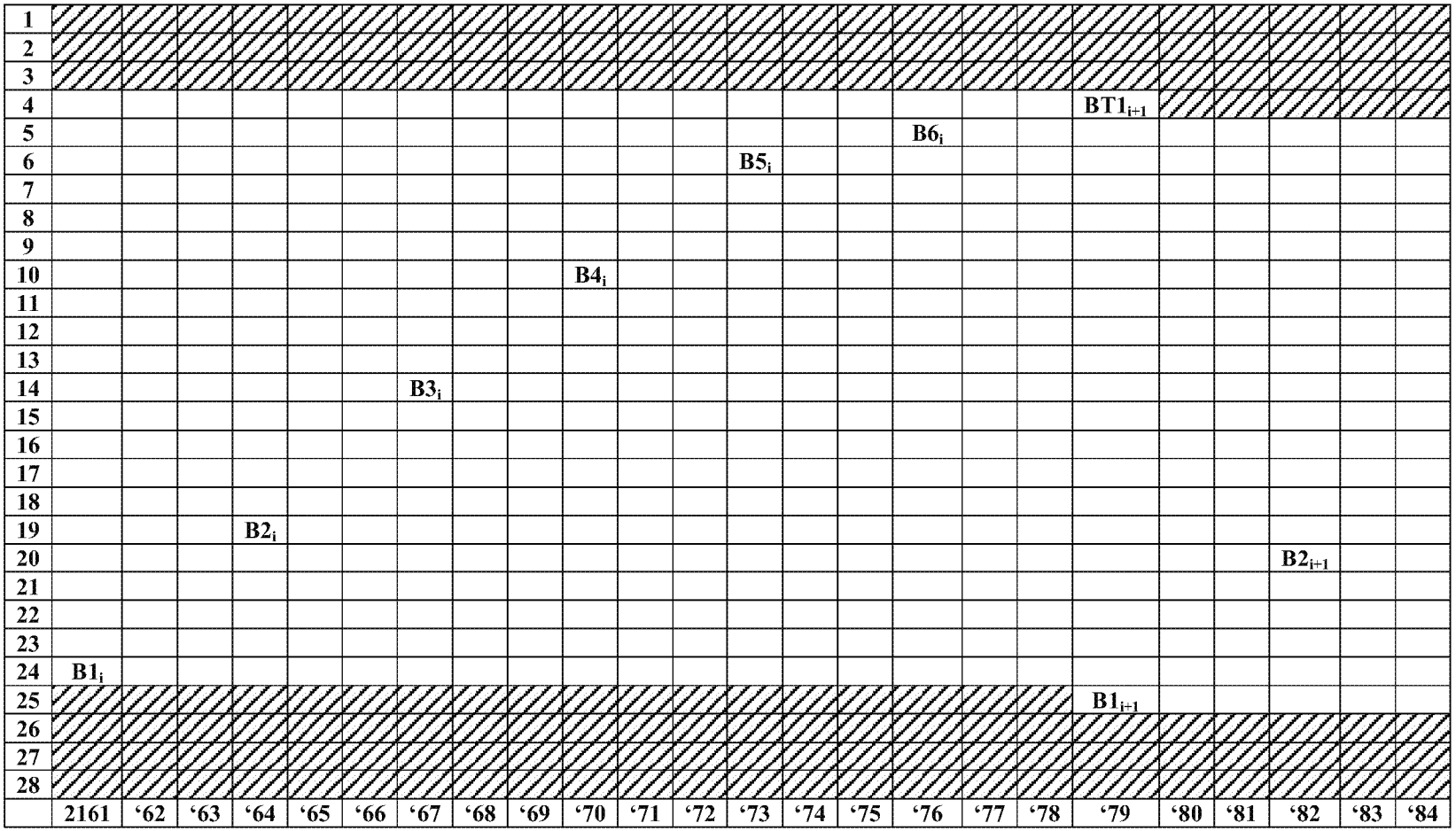

FIGS. 21A and 21B present the first two major modulation segments of a set of five major modulation segments that form part of a larger modulation sequence after FIG. 15B comprising three colors, wherein each of the major modulation segments includes a second lsb segment and wherein the last modulation segment of the major modulation segment is terminated by a terminated write pointer. The display of this example comprises 120 rows. Each color band is 20 rows high and each dark band is 20 rows high (not shown).

Each major modulation segment requires 18 rows to fully execute. For this example it is assumed that the last write pointer writes the row to which it is written to the dark or off state by a terminated write pointer. With 5 major modulation segments for each color, the total number of time slots required to write the entire display is 10,800. The number of time slots per major modulation segment is 18. The major modulation segment is applied and then moved down by one row so to modulate the entire display once will require 18 times 120 total time slots or 2160 time slots. The total number of time slots is therefore 10,800. This is the number of time slots required for each write pointer to write every row of the display.

FIG. 21A presents a modulation by major modulation segment A after FIG. 16A with the addition of a second lsb. A first write pointer A11 initiates a first major modulation segment at row 24 at time slot 1 by writing image data to that row. Write pointer $A5_i$ writes image data to row 8 at time slot 13. Write pointer A6i writes image data to row 6 at time slot 16. The first major modulation segment ends when terminated write pointer $AT1_{i+1}$ directs off state image data to row 4 at time slot 19. $AT1_{i+1}$ is a terminated write pointer associated with write pointer ALA. That the row spacing between $A5_i$ and $A6_i$ is two rows with three time slots between them. In like manner the row spacing between $A6_i$ and $AT1_{i+1}$ is two rows with three time slots between them. The weighting of 2 between $A5_i$ and $A6_i$ is after lsb1 of FIG. 16A. The weighting of 2 between $A6_i$ and $AT1_{i+1}$ is after the examples of FIG. 16B and FIG. 19A. The second instance of major modulation segment A starts when write pointer $A1_{i+1}$ writes to row 25 at time slot 19.

FIG. 21B presents major modulation segment B. The first modulation major modulation segment B begins when write pointer $B1_i$ directs image data to row 24 at time slot 2161. Write pointer $B5_i$ directed image data to row 6 at time slot 2173. Write pointer $B6_i$ directs image data to row 5 at time slot 2176. The first major modulation segment ends when write pointer $BT1_{i+1}$ directs off state image data to row 4 at time slot 2179. Terminated write pointer $BT1_{i+1}$ is associated with write pointer $B1_{i+1}$. The row spacing between $B5_i$ and $B6_i$ is one row with three time slots between them. In like manner the row spacing between $B6_i$ and $B7_i$ is one row with three time slots between them. The weighting of 1 between $B5_i$ and $B6_i$ is after lsb0 of FIG. 16B. The weighting of 1 between $B6_i$ and $B7_i$ is after the examples of FIG. 16B and FIG. 19A. The second instance of major modulation segment B starts when write pointer $B1_{i+1}$ directs image data to row 25 at time slot 2179.

Figure 22A:
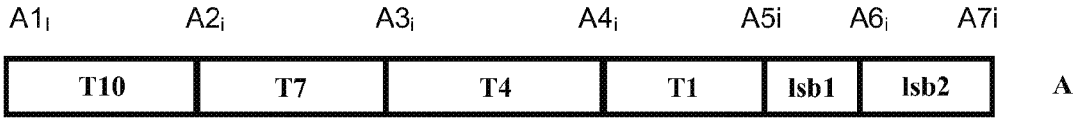
FIGS. 22 A-22C are a diagram of a set of major modulation segments depicting an instance wherein one or more of the major modulation segments comprises a plurality of the lesser significant bits of the set of major modulation segments.
Figure 22B:
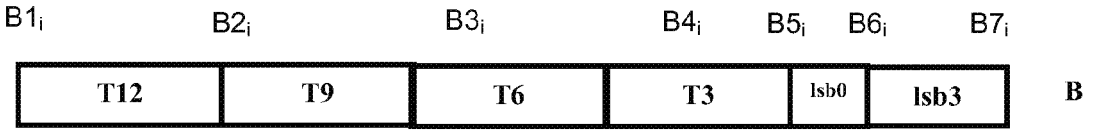
Figure 22C:
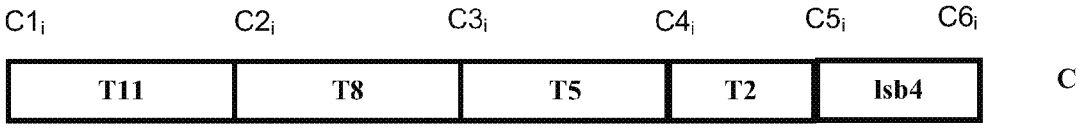

FIGS. 22A-22C depict a set of major modulation segments after FIGS. 16A-16E wherein the number of major modulation segments is reduced from 5 to 3. There are a variety of reasons for a requirement to do this, the most common being to create the possibility for the input of additional image data frames or the use of image data motion-interpolated to create intermediate image data frames. The proximate cause is the aforementioned limitation of bandwidth.

The example of FIGS. 22A-22C creates roughly equal lesser bit segments. The thermometer bits are adjusted so that the total time for each major modulation segment is substantial equal to the others.

In FIG. 22A lsb1 (value 2 from FIG. 15A) and lsb2 (value 4 from FIG. 15E) are placed at the end of major modulation segment A. The choice of order is to minimize the time between T1, should it be active or on, and the start of lsb2, should lsb1 be off or not active.

In FIG. 22B lsb0 (value 1 from FIG. 15B) and lsb 3 (value 8 from FIG. 15C) are placed at the end of major modulation segment B. The choice of order, with lsb0 in first position with lsb3 after, is minimize the time between T1, should it be active, and the start of lsb3, should lsb0 be of or not active.

In FIG. 22C, lsb4 (value 16 from FIG. 15D) is placed at the end of major modulation segment C. This reduces the number of modulation segments in the major modulation segment C from 7 seen in major modulation segments A and B to 6. The gray scale values are proportional to row spacing rather so devising a major modulation segment of correct gray scale value is not dependent on the preservation of numbers of modulation segments.

The pulse width modulation methods disclosed in the present application are compatible with scrolling color projection system 105 of FIG. 1. The modulation methods are also compatible with scrolling color projection system 105 of FIG. 1 when optional spatial light modulator 165 is present to enable the projection of stereoscopic images.

Thus applicant has demonstrated embodiments capable of pulse width modulating a scrolling color projection system. Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

What is claimed is:

1. A method for pulse width modulating a display, wherein said display comprises at least two display sections, each comprising a plurality of rows, wherein said display responds to changes in image data on a pixel by changing the modulation of the light incident on said pixel responsive to said image data, the method comprising:

applying a pattern of virtual write pointers operative to direct image data to the rows of a display, said pattern configured such that a first write pointer is operative to direct image data to a first row in a first display section;

wherein said pattern of virtual write pointers comprises a plurality of write pointer groups, wherein a first group of virtual write pointers comprised of the first write pointer in each of said at least two display sections direct image data to a like number of rows, one in each display section, and wherein a second group of virtual write pointers wherein a second group of write pointers comprised of the second write pointer in each of said at least two display sections direct image data to a like number of rows, one in each display section, and wherein a third group of virtual write pointers comprised of the third write pointer in each of said at least two display sections direct image data to a like number of rows, one in each display section, and wherein a subsequent group of virtual write pointer comprising the next subsequent write pointer in each of said at least two display sections direct image data to a like number of rows, one in each display section, until all write pointers for all display sections have directed image data to their respective rows;

wherein each said first row in a display section is separated from each second row in the same display section by a first number of rows comprising at least one row, and wherein said second row in the same display section is separated from said third row in the same display section by a second number of rows different from said first number of rows and by at least one row;

applying said pattern of virtual write pointers to said at least two display sections with at least one row offset from said earlier first row in said first display section, and then repeating the previously described row write actions with said at least one row offset, said row write offset being the same in all instances; and continuing until all rows have been written by all write pointers.

2. The method of claim 1, wherein said second row is above said first row, and said third row is above said second row.

3. The method of claim 1 wherein said second row is below said first row, and said third row is below said second row.

4. The method of modulating a display of claim 1 wherein the boundaries for said at least two imaging sections move at the same rate as the write pointers of the imaging sections.

5. The method of modulating a display of claim 4 wherein the boundaries for each of said at least two imaging sections are substantially coextensive with a moving band of color of a scrolling color display.

6. The method of modulating a display of claim 5 wherein each of said at least two imaging section are illuminated by moving bands of color of different colors.

7. The method of modulating a display of claim 1 wherein the boundaries for said at least two imaging section are fixed.

8. The method of modulating a display of claim 7 wherein stereoscopic imaging data for a left eye is displayed in a first imaging section and stereoscopic image data for a right eye is displayed in a second image section.

9. The method of modulating a display of claim 1 wherein one of said write pointers in a row write sequence is a terminated write pointer positioned at the end of said row write sequence within said imaging segments and operative to direct off state image data to a row of said imaging segment.

10. The method of modulating a display of claim 1 wherein a lesser significant bit of image data is represented by two modulation segments wherein a first modulation segment is set to on state according to a first set of criteria and a second modulation segment is set to on state according to a second set of criteria, one of said second set of criteria comprising said first modulation segment is set to on state.

11. The method of modulating a display of claim 1, wherein the display receives digital image data from an image data source and reformats said digital image data into a set of binary weighted and non-binary weighted modulation segments, and wherein said set of binary weighted and non-binary weighted modulation segments are formed into a modulation sequence.

12. The method of modulating a display of claim 1, wherein image data for each color is organized into a plurality of major modulation segments, wherein each of said plurality of major modulation segments comprises less than the full range of gray scale values for that color.

13. The method of modulating a display of claim 12 wherein said non-binary weighted bits are thermometer bits.

14. The method of modulating a display of claim 13 wherein said thermometer bits are distributed across said plurality of major modulation segments.

15. The method of modulating a display of claim 14 wherein no two consecutive thermometer bits are placed in the same major modulation segment.

16. The method of modulating a display of claim 15 wherein the temporal order of said thermometer bits assigned to each of said major modulation segments are ordered such that the first modulation segments, like in number to the number of said plurality of major modulation segments, are distributed across said plurality of major modulation segments, at the temporal position nearest the end of said major modulation segments, and wherein any remaining thermometer bits remaining for each of said plurality of major modulation segments are positioned adjacent to any previously placed thermometer bits.

17. The method of modulating a display of claim 14 wherein said binary weighted modulation segments are positioned at the temporal end of the major modulation segments.

18. The method of modulation a display of claim 17 wherein a binary weighted modulation segment of greatest weight within each major modulation segment is placed last in said each major modulation segment, and wherein a binary weighted modulation segment of lesser weight within said major modulation segment is placed adjacent to said binary weighted modulation segment of greatest weight within said each major modulation segment, and wherein said first thermometer bit within each major modulation segment is placed adjacent to said binary weighted modulation segments.

19. A method for determining a pattern of virtual write pointers operative to direct image data to the rows of a pulse width modulated display comprising at least two display sections, the method comprising;

selecting a first group of virtual write pointers comprising of a first write pointer for each said display section, and then determining the row spacing between said virtual write pointers of said first group;

selecting a number of rows spacing between each of said first write pointer in each display section in said first group of virtual write pointers and a second write pointer in each of said at least two display sections, said second writer pointers in each of said at least two display sections form a second group of write pointers, wherein each of said second write pointers is referenced to each of said first write pointers in the same display section; and selecting a number of rows spacing between each of said second write pointers in each display section in said second group of virtual write pointer and a third write pointer in each of said at least two display sections, said third write pointers in each of said at least two display sections form a third group of write pointers, wherein each of said third write pointers is referenced to each of said second write pointers in the same display section;

wherein the row spacing between said first write pointers and said second write pointers in each display section is at least one row and wherein the row spacing between said second write pointers and said third write pointers in each section is at least one row, and wherein said row spacing between said first write pointers and said second write pointers in each section is not equal to said row spacing between said second write pointers and said third write pointers in each section; and wherein all remaining write pointers in each display section are positioned with reference to the preceding write pointers in that same display section;

wherein a row offset spacing and direction is determined such that when the entire set of write pointer has been applied in each of the display sections, the row offset is applied and the pattern of virtual of write pointers is applied to the rows of said display again.

20. A pulse width modulated display, wherein said display comprises at least two display sections, each comprising a plurality of rows, wherein said display responds to changes in image data on a pixel by changing the modulation of the light incident on said pixel responsive to said image data, the display comprising:

a display operative to receive image data directed to a row by a virtual write pointer, wherein the row structure of said display comprises a row addressing scheme, operative to address rows individually;

wherein said display receives image data directed to rows of the display based on a pattern of virtual write pointers, said pattern of virtual write pointers operative to direct image data to a first row in a first display section;

wherein said pattern of virtual write pointers comprises a plurality of write pointer groups, wherein a first group of virtual write pointers comprised of a first write pointer in each of said at least two display sections to direct image data to a like number of rows in each display section, and wherein a second group of write pointers comprised of a second write pointer in each of said at least two display sections to direct image data to a like number of rows, one in each display section, and wherein a third group of virtual write pointers comprised of a third write pointer in each of said at least two display sections to direct image data to a like number of rows in each display section, and wherein a subsequent group of virtual write pointer comprising a next subsequent write pointer in each of said at least two display sections to direct image data to a like number of rows in each display section until all write pointers for all display sections have directed image data to their respective rows;

wherein each said first row in a display section is separated from each said second row in the same display section by a first number of rows comprising at least one row, and wherein said second row in the same display section is separated from said third row in the same display section by a second number of rows different from said first number of rows and by at least one row;

wherein said pattern of virtual write pointers direct image data to said at least two display sections with at least one row offset from said earlier first row in said first display section, and then said pattern repeats the previously described row write actions with said at least one row offset, said offset being the same in all instances; and continuing until all write pointers have directed image data to all rows of said display.

* * * * *